US005342748A

United States Patent [19]

Miyoshi et al.

[11] Patent Number: 5,342,748

[45] Date of Patent: Aug. 30, 1994

[54] COLOR PHOTOGRAPHIC LIGHT-SENSITIVE MATERIAL FOR PRINTING USE

[75] Inventors: Masanobu Miyoshi; Makoto Kajiwara; Makoto Onodera, all of Odawara, Japan

[73] Assignee: Konica Corporation, Japan

[21] Appl. No.: 158,354

[22] Filed: Nov. 23, 1993

Related U.S. Application Data

[63] Continuation of Ser. No. 51,606, Apr. 23, 1993, abandoned, which is a continuation of Ser. No. 839,922, Feb. 21, 1992, abandoned, which is a continuation of Ser. No. 366,302, Jun. 13, 1989, abandoned, which is a continuation of Ser. No. 218,448, Jul. 11, 1988, abandoned, which is a continuation of Ser. No. 850,586, Apr. 10, 1986, abandoned.

[30] Foreign Application Priority Data

Apr. 20, 1985 [JP] Japan ..... 60-84759

[51] Int. Cl.[5] ..... G03C 7/38

[52] U.S. Cl. ..... 430/558; 430/504; 430/505; 430/567

[58] Field of Search ..... 430/567, 505, 558 R, 430/504

[56] References Cited

U.S. PATENT DOCUMENTS

| | | | |
|---|---|---|---|
| 4,481,288 | 11/1984 | Yamada et al. | 430/567 |
| 4,536,472 | 8/1985 | Kato et al. | 430/558 |
| 4,576,910 | 3/1986 | Hirano et al. | 430/558 |
| 4,590,153 | 5/1986 | Kawagishi et al. | 430/558 |
| 4,640,889 | 2/1987 | Komorita et al. | 430/505 |
| 4,735,893 | 4/1988 | Morigaki et al. | 430/558 |
| 4,772,542 | 9/1988 | Haga | 430/505 |
| 4,830,956 | 5/1989 | Waki et al. | 430/558 |
| 5,278,038 | 1/1994 | Miyoshi et al. | 430/567 |

*Primary Examiner*—Richard L. Schilling
*Attorney, Agent, or Firm*—Jordan B. Bierman

[57] ABSTRACT

A color photographic light-sensitive material for printing use comprising a reflection type support bearing thereon a blue-sensitive silver halide emulsion layer, a green-sensitive silver halide emulsion layer and a red-sensitive silver halide emulsion layer; wherein a silver halide emulsion contained in said green-sensitive silver halide emulsion layer is a monodispersed silver halide emulsion and a coupler combined with said monodispersed silver halide emulsion is a magneta coupler represented by the following formula I wherein Z represents a group of non-metal atoms necessary for forming a nitrogen-containing heterocyclic ring, and the ring formed by the Z is allowed to have substituents; X represents a substituent capable of splitting off through the reaction thereof on the oxidation products of a color developing agent; and R represents hydrogen or a substituent.

5 Claims, No Drawings

COLOR PHOTOGRAPHIC LIGHT-SENSITIVE MATERIAL FOR PRINTING USE

This application is a continuation of application Ser. No. 51,606, filed Apr. 23, 1993; which is a continuation of application Ser. No. 839,922, filed Feb. 21, 1992; which is a continuation of application Ser. No. 366,302, filed Jun. 13, 1989; which is a continuation of application Ser. No. 218,448, filed Jul. 11, 1988; which is a continuation of application Ser. No. 850,586, filed Apr. 10, 1986, all now abandoned, which, in turn, claims the priority of Japanese Application 84759/85, filed Apr. 20, 1985.

BACKGROUND OF THE INVENTION

The present invention relates to a color photographic light-sensitive material for printing use and more particularly to the color photographic light-sensitive material for printing use which is excellent in gradation characteristics.

Generally speaking, in a negative-positive type color photography, a photographic object is photographed on a color negative film through a camera, so that a negative image may be produced. The resulting negative image is printed on a sheet of color printing paper by a printer, so that a color print of the image may be produced to be a final object of appreciation.

One of the essential factors in controlling the quality of such a color print as described above is the gradation characteristics of a color printing paper.

If the gradation characteristics of a color printing paper are improper, that is, for example, if the gradation of the paper is too hard, the image printed out on the paper will lack the proper image representation especially in the low and high density portions of the printed image; and if the gradation is too soft, the image printed out on the paper will come out dull and fuzzy. The resulting color print came out in either case is not satisfactory in quality.

A color print will not come out satisfactorily in quality even if only the gradation characteristics of a single silver halide emulsion layer are satisfactory. In a substractive color photography, the three colors, cyan, magenta and yellow, are to be well-balanced together from the high-light portions to the shadow portions of a scene.

For example, if the garadation in the high density portions of a magenta color developing layer is relatively softer than those of the other color developing layers, the shadow portions of the layer will be changed from black into greenish black, and if the gradation thereof is relatively too harder, the shadow portion thereof will be changed into redish black. Anyway, a poor color print in color reproductivity will come out in either case. As described above, the gradation characteristics of a color photographic light-sensitive material for color printing use are indispensable from the viewpoints of both tone and color reproductivity. It is therefore demanded to develop a technique capable of enjoying a proper gradation.

One of the most well-known techniques for controlling gradations is to change an amount of silver to be coated on. This technique has such a disadvatage that a maximum density is varied, though this is the easiest way to control gradations. Therefore, this technique is merely used for a fine adjustment or the like.

Another well-known technique is that one and the same layer or separate layers are added with a plurality of silver halide grains which are harder than those in a desired gradation and have the same color sensitivity with and the different photographic sensitivity from each other. This is a technique generally known in the art. According to this technique, it seems to be able to produce any gradation theoretically, however, when applying this technique practically to a commercial production, the practical applicability thereof is limited because of the restrictions in manufacturing facility and costs or the like. Any manufacturing effect may be unable to enjoy if this technique is solely used.

There are well-known gradation adjusting techniques to be used in a process of preparing a light-sensitive silver halide emulsion. They include, for example, a hardening technique in which a metal ion dope such as that of rhodium, iridium or the like is used in a physically ripening process; a technique in which the conditions desired for producing silver halide grains are suitably selected from, for example, a single-jet precipitation process that is suitable for making a soft-type emulsion double-jet precipitation process that is suitable for making a hard-type emulsion and the values of pAg, pH and composition distribution of a silver halide each in producung grains; a technique in which the conditions desired for a chemical sensitization are selected; and the like. The desired gradation may be obtained by using the above-mentioned techniques independently or in combination, however, in almost all cases, the deteriorations will be caused in other photographic characteristics such as sensitivity, fog, reciprocity law failure, latent-image stability, pressure resistance, and the like, or in stability in manufacture, and it requires much trouble to find out the satisfactory conditions in either case. The above-mentioned technique may display only a limited effect if it is put into practical use.

For producing colors in a subtractive color process with a silver halide photographic light sensitive material including a color photographic light sensitive material for printing use, there uses a yellow coupler, a magenta coupler and a cyan coupler capable of forming a yellow dye image, a magenta dye image and a cyan dye image respectively through a coupling reaction thereof to the oxidation products of an aromatic primary amine color developing agent. A gradation may anyway be changed by selecting the kinds of the above-mentioned couplers or the substituents thereof, however, this technique is also difficult to put into practical use, because of the undesirable changes caused in the order characteristics of the light sensitive material, such as the spectral characteristics of the dye images, the stability of the dye images.

Further, there are, for example, a description of a technique for softening a high-light portion by selecting a suitable high boiling solvent for a coupler in Japanese Patent O.P.I. Publication No. 40550/1983; and another description of a gradation adjusting technique in which a high boiling solvent is selected and a catechol derivative is used in Japanese Patent Application No. 213161/1984. In these techniques, it was found that some specific density area of some specific emulsion layer was effectivly improved but the overall gradations, the gradation balance and the like were not satisfactorily improved, though the techniques did work anyhow.

After the inventors were devoted to their studies by making use of the above-mentioned techniques, they found that they reached the reasonably satisfiable levels of the gradations and the balance thereof as far as both of a blue-sensitive emulsion layer and a red-sensitive emulsion layer concerned, but they did not reach any satisfiable level in matching with a green-sensitive emulsion layer. Resultantly, they failed to obtain any color photographic light sensitive material for printing use which is satisfiable in gradation characteristics.

In the above-mentioned techniques, it was difficult to manufacture inexpensively and stably any color photographic light sensitive material for printing use which is excellent in gradation and other photographic characteristics, as described above.

SUMMARY OF THE INVENTION

It is an object of the invention to provide a color photographic light sensitive material for printing use in which the gradation characteristics thereof are excellent.

Another object of the invention is to provide a color photographic light sensitive material for printing use in which the colors thereof are properly balanced from the high light portions to the shadow portions thereof and the color reproducibility thereof is excellent.

A further object of the invention is to provide a color photographic light sensitive material for printing use which can be manufactured stably and inexpensively and is excellen in both of gradation and other photographic characteristics.

The above-mentioned objects of the invention can be achieved with a color photographic light sensitive material for printing use comprising a reflecting support bearing thereon a blue-sensitive silver halide emulsion layer, a green-sensitive silver halide emulsion layer and a red-sensitive silver halide emulsion layer; wherein a silver halide emulsion contained in the above-mentioned green-sensitive silver halide emulsion layer is a monodispersed silver halide emulsion and a coupler combined with the above-mentioned monodispersed silver halide emulsion is a magenta coupler represented by the following formula [I]:

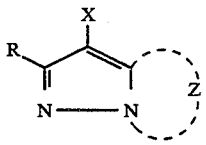

Formula [I]

wherein Z represents a group of non-metal atoms necessary for forming a nitrogen-containing heterocyclic ring, and any ring formed by the Z is allowed to have substituents; X represents a substituent capable of splitting off through a reaction thereof to the oxidation products of a color developing agent; and R represents hydrogen or a substituent.

DETAILED DESCRIPTION OF THE INVENTION

The invention will now be described in detail.

In the magenta couplers relating to the invention represented by the above-given Formula [I],

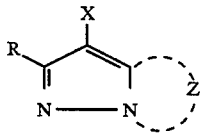

Formula [I]

wherein Z represents a group of non-metal atoms necessary for forming a nitrogen-containing heterocyclic ring, and any ring formed by the abovegiven Z is allowed to have substituents; X represents a substituent capable of splitting off through the reaction thereof to the oxidation products of a color developing agent; and R represents hyrogen or a substituent.

The substituents represented by the abovegiven R include, for example, a halogen, an alkyl group, a cycloalkyl group, an alkenyl group, a cycloalkenyl group, an alkynyl group, an aryl group, a heterocyclic group, an acyl group, a sulfonyl group, a sulfinyl group, a sulfonyl group, a carbamoyl group, a sulfamoyl group, a cyano group, a spiro compound residual group, a cross linked hydrocarbon compound residual group, an alkoxy group, an aryloxy group, a heterocyclicoxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclicthio group.

A halogen includes, for example, chlorine and bromine, and more preferably among them, chlorine.

The alkyl groups represents by R include, for example, those each having 1 to 32 carbon atoms and an alkenyl group; the alkynyl groups represented thereby include, for example, those each having 2 to 32 carbon atoms and a cycloalkyl group; and the cycloalkenyl groups represented thereby include, for example, those each having 3 to 12 carbon atoms and more preferably those each having 5 to 7 carbon atoms. The above-mentioned alkyl, alkenyl and alkynyl groups are allowed to be normal chained or branch chained.

The above-mentioned alkyl, alkenyl, alkynyl, cycloalkyl and cycloalkenyl groups are allowed to have such a substituent as an aryl group, a cyano group, a halogen, a heterocyclic group, a cycloalkyl group, a cycloalkenyl group, a spiro compound residual group and a cross linked hydrocarbon compound residual group. Besides the above, they are also allowed to have a substituent substituted through such a carbonyl group as that of acyl carboxy, carbamoyl, alkoxycarbonyl or aryloxycarbonyl. They are further allowed to have such a substituent substituted through a hetero atom as, typically, those substituted through oxygen such as that of hydroxy, alkoxy, aryloxy, heterocyclicoxy, siloxy, acyloxy, carbamoyloxy or the like; those substituted through nitrogen such as that of nitro, amino including, for example, dialkylamino and the like, sulfamoylamino, alkoxycarbonylamino, aryloxycarbonylamino, acylamino, sulfonamido, imido, ureido or the like; those substituted through sulfur such as that of alkylthio, arylthio, heterocyclicthio, sulfonyl, sulfinyl, sylfamoyl or the like; and those substituted through phosphorus such as that of phosphonyl or the like.

The above-mentioned substituents typically include, for example, a methyl, ethyl, isopropyl, t-butyl, pentadecyl, heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenyl-isopropyl, 3-m-butanesulfonaminophenoxypropyl, 3-4'-{α-[4''(p-hydroxybenzenesulfonyl)phenoxy]dodecanoylamino} phenylpropyl, 3-{4'-[α-(2'',4''-di-t-amylphenoxy)-butaneamido]phenyl}-propyl, 4-[α-(o-chlorophenoxy)-tetradecaneamidophenoxy]propyl, aryl, cyclopentyl, or cyclohexyl group.

The aryl groups represented by R preferably include, for example, a phenyl group, and they are allowed to have such a substituent as an alkyl, alkoxy or acylamino group. They typically include, for example, a phenyl, 4-t-butylphenyl, 2,4-di-t-amylphenyl, 4-tetradecaneamidophenyl, hexadesiloxy phenyl, or 4'-[α-(4''-t-butylphenoxy)tetradecaneamido]phenyl group.

The heterocyclic groups represented by R preferably include, for example, the 5 to 7 membered ones. They are allowed to be substituted or condensed, and they typically include, for example, a 2-furyl, 2-thienyl, 2-pyrimidinyl, or 2-benzothiazolyl group.

The acyl groups represented by R include, for example, those of acetyl, phenylacetyl, dodecanoyl, alkylcarbonyl such as α-2,4-di-t-amylphenoxybutanoyl, benzoyl, 3-pentadecyloxy benzoyl, arylcarbonyl such as p-chlorobenzoyl, and the like.

The sulfonyl groups represented by R include, for example, an alkylsulfonyl group such as methylsulfonyl and dodecylsulfonyl groups, an arylsulfonyl group such as benzenesulfonyl and p-toluenesulfonyl groups.

The sulfinyl groups represented by R include, for example, an alkylsulfinyl group such as an ethylsulfinyl, octylsulfinyl or 3-phenoxybutylsulfinyl group; an arylsulfinyl group such as a phenylsulfinyl or m-pentadecylphenylsulfinyl group.

The phosphonyl groups represented by R include, for example, an alkylphosphonyl group such as butyloctylphosphonyl group, an alkoxyphosphonyl group such as octyloxyphosphonyl group, an aryloxyphosphonyl group such as phenoxyphosphonyl group, an arylphosphonyl group such as phenylphosphonyl group, and the like.

In the carbamoyl groups represented by R, the alkyl, aryl and more preferably phenyl groups thereof may be substituted. They include, for example, N-methylcarbamoyl group, N,N-dibtylcrbamoyl group, N-(2-pentadecyloctylethyl)carbamoyl group, N-ethyl-N-dodecylcarbamoyl group, N-{3-(2,4-di-t-amylphenoxy)propyl}carbamoyl group, and the like.

In the sulfamoyl groups represented by R, the alkyl, aryl and more preferably phenyl groups may be substituted. They include, for example, N-propylsulfamoyl group, N,N-diethylsulfamoyl group, N-(2-pentadecyloxyethyl)sulfamoyl group, N-ethyl-N-dodecylsulfamoyl group, N-phenylsulfamoyl group, and the like.

The spiro compound residual groups represented by R include, for example, spiro[3.3]heptane-1-yl, and the like.

The cross linked hydrocarbon compound residual groups include, for example, bicyclo[2.2.19 heptane-1-yl, tricyclo [3.3.1.1$^{3,7}$]decane-1-yl, 7,7-dimethyl-bicyclo[2.2.1]heptane-1-yl and the like.

The alkoxy groups represented by R are allowed to substitute the substituents given to the above-mentioned alkyl groups, and they include, for example, a methoxy, propoxy, 2-ethoxyethoxy, pentadecyloxy, 2-dodecyloxyethoxy, phenthyloxyethoxy and the like groups.

The aryloxy groups represented by R preferably include, for example, a phenyloxy group, and the aryl nucleus thereof is further allowed to be substituted by the substituents or atoms given to the above-mentioned aryl groups. They include, for example, a phenoxy, p-t-butylphenoxy, m-pentadecylphenoxy and the like groups.

The heterocyclicoxy groups represented by R preferably include, for example, those each having a 5 to 7 membered heterocyclic ring which is also allowed to have a substituent. They include, for example, a 3,4,5,6-tetrahydropyranyl-2-oxy group and a 1-phenyltetrazole-5-oxy group.

The siloxy groups represented by R may further be substituted by an alkyl group or the like. They include, for example, a trimethylsiloxy, triethylsiloxy, dimethylbutylsiloxy and the like groups.

The acryloxy groups represented by R include, for example, an alkylcarbonyloxy, arylcarbonyloxy and the like groups. They are further allowed to have a substituent including, typically, an acetyloxy, α-chloracetyloxy, benzoyloxy and the like groups.

The carbamoyloxy groups represented by R may be substituted by an alkyl, aryl or the like group. They include, for example, N-ethylcarbamoyloxy, N,N-diethylcarbamoyloxy, N-phenylcarbamoyloxy and the like group.

The amino groups represented by R may also be substituted by an alkyl group, an aryl group and more preferably a phenyl group, and the like group. They include, for example, an ethylamino, anilino, m-chloroanilino, 3-pentadecyloxycarbonylanilino, 2-chloro-5-hexadecaneamidoanilino and the like groups.

The acylamino groups represented by R include, for example, an alkylcarbonylamino, arylcarbonylamino and more preferably phenylcarbonylamino, and the like groups. They may further have a substituent including, typically, an acetamido, α-ethylpropaneamido, N-phenylacetamido, dodecaneamido, 2,4-di-t-amylphenoxyacetamido, α-3-t-butyl-4-hydroxyphenoxybutaneamido and the like groups.

The sulfonamido groups represented by R include, for example, an alkylsulfonylamino, arylsulfonylamino and the like groups, and they are allowed to have a substituent including, typically, a methylsulfonylamino, pentadecylsulfonylamino, benzenesulfonamido, p-toluenesulfonamido, 2-methoxy-5-t-amylbenzenesulfonamido and the like groups.

The imido groups represented by R may be of the open-chained or of the cyclic, and they may also have a substituent including, for example, a succinic acid imido, 3-heptadecyl succinic acid imido, phthalic imido, glutaric imido and the like groups.

The ureido groups represented by R may be substituted by an alkyl, aryl and preferably phenyl or the like group. They include, for example, N-ethylureido, N-methyl-N-decylureido, N-phenylureido, N-p-tolylureido and the like groups.

The sulfamoylamino groups represented by R may be substituted by an alkyl, aryl and more preferably phenyl, or the like group. They include, for example, a N,N-dibutylsulfamoylamino, N-methylsulfamoylamino, N-phenylsulfamoylamino and the like groups.

The alkoxycarbonylamino groups represented by R may further have a substituent including, for example, a methoxycarbonylamino, methoxyethoxycarbonylamino, octadecyloxycarbonylamino and the like groups.

The aryloxycarbonylamino groups represented by R may have a substituent including, for example, a phenoxycarbonylamino, 4-methylphenoxycarbonylamino and the like groups.

The alkoxycarbonyl groups represented by R may further have a substituent including, for example, a methoxycarbonyl, butyloxycarbonyl, dodecyloxycarbonyl, octadecyloxycarbonyl, ethoxymethoxycarbonyloxy, benzyloxycarbonyl and the like groups.

The aryloxycarbonyl groups represented by R may further have a substituent including, for example, a phenoxycarbonyl, p-chlorophenoxycarbonyl, m-pentadecyloxyphenoxycarbonyl and the like groups.

The alkylthio groups represented by R may further have a substituent including, for example, an ethylthio, dodecylthio, octadecylthio, phenethylthio and 3-phenoxypropylthio groups.

The arylthio groups represented by R include preferably a phenylthio group and may further have a substituent including, for example, a phenylthio, p-methoxyphenylthio, 2-t-octylphenylthio, 3-octadecylphenylthio, 2-carboxyphenylthio, p-acetaminophenylthio and the like groups.

The heterocyclicthio groups represented by R include, preferably, a 5 to 7 membered heterocyclicthio group, and may further have a condensed ring or a substituent. They include, for example, a 2-pyridylthio, 2-benzothiazolylthio, and 2,4-diphenoxy-1,3,5-triazole-6-thio groups.

The substituents represented by X which are capable of splitting off through the reaction thereof to the oxidation products of a color developing agent include, for example, the groups substituted through carbon, oxygen, sulphur or nitrogen atom as well as such a halogen atom as chlorine, bromine, fluorine or the like atom.

The groups substituted through a carbon atom include, for example, a carboxyl group and besides, the groups represented by the following formula:

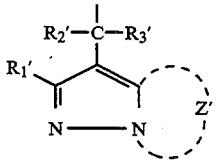

wherein $R_{1'}$ is synonymous with the above-mentioned R; Z' is synonymous with the above-mentioned Z; and $R_{2'}$ and $R_{3'}$ represent hydrogen, an aryl group, an alkyl group or a heterocyclic group, respectively; a hydroxymethyl group and a triphenylmethyl group.

The groups substituted through oxygen include, for example, an alkoxy, aryloxy, heterocyclicoxy, acyloxy, sulfonyloxy, alkoxycarbonyloxy, aryloxycarbonyloxy, alkyloxalyloxy and alkoxyoxalyloxy groups.

The alkoxy groups are allowed to have a substituent including, for example, an ethoxy, 2-phenoxyethoxy, 2-cyanoethoxy, phenethylopxy, p-chlorobenzyloxy and the like groups.

Among the aryloxy groups, a phenoxy group is preferred. Such aryloxy groups may have a substituent. They include typically phenoxy, 3-methylphenoxy, 3-dodecylphenoxy, 4-methanesulfonamidophenoxy,4-[α-(3'-pentadecylphenoxy)butanamido]phenoxy, hexyldecyl- carbamoylmethoxy, 4-cyanophenoxy, 4-methanesulfonylphwnoxy, 1-naphthyloxy, p-methoxyphenoxy and the like groups.

The hetero cyclicoxy groups include preferably a 5 to 7 membered heterocyclicoxy group, and may have a substituent. They typically include a 1-phenyltetrazolyloxy, 2-benzothiazolyloxy or the like group.

The acyloxy groups include, for example, such an alkylcarbonyloxy group as an acetoxy, butanoloxy or the like group; such an alkenylcarbonyloxy group as a cinnamoyloxy group; ans such an arylcarbonyloxy group as a benzoyloxy group.

The sulfonyloxy groups include, for example, a butanesulfonyloxy group or a methanesulfonyloxy group.

The alkonylcarbonyloxy groups include, for example, an ethoxycarbonyloxy group or a benzyloxycarbonyloxy group.

The aryloxycarbonyl groups include, for example, a phenoxycarbonyloxy group or the like groups.

The alkyloxalyloxy groups include, for example, a methyloxalyloxy group.

The alkoxyoxalyloxy groups include, for example, an ethoxyoxalyloxy group and the like.

The groups substituting through sulphur include, for example, an alkylthio, arylthio, heterocyclicthio, alkyloxythiocarbonylthio or the like groups.

The alkylthio groups include, for example, a butylthio, 2-cyanoethylthio, phenethylthio, benzylthio or the like groups.

The arylthio groups include, for example, a phenylthio, 4-methanesulfonamidophenylthio, 4-dodecylphenethylthio, 4-nonafluoropentanamidophenethylthio, 4-carboxyphenylthio, 2-ethoxy-5-t-butylphenylthio or the like groups.

The heterocyclicthio groups include, for example, a 1-phenyl-1,2,3,4-tetrazolyl-5-thio, 2-benzothiazolylthio or the like groups.

The alkyloxythiocarbonylthio groups include, for example, a dodecyloxythiocarbonylthio or the like groups.

The groups sustituting through the above-mentioned nitrogen include, for example, those represented by the following formula:

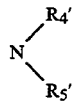

wherein, $R_{4'}$ and $R_{5'}$ represent hydrogen, an alkyl, aryl, heterocyclic, sulfamoyl, carbamoyl, acyl, sulfonyl, aryloxycarbonyl or alkoxycarbonyl group; and $R_{4'}$ and $R_{5'}$ may be so coupled each other as to form a heterocyclic ring, provided that $R_{4'}$ and $R_{5'}$ shall not be hydrogen at the same time.

The alkyl groups are allowed to be normal-chained or branch-chained and preferably have 1 to 24 carbon atoms. The alkyl groups may have such a substituent as an aryl, alkoxy, aryloxy, alkylthio, arylthio, alkylamino, arylamino, acylamino, sulfonamido, imino, acyl, alkylsulfonyl, arylsulfonyl, carbamoyl, sulfamoyl, alkoxycaronyl, aryloxycarbonyl, alkyloxycarbonylamino, aryloxycarbonylamino, hydroxyl, carboxyl and cyano groups and a halogen. As for the typical examples of the alkyl groups, ethyl, 2-ethylhexyl and 2-chlorethyl groups may be given.

It is preferred that the aryl groups represented by $R_{4'}$ and $R_{5'}$ have 6 to 32 carbon atoms and that they are a phenyl or naphthyl group in particular. They are also allowed to have substituents including, for example, the substituents to the alkyl groups represented by the above-mentioned $R_{4'}$ and $R_{5'}$, and an alkyl group. The typical examples of the aryl groups include a phenyl, 1-naphthyl or 4-methylsulfonylphenyl group.

It is preferred that the heterocyclic groups represented by the above-mentioned $R_{4'}$ and $R_{5'}$ are the 5 to 6 membered ones. They are also allowed to be of the condensed ring and to have a substituent. The typical examples thereof include a 2-furyl, 2-quinolyl, 2-pyrimidyl, 2-benzothiazolyl, 2-pyridyl or the like groups.

The sulfamoyl groups represented by the $R_{4'}$ and $R_{5'}$ include, for example, N-alkylsulfamoyl, N,N-dialkylsulfamoyl, N-arylsulfamoyl, N,N-diarylsulfamoyl and the like groups. These alkyl and aryl groups are allowed to have the same substituents as those given in the cases of the above-mentioned alkyl and aryl groups. The typical examples of the sulfamoyl groups include N,N-diethylsulfamoyl, N-methylsulfamoyl, N-dodecylsulfamoyl and N-p-tolylsulfamoyl groups.

The carbamoyl groups represented by the $R_{4'}$ and $R_{5'}$ include, for example, N-alkylcarbamoyl, N,N-dialkylcarbamoyl, N-arylcarbamoyl, N,N-diarylcarbamoyl and the like groups. These alkyl and aryl groups are allowed to have the same substituents as those given in the cases of the above-mentioned alkyl and aryl groups. The typical examples of the carbamoyl groups include N,N-diethylcarbamoyl, N-methylcarbamoyl, N-dodecylcarbamoyl, N-p-cyanophenylcarbamoyl and N-p-tolylcarbamoyl groups.

The acyl groups represented by the $R_{4'}$ and $R_{5'}$ include, for example, alkylcarbonyl, arylcarbonyl and heterocyclic carbonyl groups. Such alkyl, aryl and heterocyclic groups are allowed to have a substituent. The typical examples of the acyl groups include a hexafluorobutanoyl, 2,3,4,5,6-pentafluorobenzoyl, acetyl, benzoyl, naphthoyl, 2-fulylcarbonyl or the like groups.

The sulfonyl groups represented by the $R_{4'}$ and $R_{5'}$ include, for example, an alkylsulfonyl, arylsulfonyl or heterocyclic sulfonyl group, and they are also allowed to have a substitutent. The typical examples of these sulfonyl groups include an ethanesulfonyl, benzenesulfonyl, octanesulfonyl, naphthalenesulfonyl, p-chlorobenzenesulfonyl or the like groups.

The aryloxycarbonyl groups represented by the $R_{4'}$ and $R_{5'}$ are allowed to have the same substituents as those given in the case of the above-mentioned aryl groups. The typical examples thereof include a phenoxycarbonyl group and the like.

The alkoxycarbonyl groups represented by the $R_{4'}$ and $R_{5'}$ are allowed to have the same substituents as those given in the case of the above-mentioned alkyl groups. The typical examples thereof include a methoxycarbonyl, dodecyloxycarbonyl, benzyloxycarbonyl or the like groups.

It is preferred that the above-mentioned heterocyclic rings formed by coupling $R_{4'}$ or $R_{5'}$ thereto are the 5 to 6 membered ones. They may be saturated or unsaturated and of the aromatic or the non-aromatic and further condensed rings. Such heterocyclic rings include, for example, N-phthalimido, N-succinic acid imido, 4-N-urazolyl, 1-N-hydantoinyl, 3-N-2,4-dioxooxazolidinyl, 2-N-1,1-dioxo-3-(2H)-oxo-1,2-benzothiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-isoindolyl, 2-isoindolinyl, 1-benzotriazolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, 2-oxo-1-piperidinyl and the like groups. These heterocyclic groups may also be substituted by an alkyl, aryl, alkyloxy, aryloxy, acyl, sulfonyl, alkylamino, arylamino, acylamino, sulfonamino, carbamoyl, sulfamoyl, alkylthio, arylthio, ureido, alkoxycarbonyl, aryloxycarbonyl, imido, nitro, cyano, carboxyl or the like groups, a halogen or the like.

The nitrogen-containing heterocyclic rings formed by the above-mentioned Z or Z' include, for example, a pyrazole, imidazole, triazole, tetrazole or the like ring. The substituents which the above-mentioned rings are allowed to have include, for example, the same substituents as those given with respect to the above-mentioned R.

In the case that such a substituent as R or one of from $R_1$ to $R_8$ on a heterocyclic ring shown in Formula [I] and Formulae [II] to [VIII] of which will be described later has the following part;

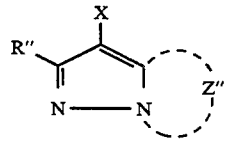

(wherein, R'', X and Z'' are synonymous with R, X and Z in Formula [I]), a so-called bis-type coupler is formed, and it is a matter of course that such couplers shall be included in the invention. Further, a ring formed by the Z, Z', Z'' or $Z_1$ that is to be described later, it is also allowed that another ring such as a 5 to 7 membered cycloalkene may be condensed. In Formula [VI], for example, it is allowed to form a ring such as a 5 to 7 membered cycloalkene or benzene by coupling $R_7$ and $R_8$ to each other.

The magenta couplers represented by Formula [I] may further typically be represented by the following formulae [II] to [VII]:

Formula [II]

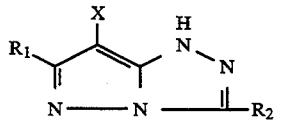

Formula [III]

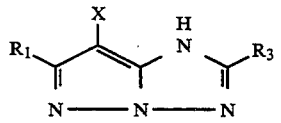

Formula [IV]

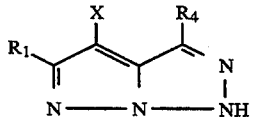

Formula [V]

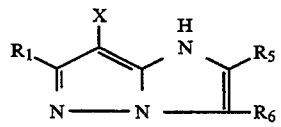

-continued

Formula [VI]

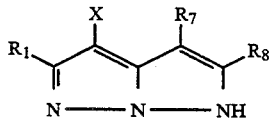

Formula [VII]

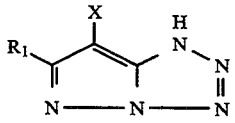

In the abovegiven Formulae [II] to [VII], $R_1$ to $R_8$ and X are synonymous with the aforementioned R and X, respectively.

The couplers represented by the following Formula [VIII] are the preferred ones among those represented by the Formula [I];

Formula [VIII]:

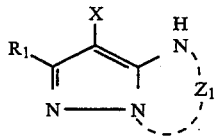

wherein $R_1$, X and $Z_1$ are synonymous with R, X and Z denoted in the Formula [I].

The particularly preferred magenta couplers among those represented by the abovegiven Formulae [II] to [VII] are the magenta couplers represented by Formula [II].

A substituent on the heterocyclic rings in the Formulae [I] to [VIII] becomes a preferred one, provided that R in Formula [I] or $R_1$ in Formulae [II] to [VIII] satisfies the following requirement 1. It becomes a further preferred one, provided that the R or $R_1$ satisfies the following requirements 1 and 2. It becomes a particularly preferred one, provided that the R and $R_1$ satisfies the following requirements 1, 2 and 3:

Requirement 1: An atom directly coupled to a heterocyclic ring is a carbon atom.

Requirement 2: Only one hydrogen atom couples to the carbon atom, or nothing couples thereto.

Requirement 3: Every coupling of the carbon atom to the neighboring atoms is a single coupling.

The most preferred substituents R and $R_1$ on the above-mentioned heterocyclic rings are represented by the following Formula [IX];

Formula [IX]:

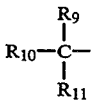

wherein $R_9$, $R_{10}$ and $R_{11}$ represent, respectively, hydrogen, a halogen, an alkyl group, cycloalkyl group, alkenyl group, cycloalkenyl group, alkynyl group, aryl group, heterocyclic group, acyl group, sulfonyl group, sulfinyl group, sulfonyl group, carbamoyl group, sulfamoyl group, cyano group, spiro compound residual group, cross-linked hydrocarbon compound residual group, alkoxy group, aryloxy group, heterocyclicoxy group, siloxy group, acyloxy group, carbamoyloxy group, amino group, acylamino group, sulfonamido group, imido group, ureido group, sulfamoylamino group, alkoxycarbonylamino group, aryloxycarbonylamino group, alkoxycarbonyl group, aryloxycarbonyl group, alkylthio group, arylthio group or heterocyclicthio group; and at least two of the $R_9$, $R_{10}$ and $R_{11}$ are not hydrogen.

Two out of the above-mentioned $R_9$, $R_{10}$ and $R_{11}$ which are, for example, $R_9$ and $R_{10}$ are allowed to couple to each other so as to form a saturated or unsaturated ring such as a cycloalkane, cycloalkene or heterocyclic ring, or so as further to produce a cross-linked hydrocarbon compound residual group by coupling $R_{11}$ to the above-mentioned ring.

The groups represented by $R_9$ to $R_{11}$ are allowed to have a substituent. The typical examples of both the groups represented by $R_9$ to $R_{11}$ and the substituents which the above-mentioned groups are allowed to have include the typical examples of the groups represented by R denoted in the above-given Formula [I] and the substituents thereto.

The typical examples of both the rings formed by coupling, for example, $R_9$ and $R_{10}$ to each other and the cross-linked hydrocarbon compounds formed by $R_9$ to $R_{11}$, and the examples of the substituents which the groups represented by $R_9$ to $R_{11}$ are allowed to have include the typical examples of a cycloalkyl group, a cycloalkenyl group, a heterocyclic group and a cross-linked hydrocarbon compound residual group each represented by R denoted in the aforegiven Formula [I] and the substituents thereto.

The following two cases are preferred with respect to the Formula [IX]:

i) A case that two of $R_9$ through $R_{11}$ are alkyl groups, and ii) Another case that one of the $R_9$ through $R_{11}$ is hydrogen and, $R_{10}$ and $R_{11}$ are coupled to each other so as to form a cycloalkyl group, together with the carbon atom.

Further, in the case i), the preferable case is that two of $R_9$ through $R_{11}$ are alkyl groups and the rest is either hydrogen or an alkyl group.

The above-mentioned alkyl and cycloalkyl groups are allowed to have a substituent. The typical examples of the alkyl groups, the cycloalkyl groups and the substituents include the typical examples of the alkyl groups, the cycloalkyl groups and the substituents represented by R denoted in the aforegiven Formula [I].

For serving as the substituents which both of the rings formed by Z denoted in Formula [I] and those formed by $Z_1$ denoted in Formula [VIII] are allowed to have, and as $R_2$ through $R_8$ denoted in Formula [II] through [VI], the preferred ones are represented by the following Formula [X];

Formula [X]:

$$-R^1-SO_2-R^2$$

wherein $R^1$ represents an alkylene group; and $R^2$ represents an alkyl, cycloalkyl or aryl group.

The alkylene group represented by $R^1$ is to have prepferably not less than 2 carbon atoms and more preferably 3 to 6 carbon atoms in the normal chained portion thereof, regardless of the normal or branch chained. The alkylene group may also have a substituent.

The examples of the above-mentioned substituents include those which an alkyl group may have provided that the alkyl group is represented by R denoted in the aforegiven Formula [I].

The preferred substituents include, for example, a phenyl group.

The typical and preferable examples of the alkylene groups represented by $R^1$ are given below:

$-CH_2CH_2CH_2-$, $-\underset{\underset{CH_3}{|}}{C}HCH_2CH_2-$, $-\underset{\underset{C_2H_5}{|}}{C}HCH_2CH_2-$, $-CH_2CH_2\underset{\underset{C_7H_{15}}{|}}{C}H-$ $-CH_2CH_2\underset{\underset{C_2H_5}{|}}{C}H-$, $-CH_2CH_2CH_2CH_2-$, $-CH_2CH_2CH_2\underset{\underset{C_6H_{13}}{|}}{C}H-$, $-CHCH_2CH_2-$, $-\overset{\overset{CH_3}{|}}{\underset{\underset{CH_3}{|}}{C}}-CH_2CH_2-$ It is regardless of that the alkyl groups represented by $R^2$ are normal chained or branch chained.

The above-mentioned alkyl groups typically include a methyl, ethyl, propyl, isopropyl, butyl, 2-ethylhexyl, octyl, dodecyl, tetradecyl, hexadecyl, octadecyl, 2-hexyldecyl or the like group.

The cycloalkyl groups represented by $R^2$ preferably include a 5 to 6 membered one that is, for example, a cyclohexyl group.

The alkyl and cycloalkyl groups each represented by $R^2$ are allowed to have a substituent which includes, for example, the substituents to the above-mentioned $R^1$.

The typical examples of the aryl groups represented by $R^2$ include, for example, a phenyl group and a naphthyl group. The aryl groups are allowed to have a substituent. These substituents include, for example, a normal chained or branch-chained alkyl group and, besides, the substituents exemplified as those to the above-mentioned $R^1$.

When there are not less than two substituents, such substituents may be the same with or the different from each other.

The particularly preferable compounds among those represented by Formula [I] are represented by the following Formula [XI];

Formula [XI]:

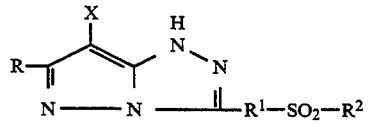

wherein R and X are synonymous with R and X denoted in Formula [I]; and $R^1$ and $R^2$ are synonymous with $R^1$ and $R^2$ denoted in Formula [X].

1

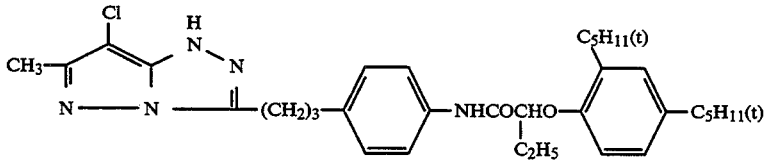

2

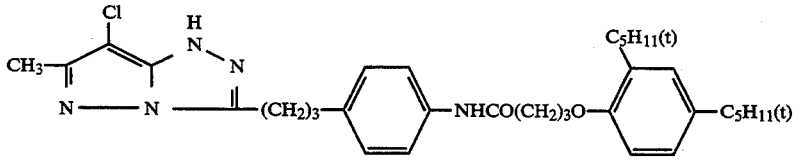

3

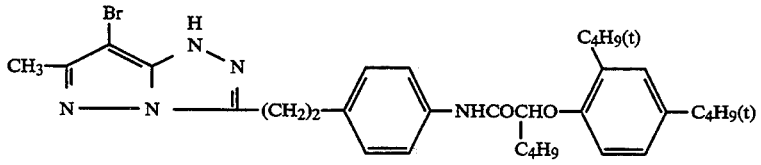

4

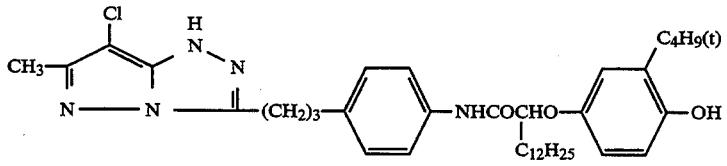

5

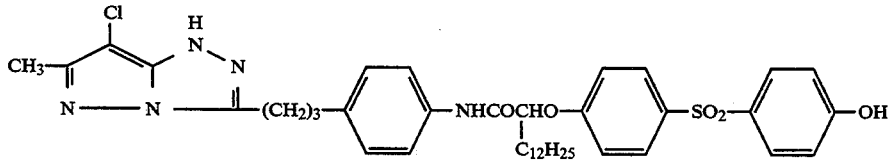

-continued
6
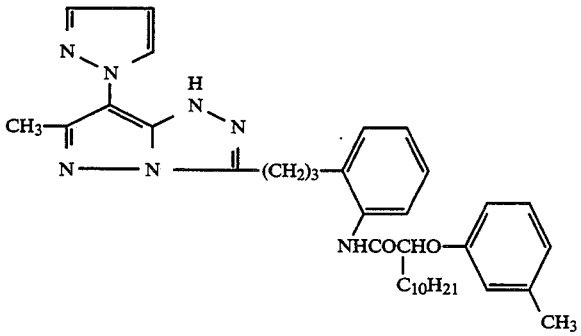
7
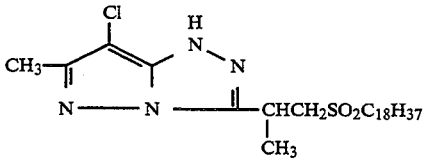
8
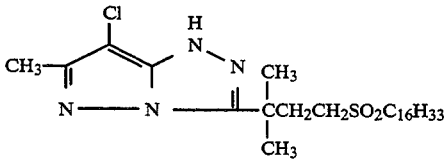
9
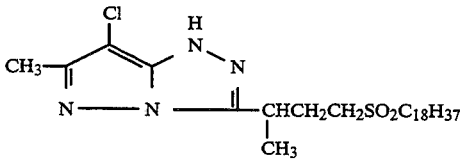
10
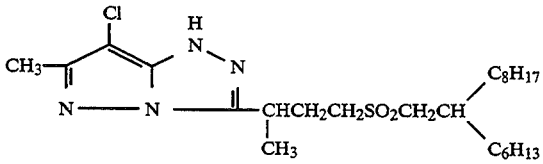
11
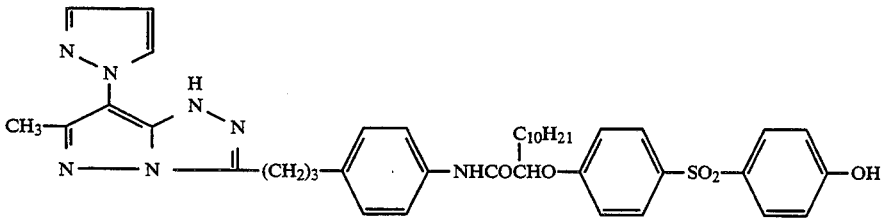
12
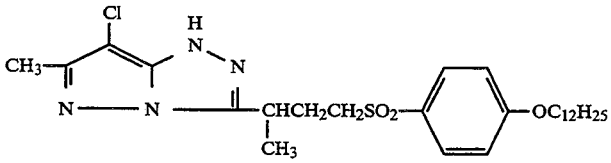
13
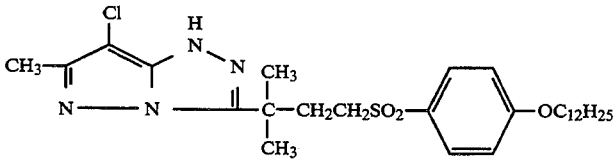

-continued
14
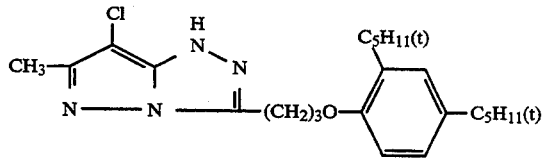
15
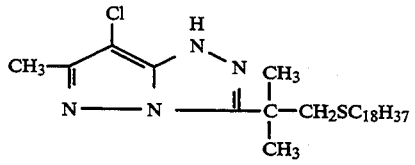
16
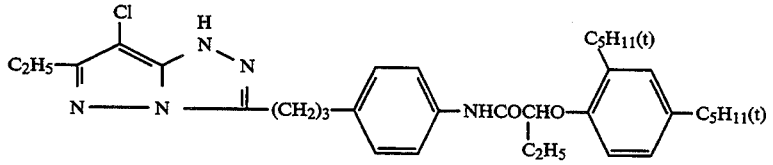
17
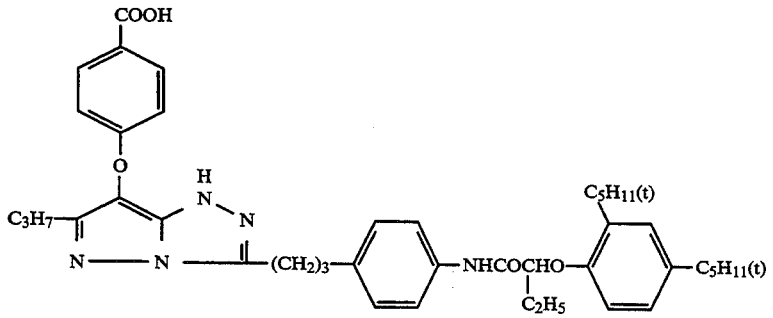
18
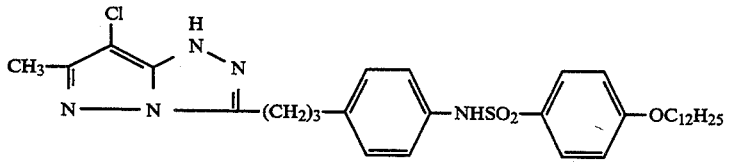
19
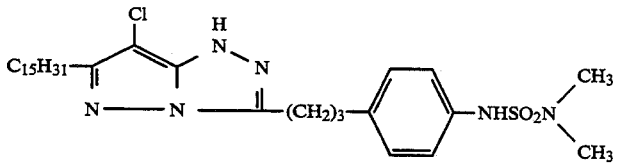
20
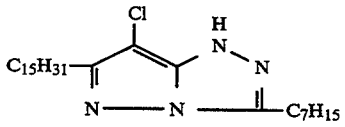
21
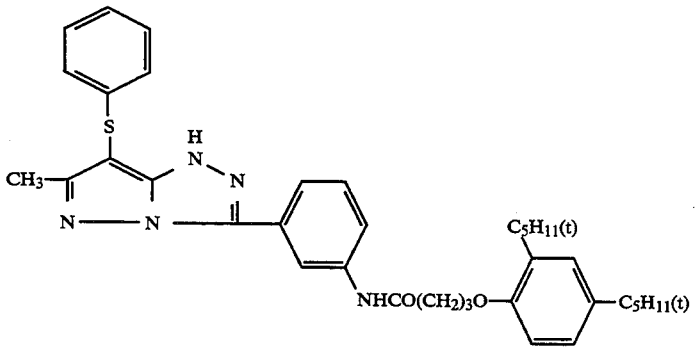

-continued
22
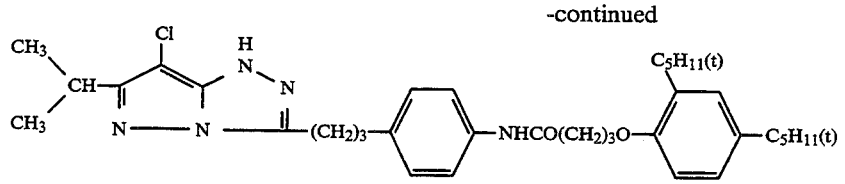
23
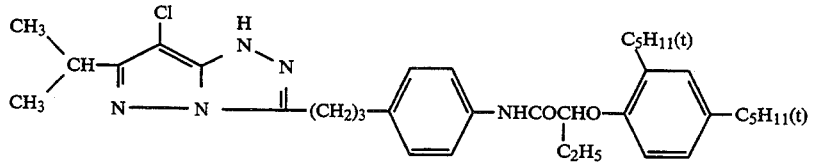
24
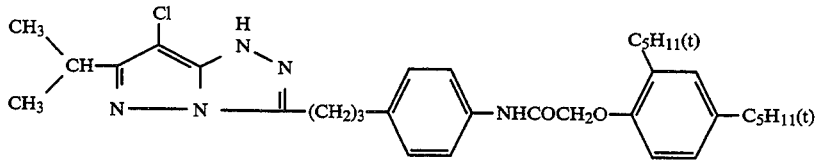
25
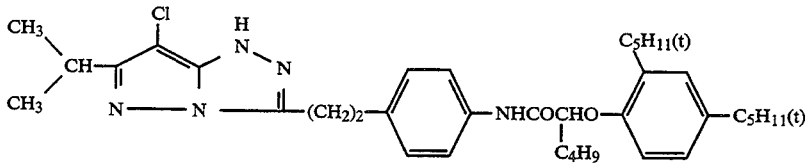
26
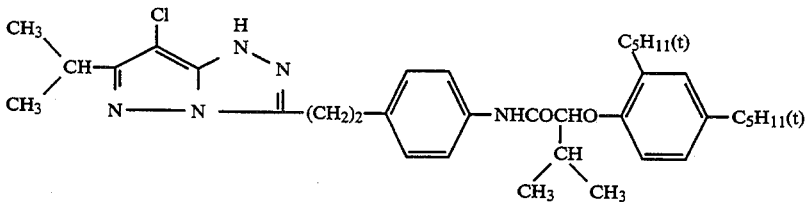
27
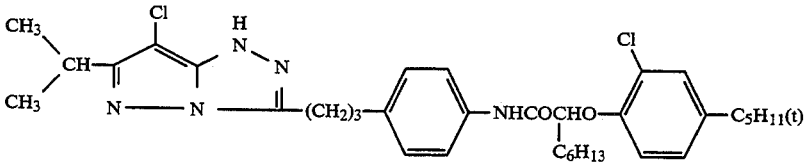
28
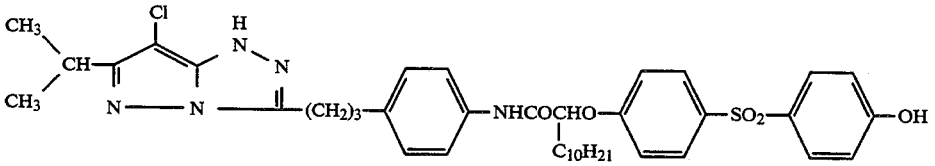
29
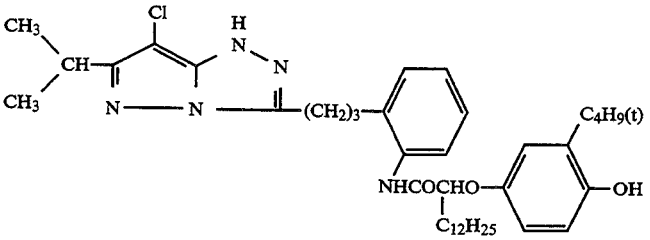
30
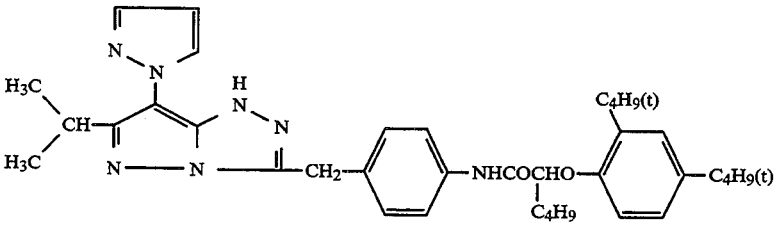

-continued
31
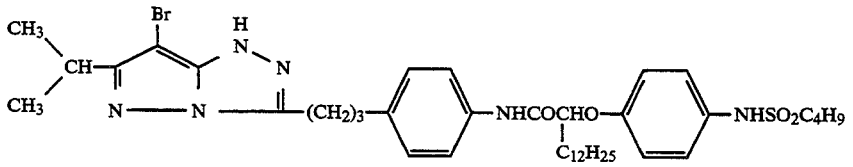
32
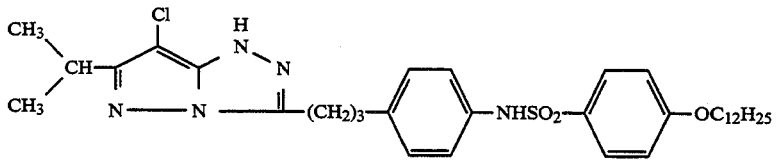
33
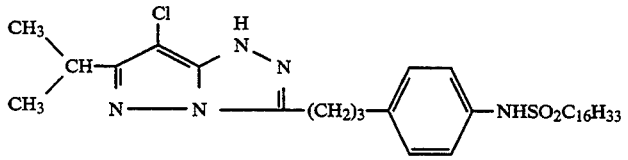
34
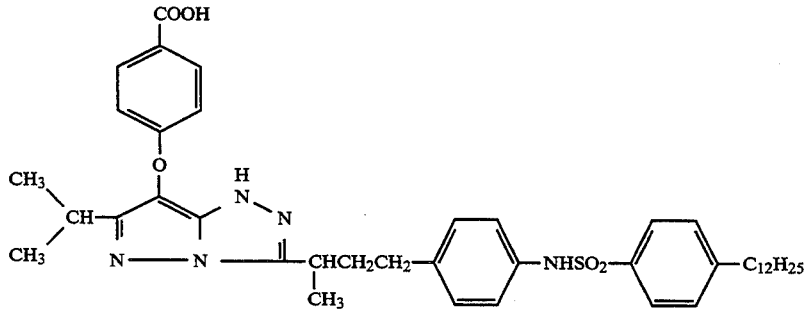
35
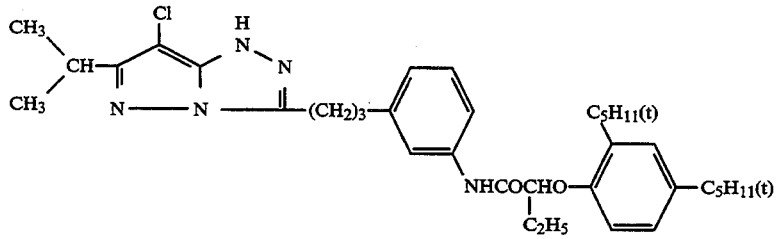
36
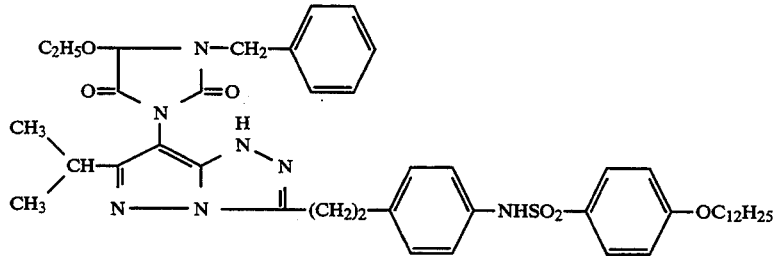

-continued
37
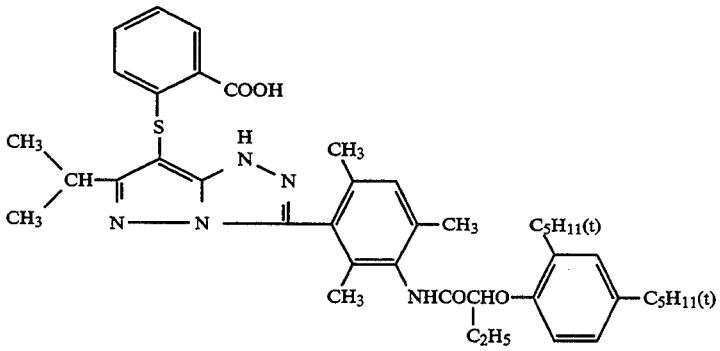
38
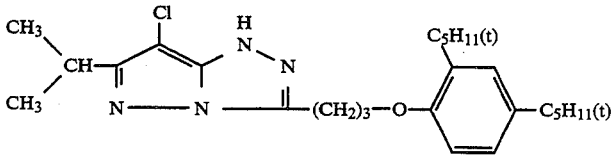
39
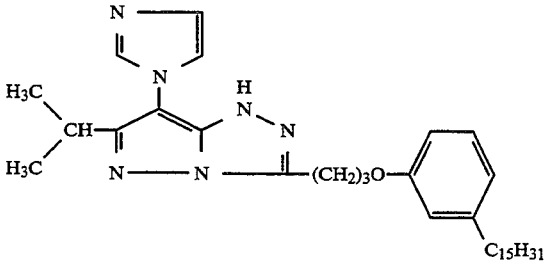
40
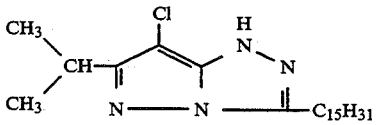
41
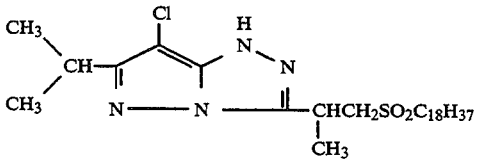
42
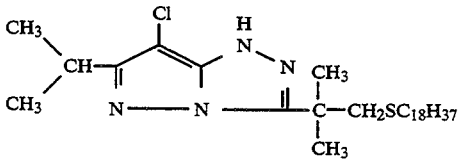
43
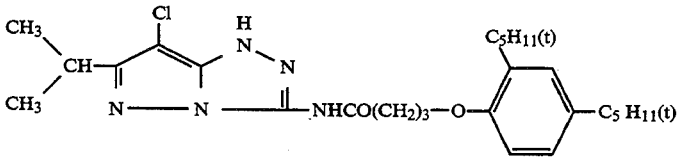
44
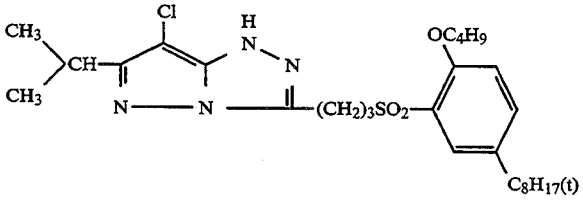

-continued
45
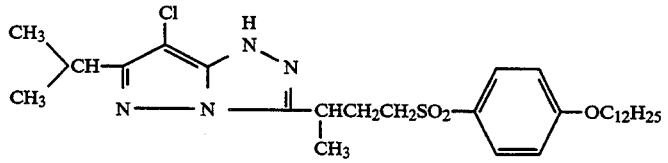
46
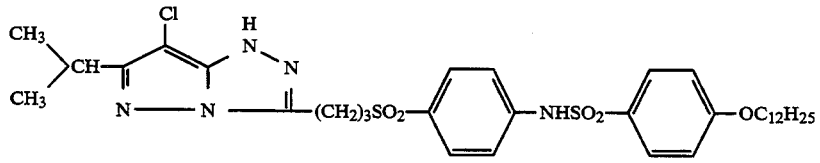
47
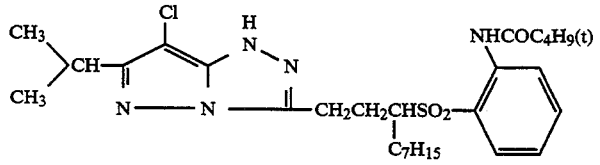
48
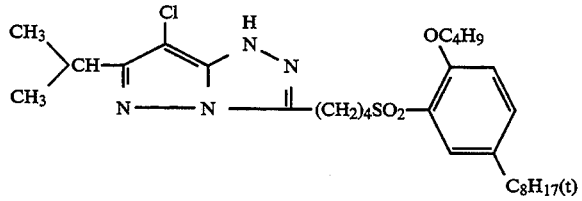
49
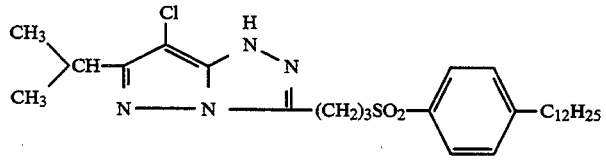
50
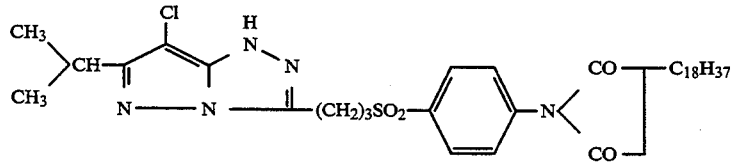
51
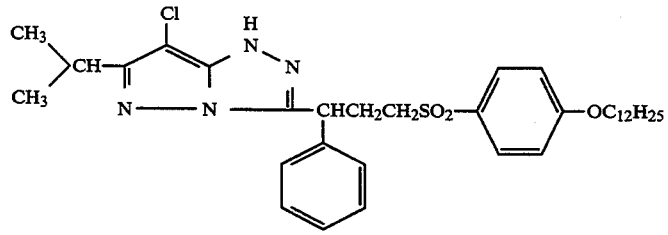
52
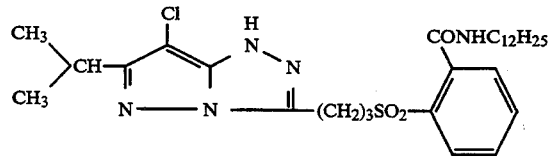
53
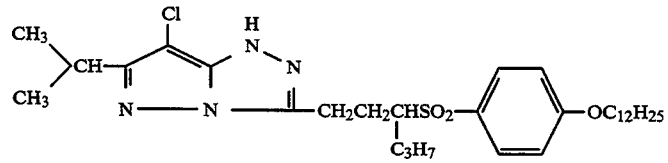

-continued
54
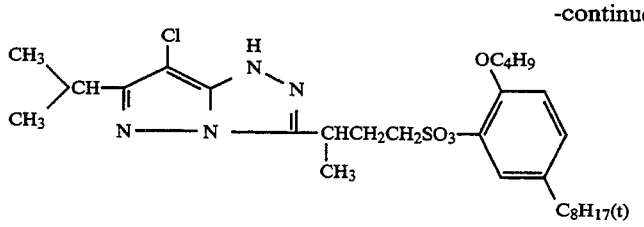
55
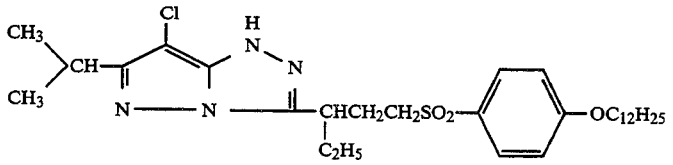
56
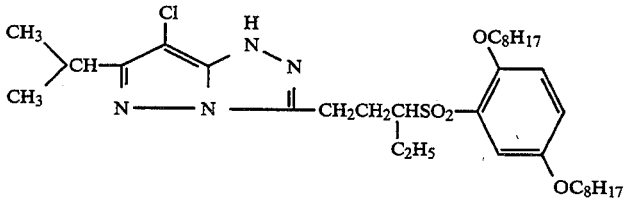
57
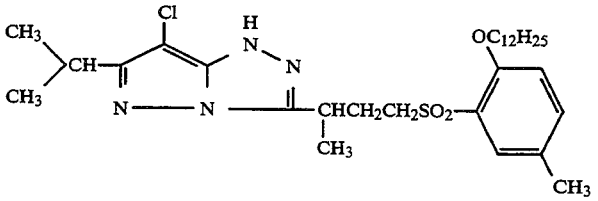
58
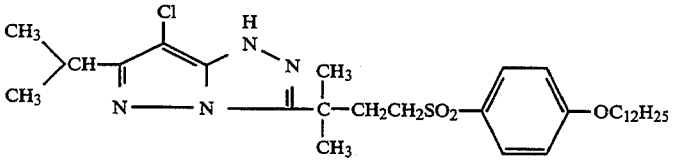
59
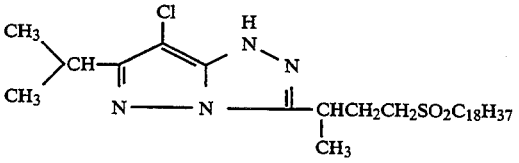
60
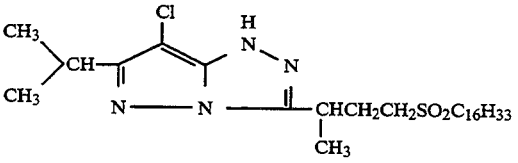
61
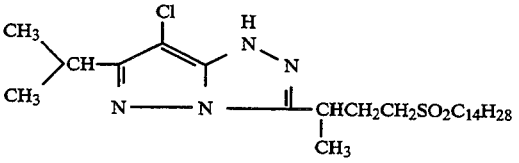
62
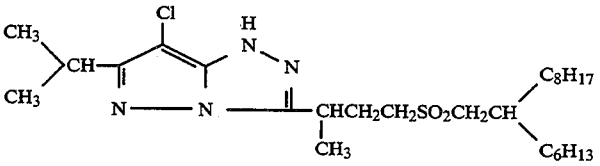

-continued
63
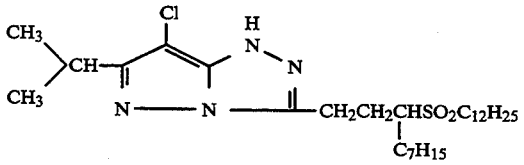
64
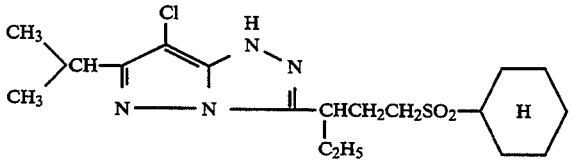
65
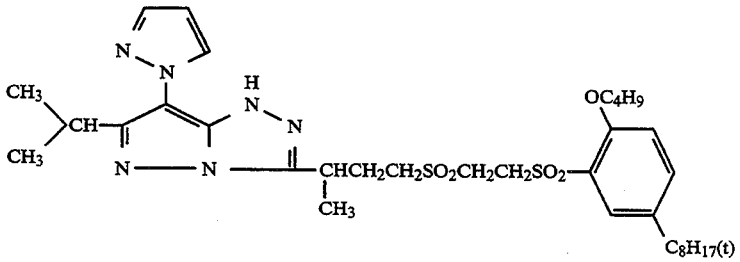
66
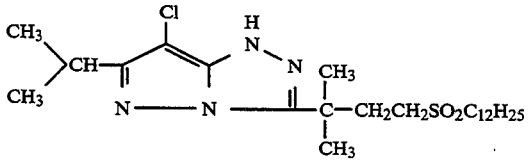
67
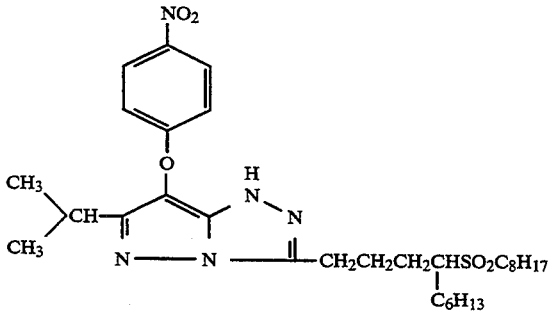
68
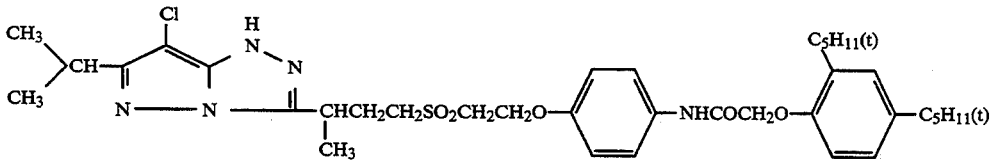
69
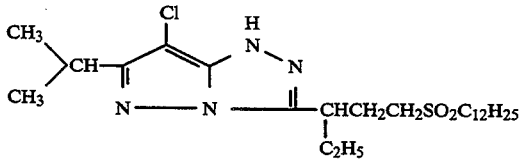

-continued
70
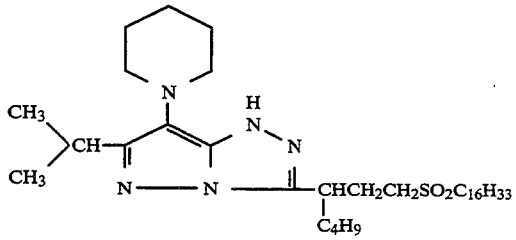
71
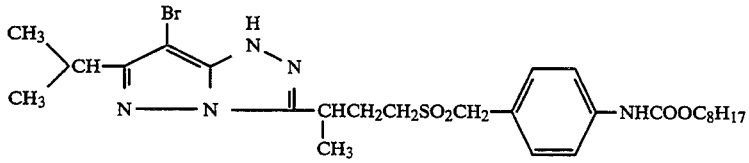
72
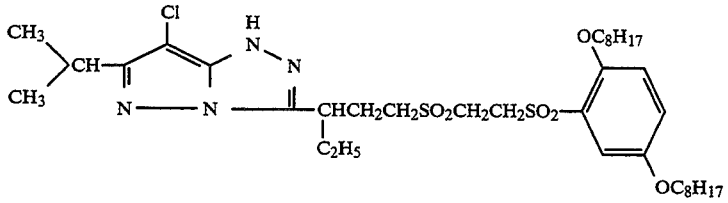
73
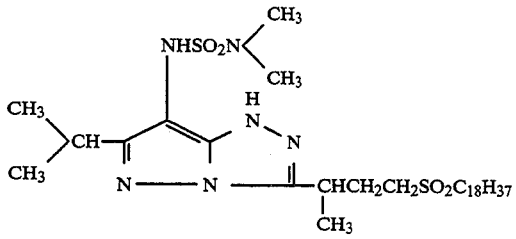
74
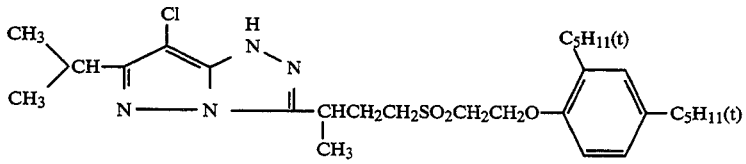
75
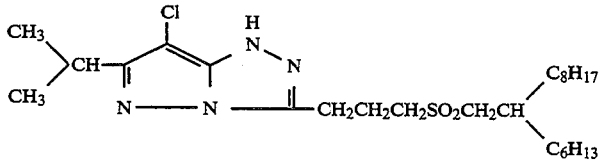
76
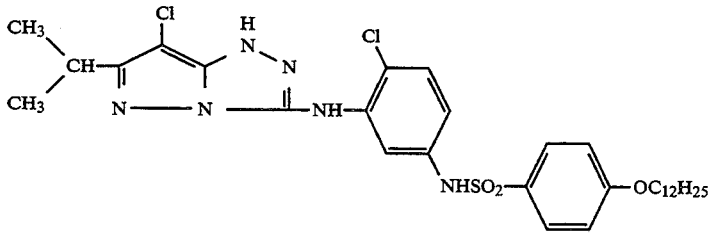
77
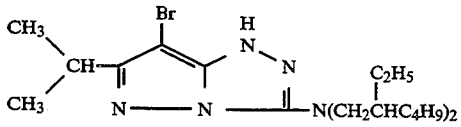

-continued
78
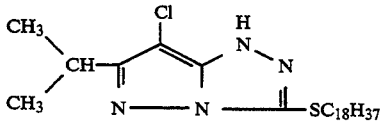
79
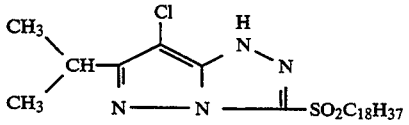
80
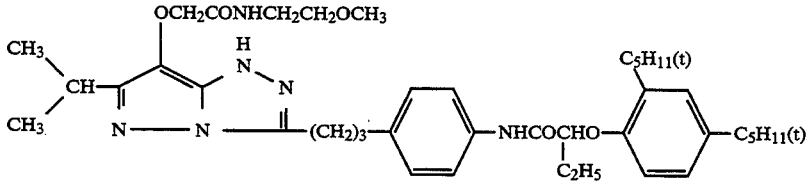
81
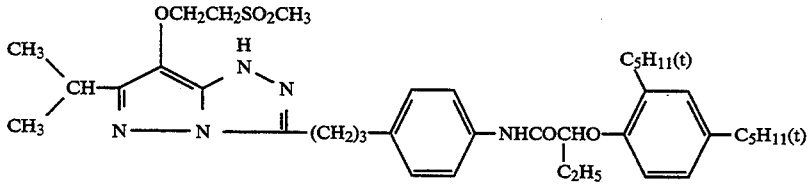
82
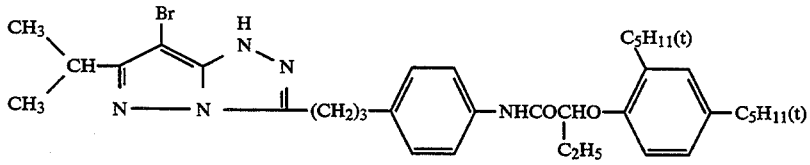
83
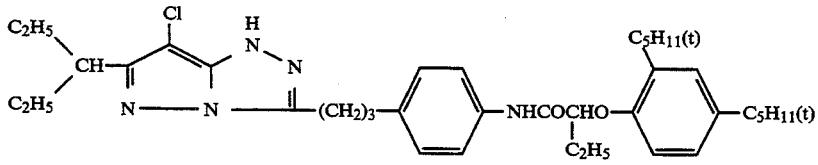
84
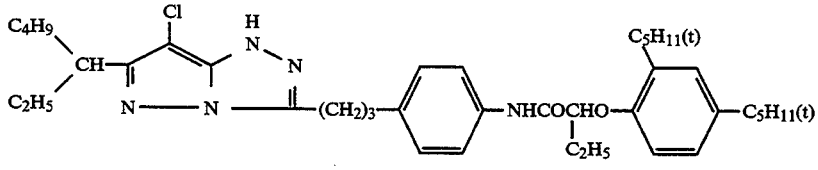
85
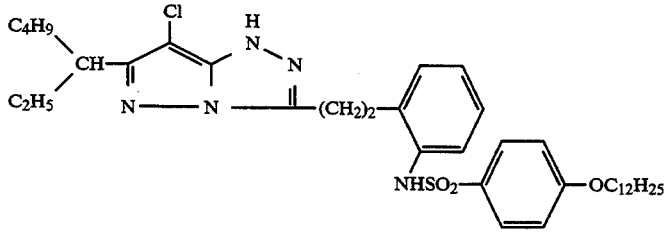
86
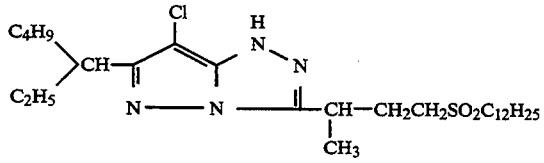

-continued
87
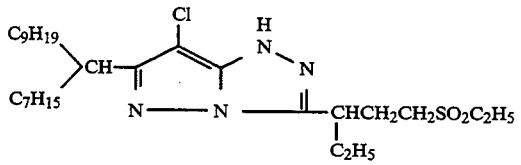
88
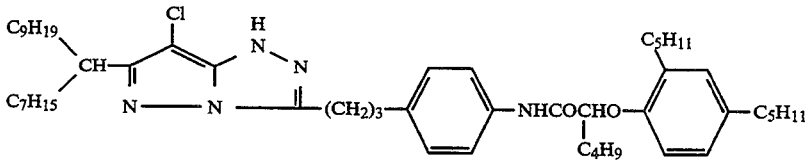
89
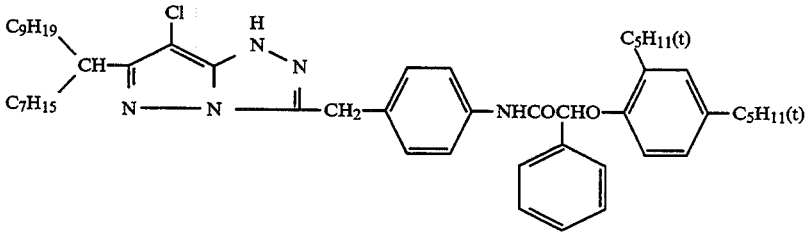
90
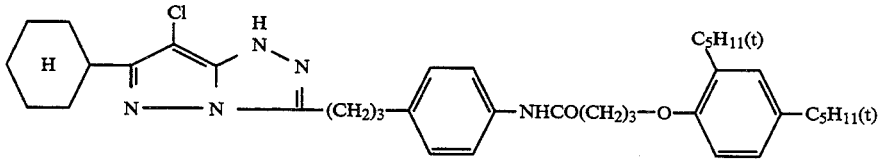
91
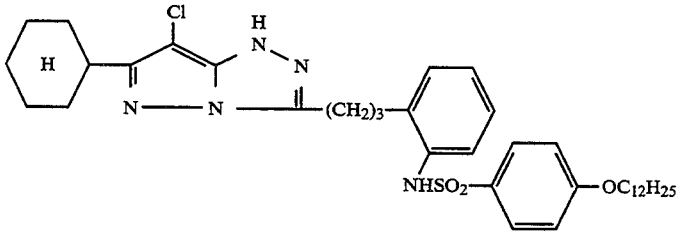
92
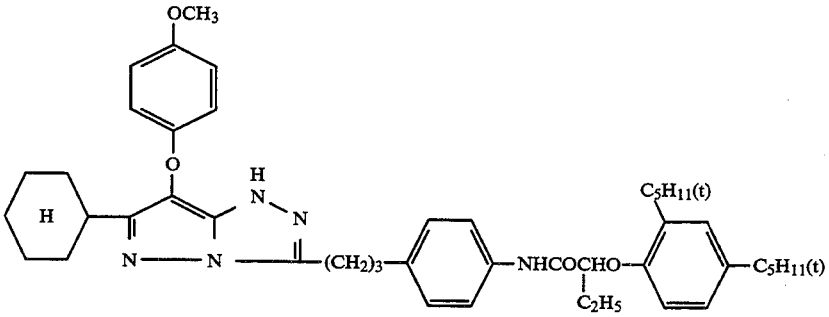
93
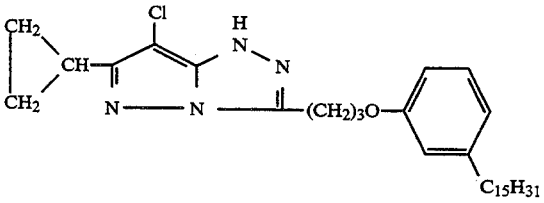
94
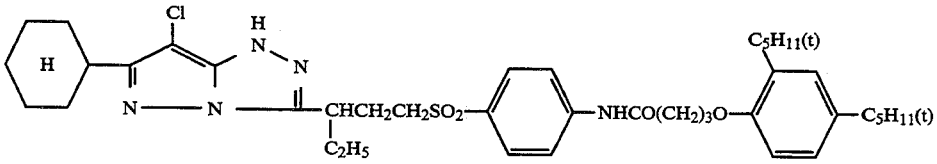

-continued
95
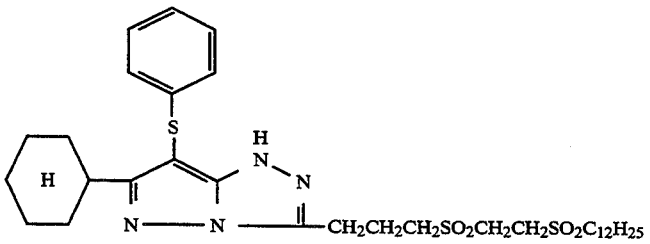
96
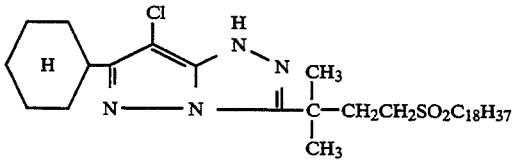
97
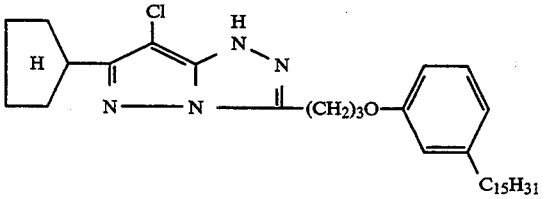
98
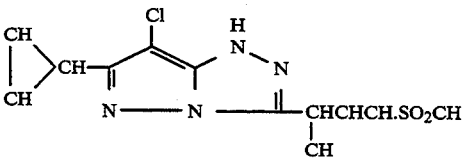
99
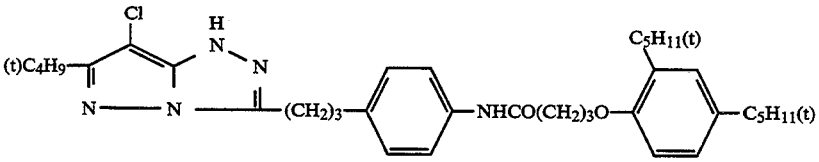
100
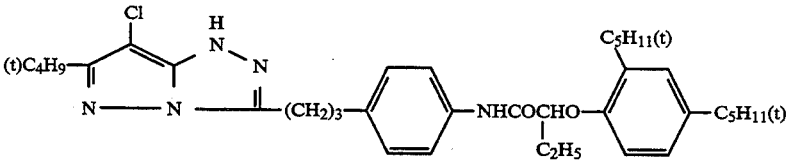
101
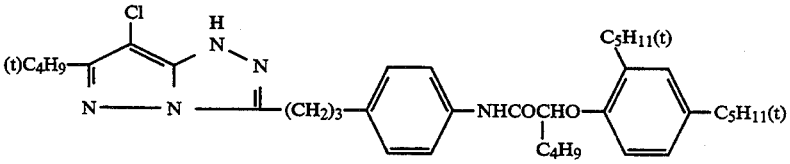
102
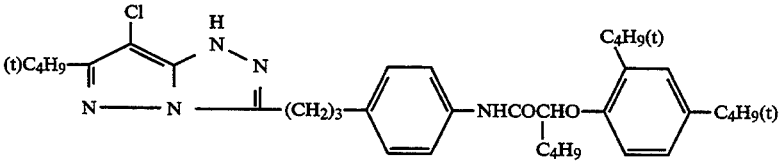
103
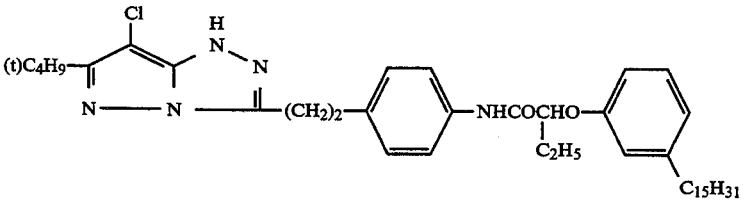

-continued
104
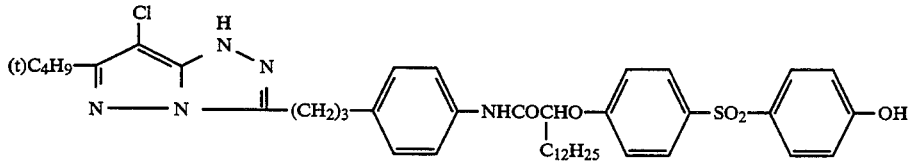
105
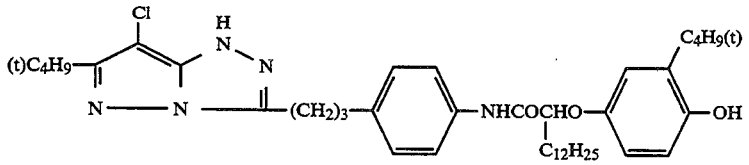
106
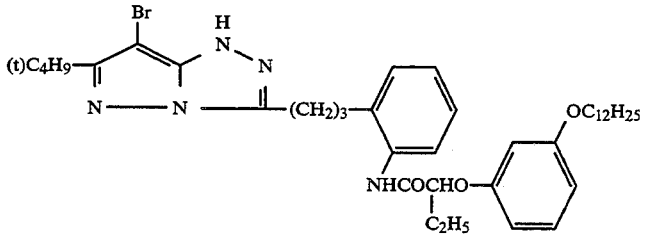
107
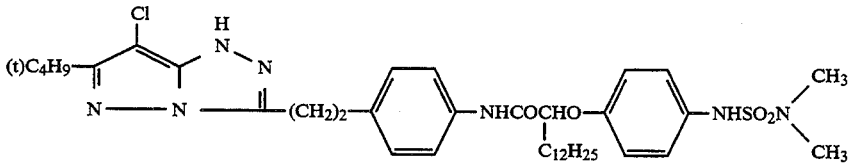
108
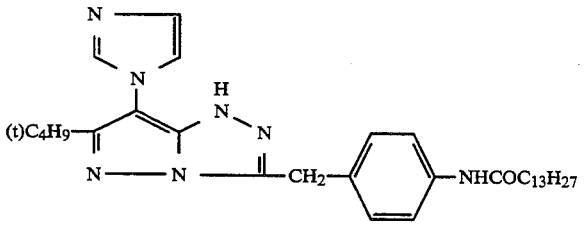
109
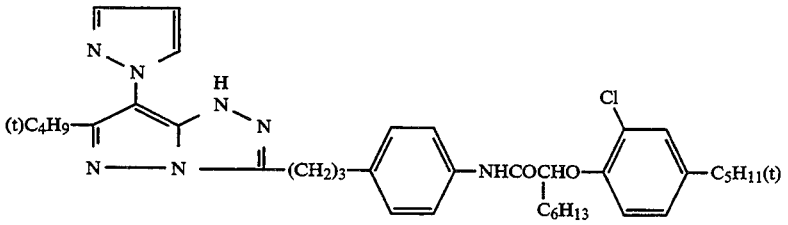
110
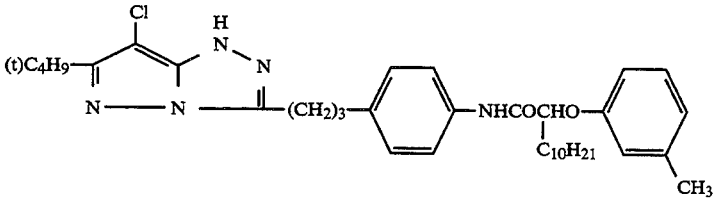
111
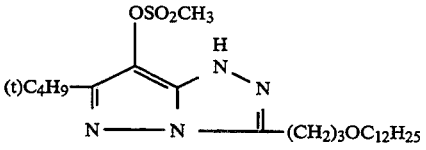

-continued
112
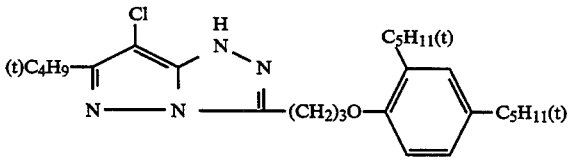
113
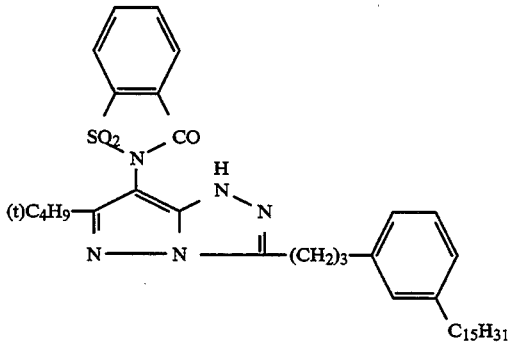
114
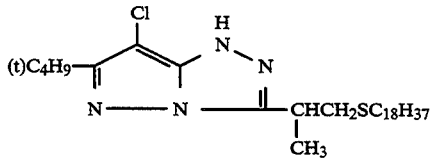
115
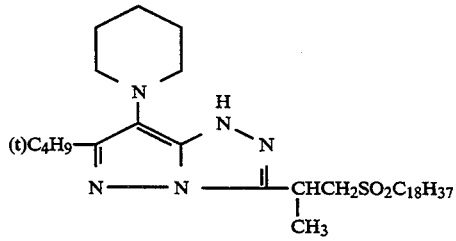
116
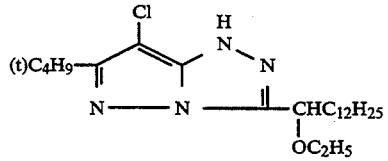
117
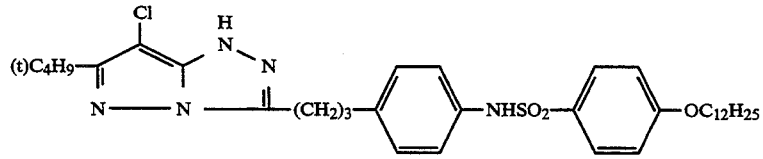
118
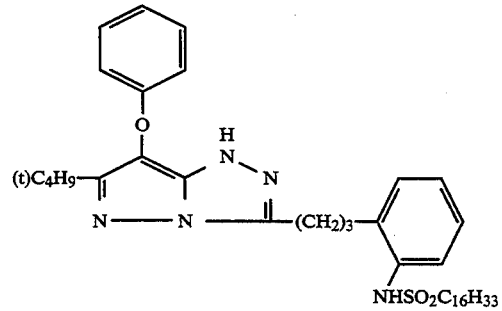

-continued
119
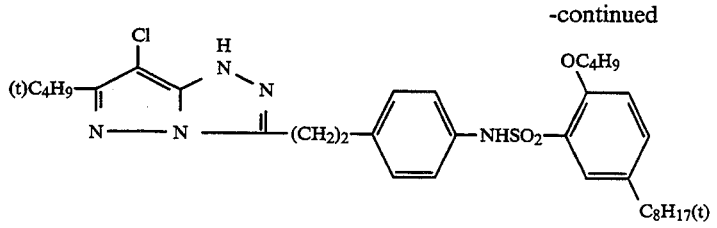
120
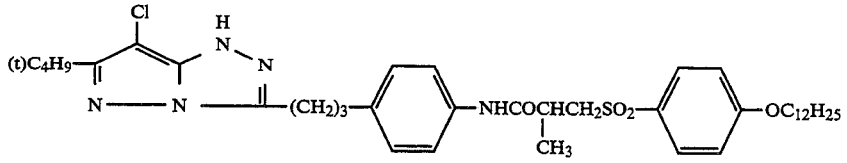
121
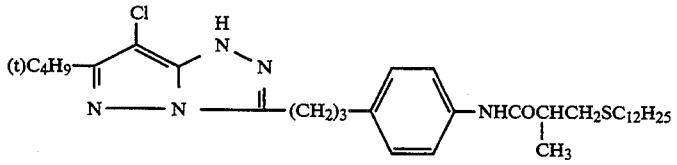
122
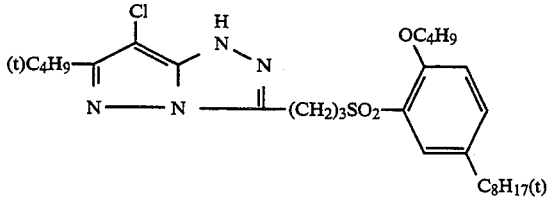
123
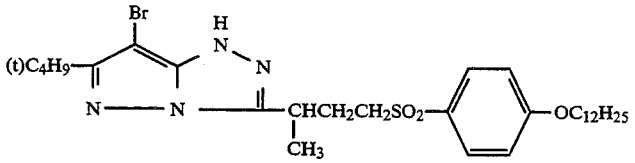
124
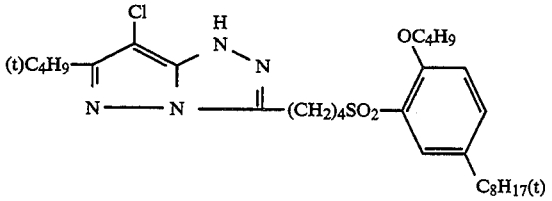
125
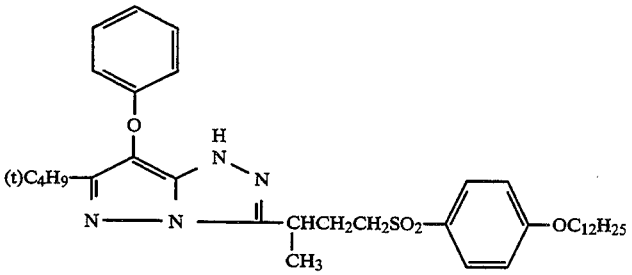
126
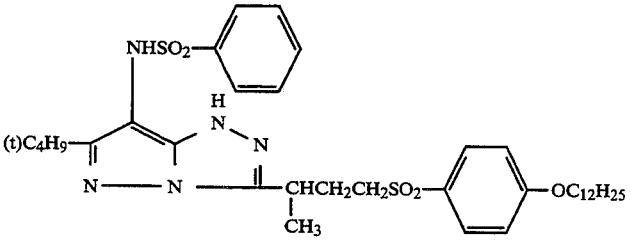

-continued
127
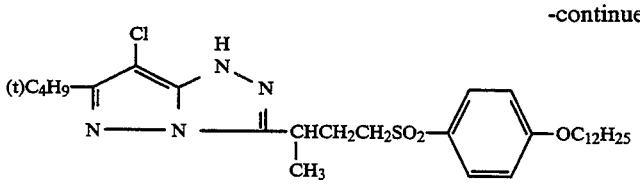
128
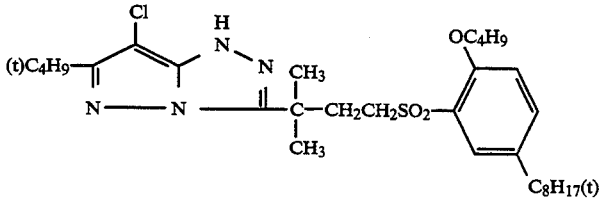
129
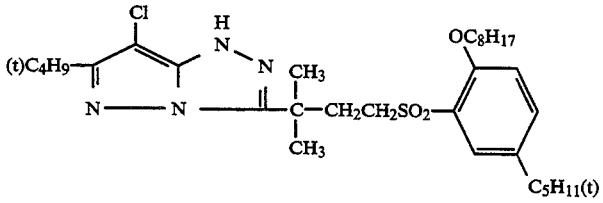
130
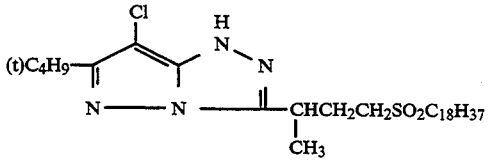
131
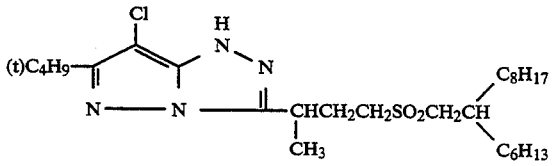
132
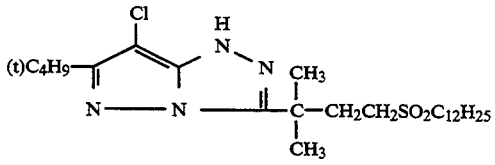
133
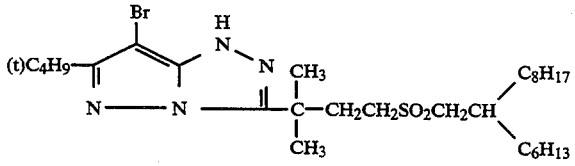
134
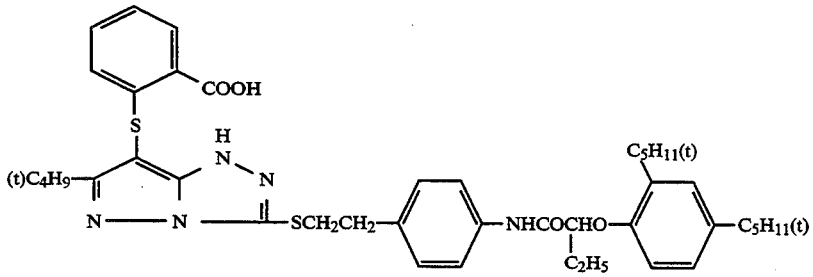

-continued
135
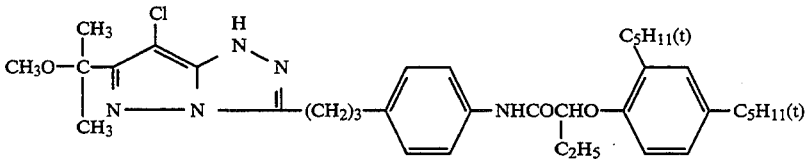
136
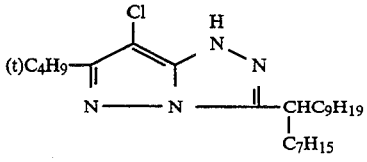
137
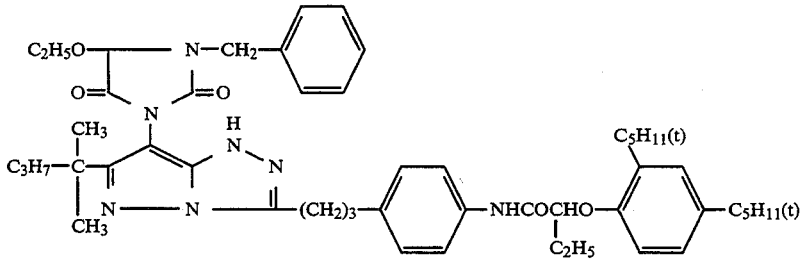
138
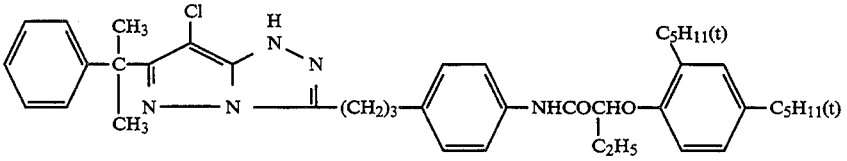
139
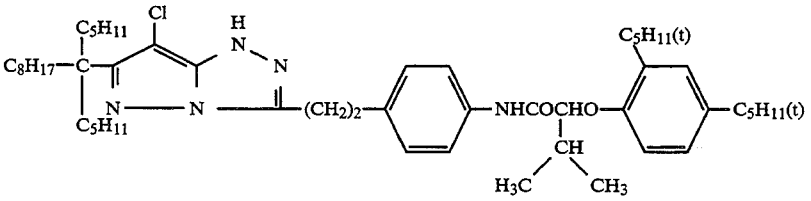
140
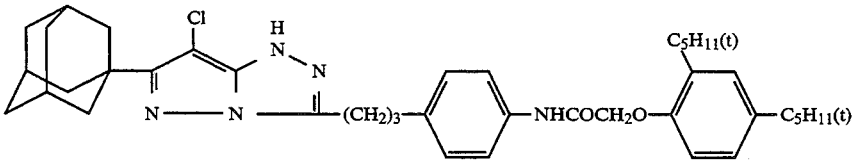
141
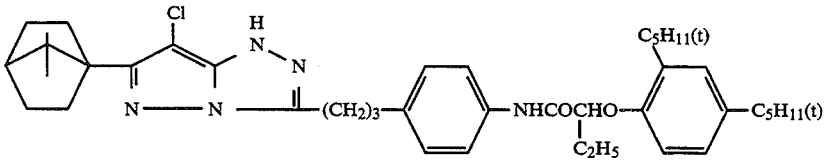
142
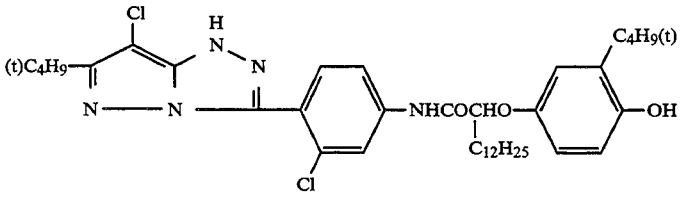

-continued
143
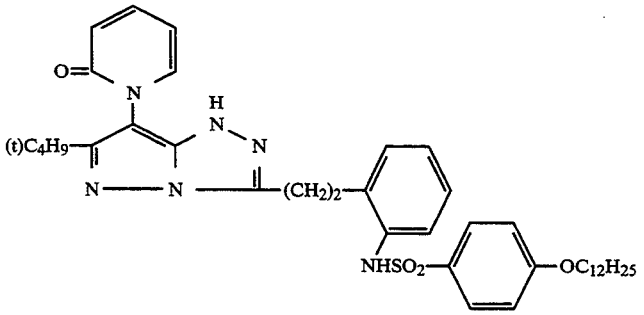
144
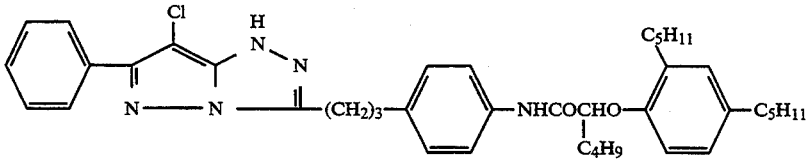
145
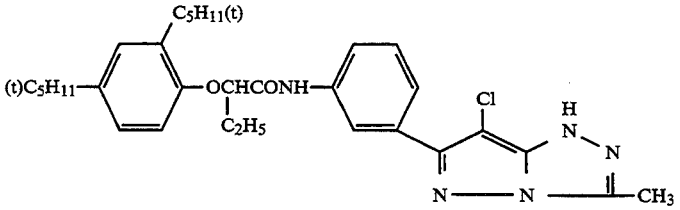
146
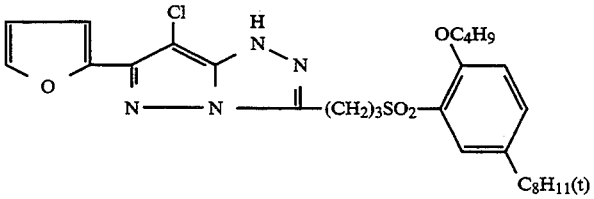
147
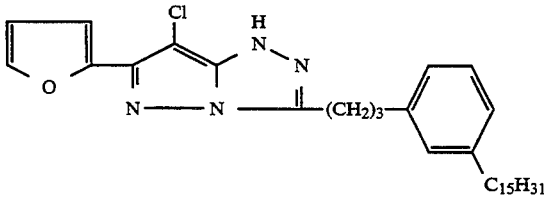
148
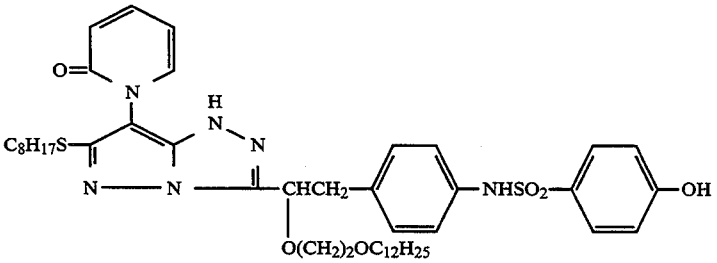
149
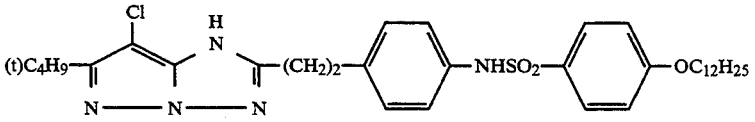
150
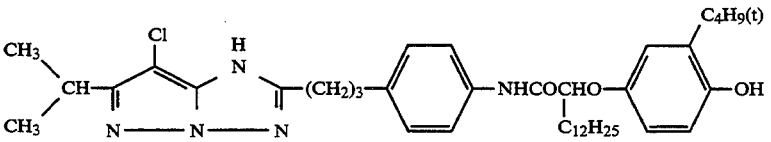

-continued
151
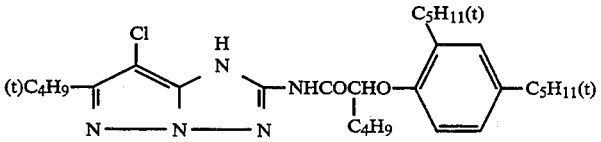
152
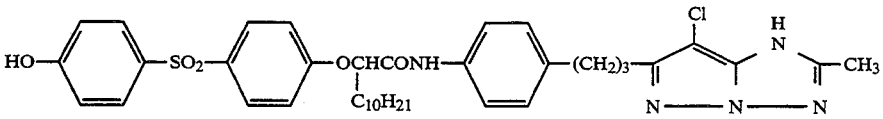
153
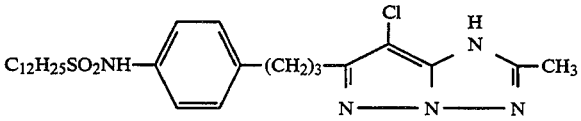
154
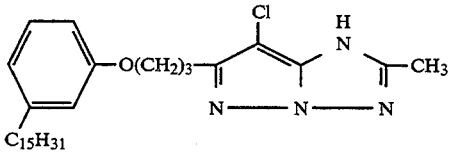
155
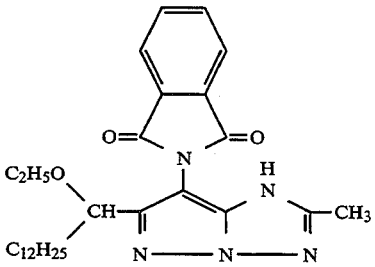
156
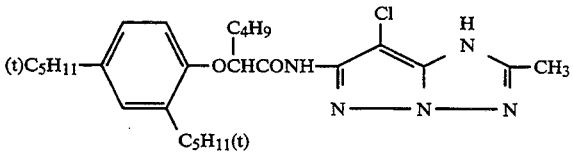
157
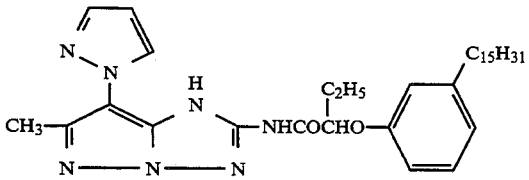
158
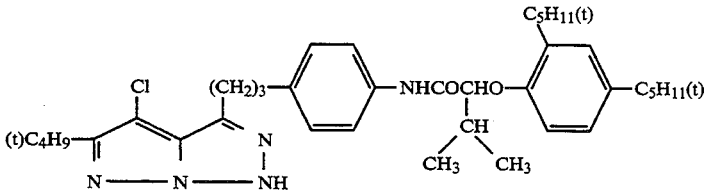
159
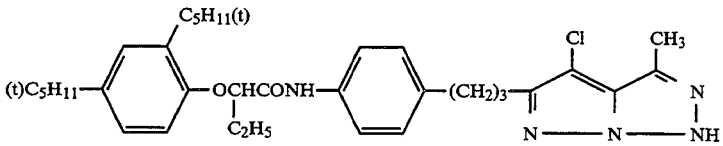

-continued
160
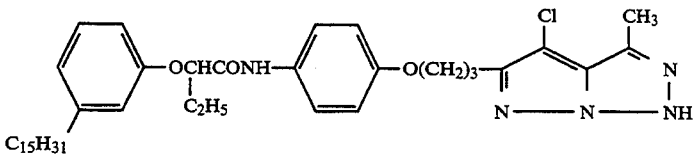
161
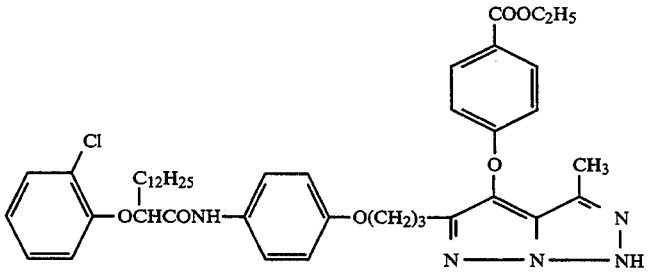
162
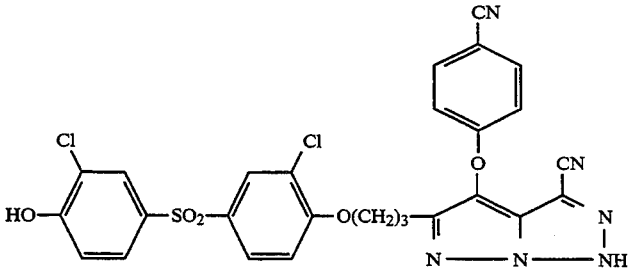
163
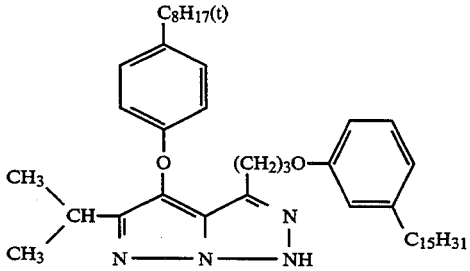
164
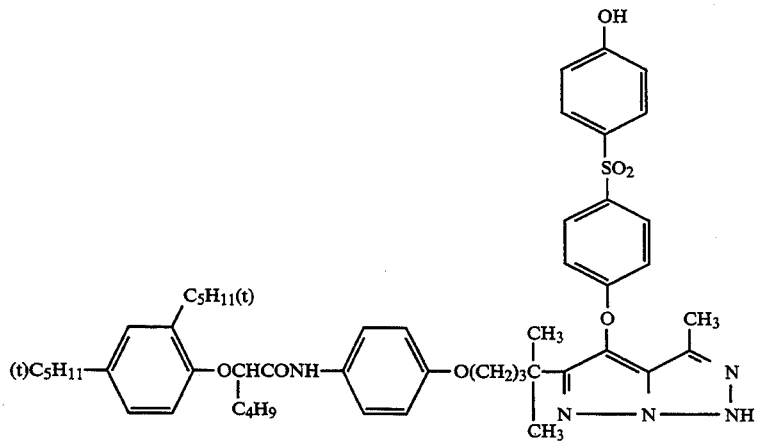
165
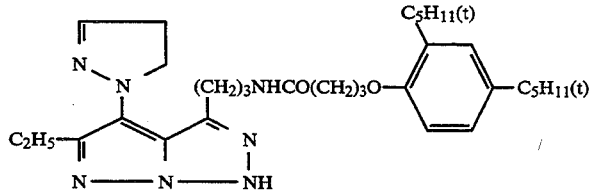

-continued
166
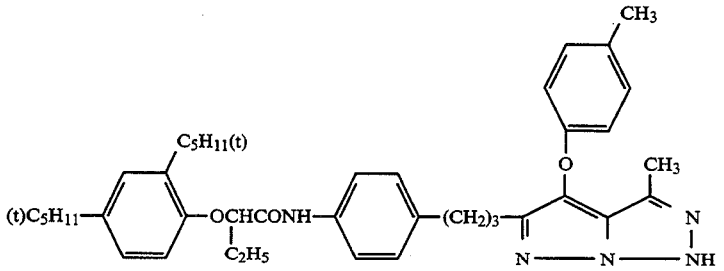
167
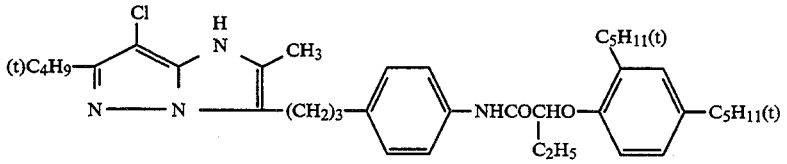
168
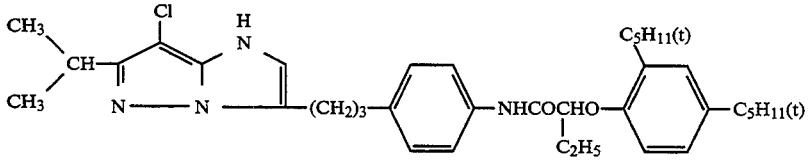
169
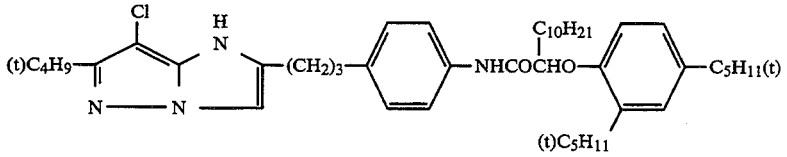
170
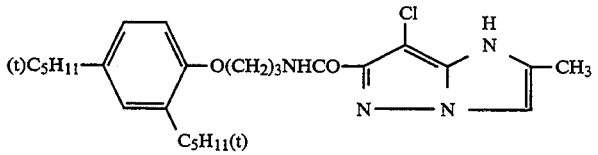
171
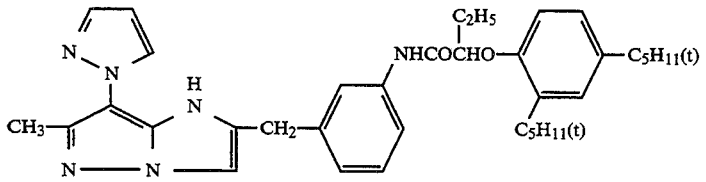
172
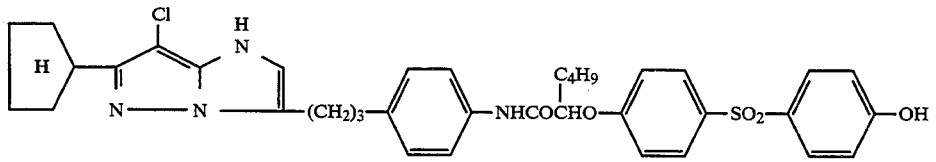
173
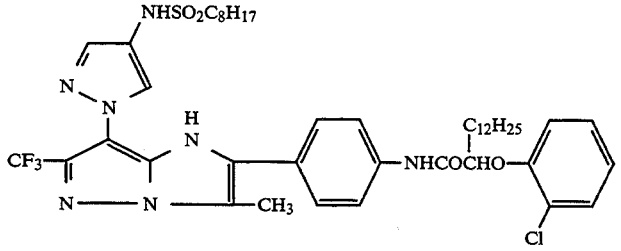

-continued
174
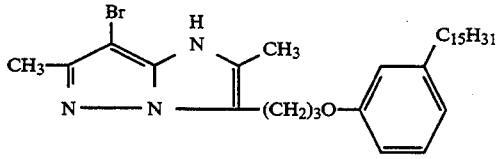
175
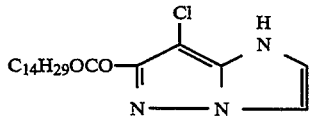
176
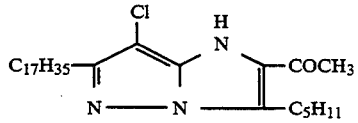
177
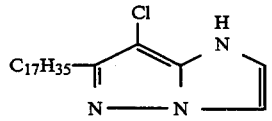
178
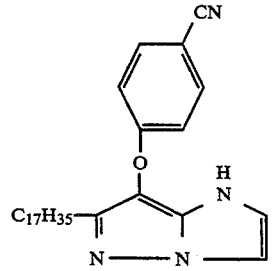
179
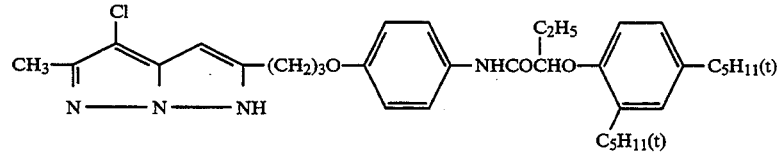
180
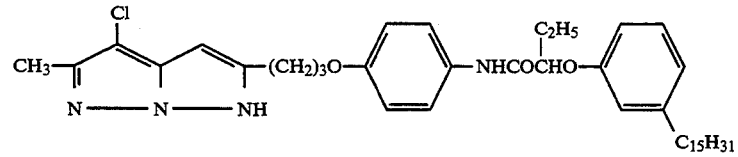
181
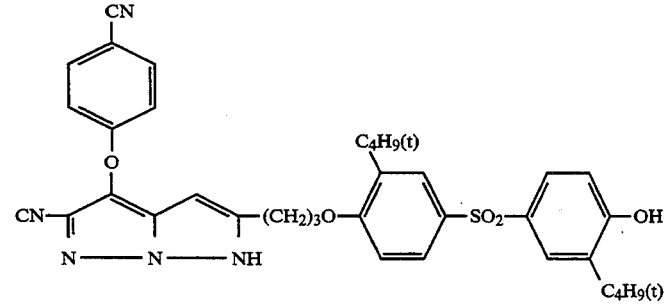

-continued
182
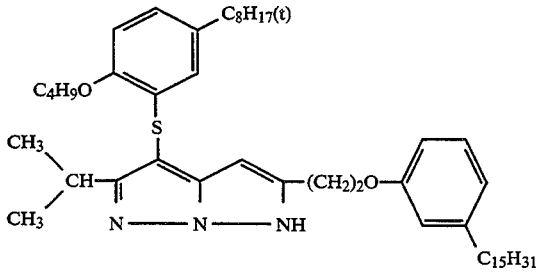
183
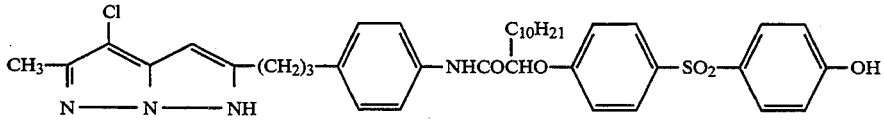
184
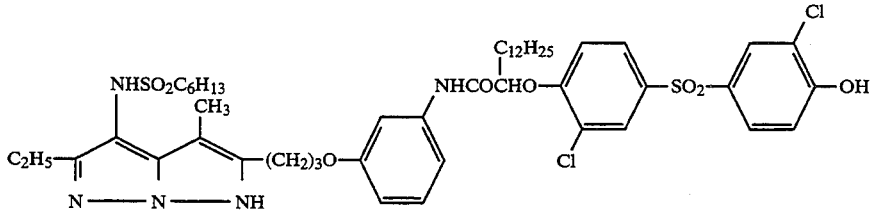
185
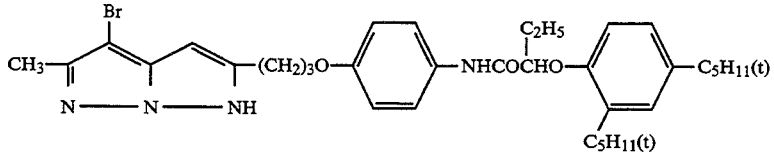
186
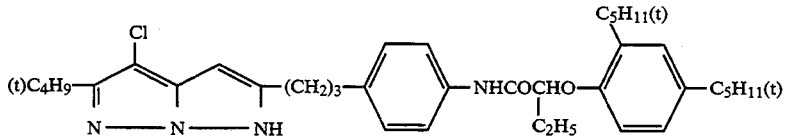
187
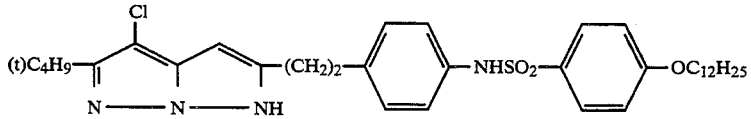
188
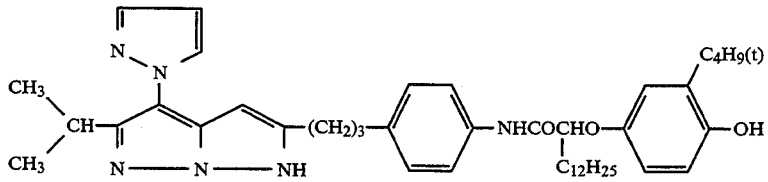
189
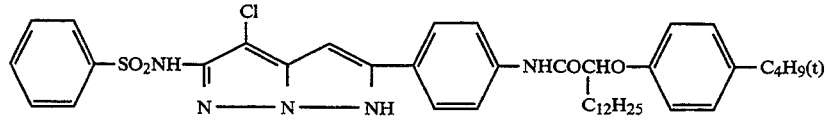

-continued
190
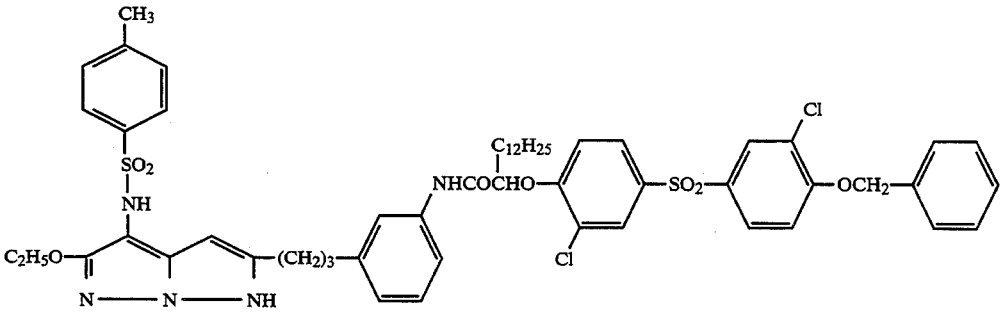
191
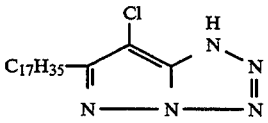
192
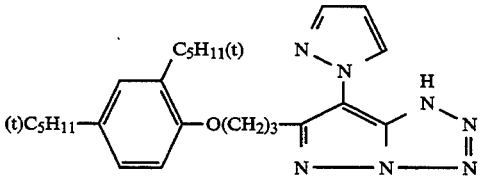
193
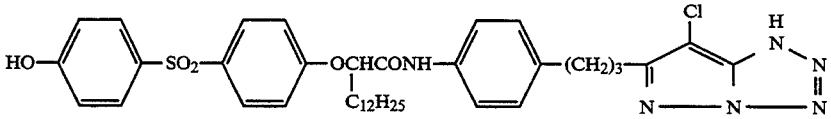
194
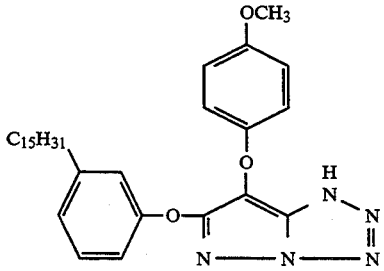
195
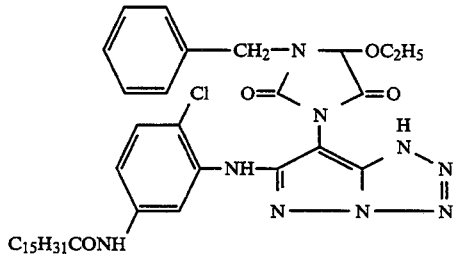
196
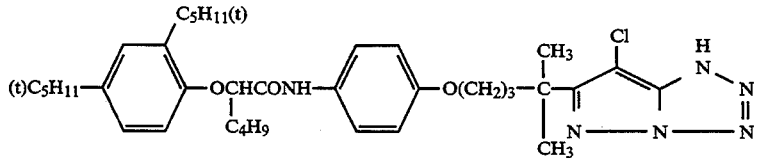
197
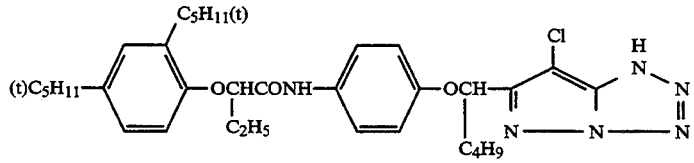

-continued

198

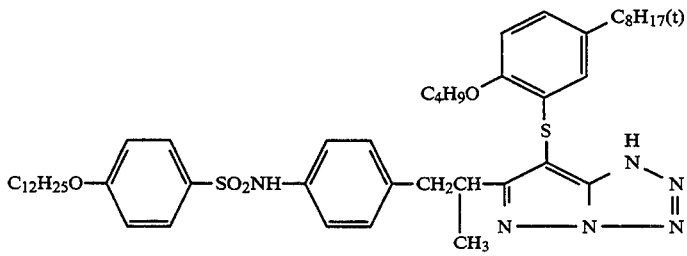

199

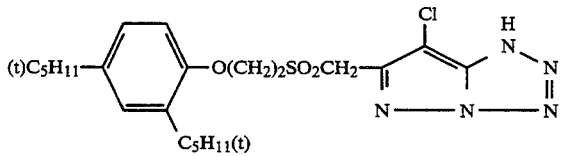

The above-mentioned typical couplers were synthesized by referring to 'Journal of the Chemical Society, Perkin I', 1977, pp. 2047–2052; U.S. Pat. No. 3,725,067; Japanese Patent O.P.I. Publication Nos. 99437/1984 and 42045/1983; and the like.

The couplers of the invention may ordinarily be used in an amount of from $1\times10^{-3}$ mole to 1 mole, and more preferably from $1\times10^{-2}$ mole to $8\times10^{-1}$ mole, per mole of a silver halide.

The couplers of the invention may also be used together with the other kinds of magenta couplers.

In the invention, the expression, 'A magenta coupler combined with a silver halide emulsion layer', means 'a magenta coupler capable of forming a magenta dye-image through a reaction thereof upon the oxidation products of a color developing agent produced in color-developing the silver halide emulsion layer'.

Next, a monodispersed emulsion relating to the invention will now be described.

The monodispersed emulsions relating to the invention mean those having a variation coefficient of not more than 0.22 and more preferably not more than 0.15 in the grain size distribution of a silver halide in the emulsion. A variation coefficient indicates an extent of the grain size distribution and is determined by the following equations:

$$\text{Variation coefficient } (S/r) = \text{Standard deviation of grain size distribution} \frac{}{\text{Average grain size}}$$

$$\text{Standard deviation of grain size distribution } (S) = \sqrt{\frac{\Sigma(\overline{r}-ri)^2 ni}{ni}}$$

$$\text{Average grain size } (\overline{r}) = \frac{\Sigma niri}{\Sigma ni}$$

wherein ri represents the grain size of individual grains; and ni represents the number thereof.

The term, grain size, denoted herein means the diameter of a grain when the grain is of a globular-shaped silver halide, and it also means the diameter of a circular image having the same area as that of the projected grain image when the grain is that in the shapes other than the globular shape.

The monodispersed emulsions relating to the invention may be used independently or in combination in the form of mixture, provided that the variation coefficients thereof are not more than 0.22. It is also allowed to use the mixture of a polydispersed emulsion and a monodispersed emulsion. The preferable monodispersed emulsions relating to the invention include, for example, a single kind of or a mixture of not more than three kinds of monodispersed emulsions each having the above-mentioned variation coefficient of not more than 0.22, or a mixture of a polydispersed emulsion and a monodispersed emulsion. In the case of the above-mentioned mixture, the monodispersed emulsion has an average grain size smaller than that of the polydispersed emulsion and occupies not less than 40% of a total projected area of the whole of the silver halide grains. More preferably, the monodispersed emulsion relating to the invention comprises a single kind of a monodispersed emulsion having the above-mentioned variation coefficient of not more than 0.22 or a mixture of the two kinds thereof.

In the silver halide grains used in the monodispersed emulsions relating to the invention (hereinafter called the emulsions of the invention), the average grain size thereof defined by the above-mentioned formula is preferably from not smaller than 0.25 μm to not larger than 0.75 μm and, more preferably, from not smaller than 0.35 μm to not larger than 0.65 μm.

There is no particular limitation to the silver halide composition of a silver halide grain to be used in the emulsion of the invention. It is, however, preferred that the silver iodide contents are small, that is, the emulsion is a silver chlorobromide emulsion, substantially. The substantial silver chlorobromide emulsion means that the silver halide of a silver halide grain used in a silver halide emulsion is composed of silver iodide less than 1 mol % and, silver chloride and silver bromide for the rest.

In a silver halide grain, a silver chloride content is preferably not less than 5 mol % and, more preferably, not less than 15 mol %.

Any crystal habits of the silver halide grains may be used in the emulsions of the invention. Any regular formed and irregular formed crystals including those in the globular or plate form may be used. In these grains, there may be used the crystals having any ratios of {100} plane to {111} plane. In addtion to the above, those in the compound crystal forms and those mixed with various crystal formed grains may either be used.

The silver halide grains to be used in the emulsions of the invention may be prepared in any one of the acid process, neutral process and ammonia process. It is allowed to grow such grains either at a time or after producing seed grains. The respective processes of preparing the seed grains and of growing them may be the same with or the different from each other.

The processes for reaction of a soluble silver salt and a soluble halide may include a normal precipitation process (or single-jet precipitation process), a reverse precipitation process, a double-jet precipitation process, the combination thereof and the like. Among them, the double-jet precipitation process is preferred for the reaction. Further, with the purpose of improving the monodispersibility a pAg-controlled double-jet precipitation process described in Japanese Patent O.P.I. Publication No. 48521/1979 may also be used as a version of the above-mentioned double-jet processes.

If further required, such a solvent for silver halides as thioether or such a crystal habit controlling agent as a mercapto-group-containing compound and a spectral sensitizer may also be used.

In course of forming and/or growing the silver halide grains used in the emulsions of the invention, a metal ion may be added to and contained in the inside and/or surface of the grain by the use of a cadmium salt, a zinc salt, a lead salt, a tarium salt, an iridium salt or the complex salts thereof, a rhodium salt or the complex salts thereof, or an iron salt or the complex salts thereof; and a reduction sensitization speck may be provided to the inside and/or surface of the grain by putting the grain in a suitable reducible atmosphere.

In the emulsions of the invention, unnecessary soluble salts may be removed therefrom after completing the growth of the silver halide grains, or the unnecessary soluble salts may remain unremoved. If they are to be removed, it can be done according to the process described in Research Disclosure, vol. 17643.

In the silver halide grains used in the emulsions of the invention, the inside and the surface thereof may be composed of the same layer or the different layers.

The silver halide grains used in the emulsions of the invention may be those in which a latent image may be formed mainly on the surface thereof, or formed mainly inside the grains.

The emulsions of the invention are chemically sensitized in the usual manner. Namely, they may be applied with a sulfur sensitization process using a sulfur-containing compound capable of reacting upon a silver ion and an active gelation; a selenium sensitization process using a selenium compound; a reduction sensitization process using a reducible substance; or a noble-metal sensitization process using gold or other noble metal compounds, independently or in combination.

The emulsions of the invention may be spectrally sensitized to the desired wavelength region by making use of the dyes which are well-known in the photographic industry as the spectral sensitizers. These spectral sensitizers may be used independently or in combination. Further, the emulsions of the invention are allowed to contain, as well as the spectral sensitizers, a dye having no spectral sensitizing function in itself or a supersensitizer which is a compound not substantially absorbing visible rays of light and capable of increasing the sensitizing function of the spectral sensitizers.

With the purposes of preventing a light-sensitive material from causing a fog and/or of keeping the photographic characteristics thereof stable in manufacture, preservation or photographic processing of the light-sensitive material, it is allowed to add the compounds well-known in the photographic industry as an antifoggant or a stabilizer into the emulsions of the invention, at any point of time when the chemical sensitization process is being carried out and/or completed, and/or any time thereafter, but before the silver halide emulsion is coated on.

'Color photographic light-sensitive materials for printing use' embodied in the invention mean the color light-sensitive materials suitable for the purpose of direct appreciation. Accordingly, they shall not be limited only to a light-sensitive material using paper to serve as the support thereof. For example, there may be used a baryta paper, a paper support coated with a polyolefin resin and the like, a polyethylene-terephthalate support containing white pigment, a support comprising a transparent film base bearing thereon a hydrophilic colloidal layer into which a white pigment is dispersively added, and the like. Namely, the preferable supports to be used in the color photographic light-sensitive materials of the invention are those in white.

The preferable supports include, for example, a paper support coated thereon with a polyolefin resin added with a white pigment such as an anatase type titanium dioxide, a polyethyleneterephthalate film containing a white pigment such as barium sulfate.

About the reason why the effects of the invention can remarkably be displayed only on the color photographic light-sensitive materials for printing use which has the above-mentioned reflection type supports, it still remains unexplained. There may supposedly be some reasons such as an optical or psychological reason from the special characteristics that a white-colored support is used to appreciated a color photograph directly with reflected light, a physiological reason that magenta color is rather prominent than the other colors, that is, the spectral luminous efficiency of the magenta color is high, and the like. Nevertheless, these reasons have not yet definitely answered to the effects of the invention.

As for the binders or the protective colloids to be used in the color photographic light-sensitive materials for printing use relating to the invention, a gelatin is advantageously used and, besides, a gelatin derivative, a graft-polymer of gelatin and other macromolecular substances, a protein, a sugar derivative, a cellulose derivative, a hydrophilic colloid such as a mono- or co-polymer synthesized hydrophilic macromolecular substance and the like.

In the color photographic light-sensitive materials for printing use relating to the invention, the photographic emulsion layers and the other hydrophilic colloidal layers thereof are hardened by cross-coupling thereto a binder molecule or a protective colloid and by using therein some hardeners for hardening the layer strength independently or in combination. It is preferred to add such a hardener in an amount of the order than another hardener is not needed to add further to a processing solution but the light-sensitive material may be hardened. It is the matter of course that such hardeners may be added into the processing solutions.

In the color photographic light-sensitive materials for printing use relating to the invention, a plasticizer may also be added tot he silver halide emulsions and/or the other hydrophilic colloidal layers thereof, with the purpose of increasing the flexibility of such layers.

In the color photographic light-sensitive materials for printing use relating to the invention, the photographic emulsion layers and the other hydrophilic colloidal layers thereof are allowed to contain a non-water-soluble or hardly soluble synthetix polymer disposed matter (a latex), with the purpose of improving the dimentional stability of such layers or the like.

In the color photographic light-sensitive materials for printing use relating to the invention, the emulsion layers thereof are processing for color development by making use of a dye-forming coupler for forming a dye through a coupling reaction on the oxidation products of an aromatic primary amine developer such as a p-phenylenediamine derivative, an Aminophenol derivative or the like. It is an ordinary manner to select the suitable ones from the dye-forming couplers so as to form the dyes capable of absorbing the respective spectra of the corresponding emulsion layers; that is to say, a yellow dye-forming coupler is selected therefrom to be used in a blue-sensitive emulsion layer, a magenta one in a green-sensitive emulsion layer, and a cyan one in a red-sensitive emulsion layer, respectively. However, it is also allowed to prepare such emulsion layer in the different manner from the above-mentioned combinations in accordance with the purposes.

The yellow dye-forming couplers include, for example, an acylacetamide coupler such as those of a benzoylacetanilide or a pivaloylacetanilide; the magenta dye-forming couplers include, for example, a 5-pyrazolone coupler, a pyrazolobenzimidazole coupler, a pyrazolotriazole coupler, an open-chained acylacetonitrile coupler and the like; and the cyan dye-forming couplers include, for example, a naphthol coupler, a phenol coupler and the like.

The yellow-dye image-forming couplers typically include, for example, a 4- or 2-equivalent coupler of acyacetamide type or bezoylmethan type; and they are described in, for example, U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140 and 3,894,875; British Patent Nos. 778,089, 808,276, 875,476, 1,402,511, 1,421,126, and 1,513,832; Japanese Patent Examined Publication No. 13576/1974; and Japanese Patent O.P.I. Publication Nos. 29432/1973, 66834/1973, 10736/1974, 122335/1974, 28834/1975, 132926/1975, 138832/1975, 3631/1976, 17438/1976, 26038/1976, 26039/1976, 50734/01976, 53825/1976, 75521/1975, 89728/1976, 102636/1976, 107137/1976, 117031/1976, 122439/1976, 143319/1976, 9529/1978, 82332/1978, 135625/1978, 145619/1978, 23528/1979, 48541/1979, 65035/1979, 133329/1979, and 598/1980.

The cyan-dye image-forming couplers typically include, for example, a 4- or 2-equivalent cyan-dye image-forming coupler of phenol or naphthol type; and they are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,466,622, 3,476,563, 3,737,316, 3,758,308, and 3,839,044; British Patent Nos. 478,991, 945,542, 1,084,480, 1,377,233, 1,388,024 and 1,543,040; and Japanese Patent O.P.I. Publication Nos. 34725/1972, 10135/1975, 25228/1075, 112038/1975, 117422/1975, 130441/1975/ 6551/1976, 37647/1976, 52828/1976, 108841/1976, 109630/1978, 48237/1979, 66129/1979, 131931/1979 and 32071/1980.

It is desired that the above-mentioned dye-forming couplers are to have, inside the moleculars thereof, the so-called ballast groups each of which has not less than 8 carbon atoms and is capable of non-diffusing any coupler.

These dye-forming couplers may be either one of a 4-equivalent one in which four silver ions are necessarily reduced and a 2-equivalent one in which two silver ions are necessarily reduced, both for forming one molecule dye. Among them, however, the 2-equivalent ones are particularly preferred.

A solid dispersion process, a latex dispersion process, an oil-drop in-water type emulsion dispersion process and other various processes may be applied to the hydrophobic compounds of the dye-forming couplers not needed to be adsorbed on the surfaces of a silver halide crystal. These processes may suitably be selected to apply in accordance with the chemical structure and the like of the hydrophobic compounds of these couplers. In the oil-drop in-water type emulsion dispersion process, there may be applied with a process of dispersing the hydrophobic compounds of the couplers or the like. In the process, generally, a high-boiling organic solvent having a boiling point of not lower than 150° C. is dissolved in combination, if necessary, with a low boiling and/or water-soluble organic solvent; and the resulting solution is emulsified and dispersed together with a hydrophilic binder such as an aqueous gelatin solution containing a surface active agent by making use of such a dispersing means as a stirrer, homogenizer, colloid-mill, flow-jet mixer, supersonic device or the like; and, after then, the resulting emulsified and dispersed matter is added to a directing hydrophilic colloidal layer.

The high-boiling organic solvents to be used in the magenta couplers represented by the aforegiven Formula [I] relating to the invention are preferred to be a compound of less than 0.6 in dielectric constant. The lower limit of the dielectric constant is not particularly limited, but a dielectric constant of not less than 1.9 is preferred. The preferred compounds include, for example, such an ester as a phthalate, phosphate and the like, an organic acid amide, a ketone, a hydrocarbon compound, and the like, each having a dielectric constant of less than 6.0; and among them, the more preferable ones are the phthalate or the phosphate. Further, the above-mentioned organic solvents may be a mixture of not less than two of them, and in this case the dielectric constant thereof is preferably less than 6.0. For reference, the dielectric constant mentioned herein indicates a dielectric constant at 30° C. The high-boiling organic solvents capable of being used in combination in the invention include, for example, dibutyl phthalate, dimethyl phthalate, tricresyl phosphate, tributyl phosphate and the like.

The phthalate advantageously used in the invention, include, for example, those represented by the following Formula [XII]:

Formula [XII]

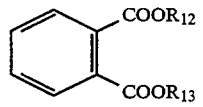

wherein, $R_{12}$ and $R_{13}$ represent an alkyl group, an alkenyl group or an aryl group, provided that an aggregate number of the the carbon atoms thereof is from 9 to 32 and, more preferably, from 16 to 24.

In the invention, the alkyl groups represented by $R_{12}$ or $R_{13}$ in the above-given Formula [XII] are of the normal chained or branch chained include, for example, a butyl, pentyl, hexyl, heptyl, octyl, nonyl, decyl, undecyl, dodecyl, tridecyl, tetradecyl, pentadecyl, hexadecyl, heptadecyl and octadecyl groups. The aryl groups represented by $R_{12}$ or $R_{13}$ in the Formula include, for example, a phenyl and naphthyl groups. The alkenyl groups represented thereby include, for example, a hexenyl, heptenyl and octadecenyl groups. These alkyl, alkeyl and aryl groups each may have a single or plural substituents. The substituents of the alkyl and alkenyl groups include, for example, a halogen, an alkoxy, aryl, aryloxy, alkenyl and alkoxycarbonyl groups. The substituents of the aryl groups include, for example, a halogen, an alkyl, alkoxy, aryl, aryloxy, alkenyl and alkoxycarbonyl groups. Not less than two of the above-mentioned substituents may also be introduced into the alkyl, alkenyl or aryl groups.

The phosphate capable of being advantageously used in the invention include, for example, those represented by the following Formula [XIII]:

Formula [XIII]:

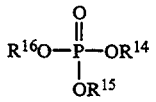

wherein $R_{14}$, $R_{15}$ and $R_{16}$ represent an alkyl, alkenyl or aryl group, respectively, provided that an aggregate number of the carbon atoms thereof is from 24 to 54.

The alkyl groups represented by $R_{14}$, $R_{15}$ and $R_{16}$ include, for example, a butyl, pentyl, hexyl, heptyl, octyl, nonyl, decyl, undecyl, dodecyl, tridecyl, tetradecyl, pentadecyl, hexadecyl, heptadecyl, octadecyl and nonadecyl groups. The aryl groups represented thereby include, for example, a phenyl and naphthyl groups. The alkenyl groups represented thereby include, for example, a hexenyl, heptenyl and octadecenyl groups, respectively.

These alkyl, alkenyl and aryl groups may have a single or plural substituents. More preferably, $R_{14}$, $R_{15}$ and $R_{16}$ are an alkyl group such as 2-ethylhexyl group, n-octyl group, 3,5,5-trimethylhexyl group, n-nonyl group, n-decyl group, sec-decyl group, t-octyl group and the like.

The typical examples of the preferably organic solvents will be given below:

Exemplified Organic Solvents:

S-1

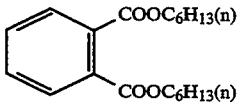

S-2

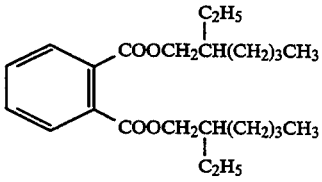

S-3

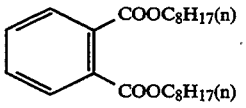

-continued

S-4

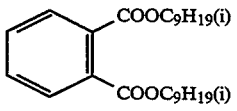

S-5

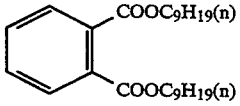

S-6

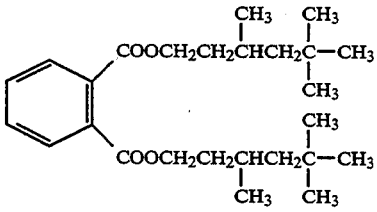

S-7

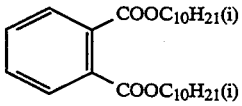

S-8

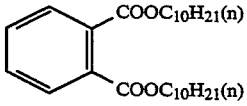

S-9

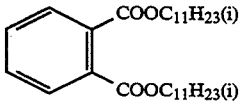

S-10

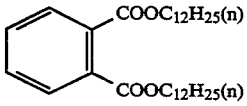

S-11

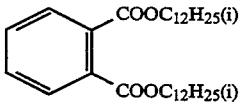

S-12

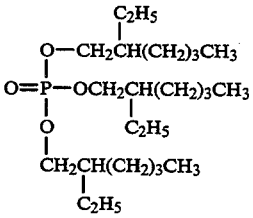

S-13

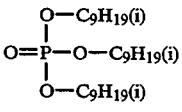

S-14

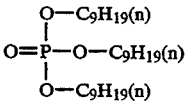

S-15

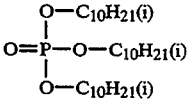

-continued

S-16

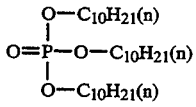

S-17

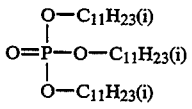

S-18

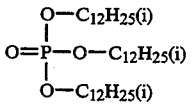

S-19

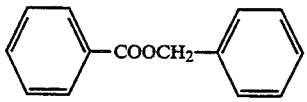

S-20

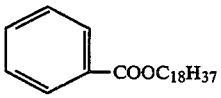

S-21

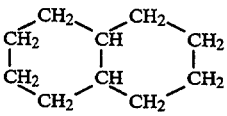

S-22

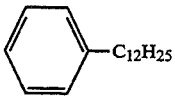

An anionic, nonionic or cationic surface active agent may be used to serve as a dispersing assistant in such a process that a hydrophobic compound is dissolved in an independent low-boiling solvent or in the solvent in combination of the low-boiling solvent and a high-boiling solvent and the resulting solution is dispersed mechanically or by making use of supersonic waves.

In the color photographic light-sensitive materials for printing use relating to the invention, there uses a color fog restrainer is used for preventing a color contamination, sharpness deterioration and rough graininess caused by the migration of the oxidation products or electron-transferring agents of a developing agent, between the emulsion layers (between the same color sensitive layers and/or the different color sensitive layers).

The color fog restrainers may be provided to an emulsion layer in itself or to an interlayer which is interposed between the adjacent layers thereto.

In the color photographic light-sensitive materials for printing use relating to the invention, the image stabilizers preferably usable for preventing the deterioration of a dye image include, for example, those represented by the following Formulas [A] to [H] and [J] to [K :

Formula [A]:

-continued

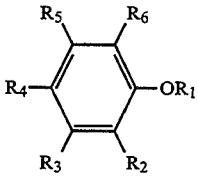

wherein $R_1$ represents hydrogen, an alkyl, alkenyl, aryl or heterocyclic group; $R_2$, $R_3$, $R_5$ and $R_6$ represents hydrogen, a halogen, a hydroxy, alkyl, alkenyl, aryl, alkoxy or acyamino group, respectively; and $R_4$ represents an alkyl, hydroxy, aryl or alkoxy group.

Further, $R_1$ and $R_2$ may close their rings to form a 5- or 6-membered ring, and when this is the case, $R_4$ represents a hydroxy or alkoxy group. Still further, $R_3$ and $R_4$ may close their rings to form a 5-membered hydrocarbon ring and when this is the case $R_1$ represents an alkyl, aryl or heterocyclic ring, provided that, however, $R_1$ is not hydrogen and $R_4$ is not a hydroxy group.

In the above-given Formula [A], $R_1$ represents hydrogen, an alkyl, alkenyl, aryl or heterocyclic group, however, among them, the alkyl groups are the normal chained or branch chained ones including, for example, a methyl, ethyl, propyl, n-octyl, tert-octyl, hexadecyl or the like group. The phenyl groups represented by $R_1$ include, for example, an allyl, hexenyl, octenyl or the like group. Further, The aryl groups represented by $R_1$ include, for example, a phenyl or naphthyl group. Still further, the heterocyclic groups represented by $R_1$ typically include, for example, a tetrahydropyranyl, pyrimidyl or the like group. Each of the above-mentioned groups may be able to have a substituent. The alkyl groups having a substituent include, for example, a benzyl or ethoxymethyl group; the aryl groups having a substituent include, for example, a methoxyphenyl, chlorophenyl or 4-hydroxy-3,5-dibutylphenyl group, or the like groups.

In Formula [A], $R_2$, $R_3$, $R_5$ and $R_6$ represent hydrogen, a halogen, a hydroxy, alkyl, alkenyl, aryl, alkoxy or acylamino group and, among them, the alkyl, alkenyl and aryl groups include the same ones as those alkyl, alkenyl and aryl groups represented by $R_1$. The above-mentioned halogen include, for example, fluorine, chlorine, bromine and the like. Further, the above-mentioned alkoxy groups typically include, for example, a methoxy or ethoxy group, or the like group. Still further, the above-mentioned acylamino groups are represented by R'CONH—, wherein R' represents an alkyl group such as a methyl, ethyl, n-propyl, n-butyl, n-octyl, tert-octyl or benzyl group, or the like groups; an alkenyl group such as an aryl, octynyl or oleyl group, or the like groups; an aryl group such as phenyl, ethoxyphenyl or nephthyl group, or the like groups; or a heterocyclic group such as pyridyl or pyrimidyl group.

In Formula [A], $R_4$ represents an alkyl, hydroxy, aryl or alkoxy group and, among them, the alkyl and aryl groups typically include the same ones as those given for the alkyl and aryl groups represented by $R_1$; and the alkenyl groups represented by $R_4$ include the same ones as those given in the alkoxy groups represented by $R_2$, $R_3$, $R_5$ and $R_6$, respectively.

$R_3$ and $R_4$ may close the rings by each other to form a ring together with a benzene ring. Such rings include, for example, those of chroman, coumaran or methylenedioxybenzene.

$R_3$ and $R_4$ may close the rings by each other to form a ring together with a benzene ring. Such rings include, for example, those of indan. These rings may have such a substituent as that of an alkyl, alkoxy or aryl group.

$R_1$ and $R_2$ or $R_3$ and $R_4$ may close the ring to form a ring, and the atom in the formed ring may be a spiro atom to produce a spiro compound, or $R_2$, $R_4$ and the like may be a cross-coupling group to form a bis-substance.

The preferable phenol or phenylether compounds out of those represented by the afore-given Formula [A] are blind one compounds each having four RO-groups in which R represents an alkyl, alkenyl, aryl or heterocyclic group, and the particularly preferably ones are represented by the following Formula [A-1];

Formula [A-1]:

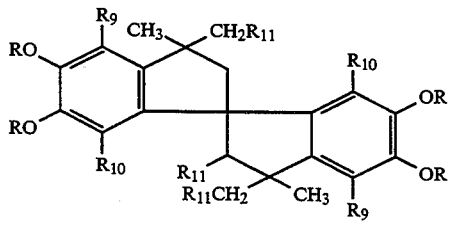

wherein R represents such as alkyl group as a methyl, ethyl, propyl, n-octyl, tert-octyl, benzyl or hexadecyl group; such an alkenyl group as an allyl, octenyl or oleyl group; such an aryl group as a phenyl or naphthyl group; or such a heterocyclic group as a tetrahydropyranyl or pyrimidyl group.

$R_9$ and $R_{10}$ represent hydrogen as fluorine, chlorine or bromine, such an alkyl group as a methyl, ethyl, n-butyl or benzyl group; such an alkoxy group as an alkyl, hexenyl or octenyl group; or such as alkoxy group as a methoxy, ethoxy or benzyloxy group.

And, $R_{11}$ represents hydrogen, such an alkyl group as a methyl, ethyl, n-butyl or benzyl group; such an alkenyl group as a 2-propenyl, hexenyl or octenyl group; or such an aryl group as a phenyl, ethoxyphenyl, chlorophenyl or naphthyl group.

The compounds represented by the aforegiven formula [A] include those described in U.S. Pat. Nos. 3,935,016, 3,982,944 and 4,254,216; Japanese Patent O.P.I. Publication Nos. 21004/1980 and 145530/1979; British Patent Nos. 2,077,455, and 2,062,888; U.S. pat. Nos. 3,764,337, 3,432,330, 3,574,627 and 3,573,050; Japanese Patent O.P.I. Publication Nos. 152225/1977, 20327/1978, 17729/1978 and 6321/1977; British Patent No. 1,347,556; British Patent Open to Public Inspection No. 2,066,975; Japanese Patent Examined Publication Nos. 12337/1979 and 31625/1973; U.S. Pat. No. 3,700,455; and the like.

An amount of the compounds represented by the Formula [A] to be used is preferably from 5 to 300 mol % and, more preferably, from 10 to 200 mol %, to an amount of magenta couplers to be used.

The typical examples of the compounds represented by Formula [A] will be given below:

Type (1)
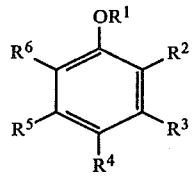
Type (2)
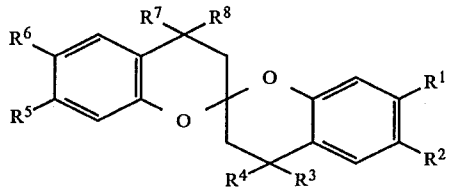
Type (3)
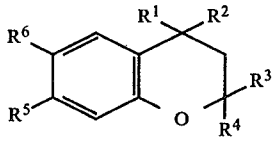
Type (4)
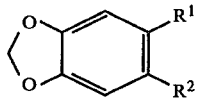
Type (5)
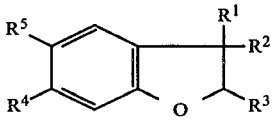
Type (6)

-continued

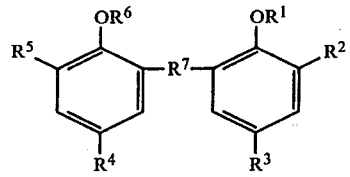

Type (7)

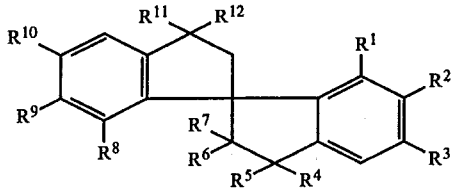

Type (1)

| Compound No. | $R^1$ | $R^2$ | $R^3$ | $R^4$ | $R^5$ | $R^6$ |
|---|---|---|---|---|---|---|
| A-1 | H | OH | $-C(CH_3)_2CH_2C(CH_3)_3$ | $CH_3O$ | H | $-C(CH_3)_2CH_2C(CH_3)_3$ |
| A-8 | $C_8H_{17}$ | $C(CH_3)_2C_2H_5$ | H | $C_8H_{17}O$ | $C(CH_3)_2C_2H_5$ | H |
| A-14 | H | H | OH | $C(CH_3)_2CH_2C(CH_3)_3$ | H | H |
| A-16 | H | $C(CH_3)_2C_3H_7$ | H | $CH_3O$ | $C(CH_3)_2C_3H_7$ | H |

Type (2)

| Compound No. | $R^1$ | $R^2$ | $R^3$ | $R^4$ | $R^5$ | $R^6$ | $R^7$ | $R^8$ |
|---|---|---|---|---|---|---|---|---|
| A-2 | $CH_3$ | OH | $CH_3$ | $CH_3$ | $CH_3$ | OH | $CH_3$ | $CH_3$ |
| A-10 | $CH_3$ | $OCH_3$ | $CH_3$ | $CH_3$ | $CH_3$ | $CH_3O$ | $CH_3$ | $CH_3$ |

Type (3)

| Compound No. | $R^1$ | $R^2$ | $R^3$ | $R^4$ | $R^5$ | $R^6$ |
|---|---|---|---|---|---|---|
| A-3 | $CH_3$ | $CH_3$ | H | $CH_3$ | (t)$C_8H_{17}$ | OH |
| A-11 | $CH_3$ | $CH_3$ | H | $CH_3$ | (t)$C_8H_{17}$ | $C_8H_{17}O$ |
| A-12 | $CH_3$ | $CH_3$ | H | $CH_3$ | $CH_3$ | $O(CH_2)_2OC_{10}H_{21}$ |
| A-17 | H | $CH_3$ | $CH_3$ | $CH_3$ | (t)$C_8H_{17}$ | OH |
| A-18 | $CH_3$ | $CH_3$ | $CH_3$ | 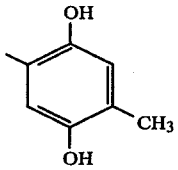 | $CH_3$ | OH |

Type (4)

-continued

| Compound No. | $R^1$ | $R^2$ |
|---|---|---|
| A-4 | $C_3H_7$ | 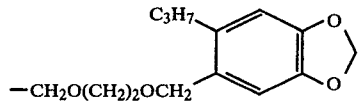 |
| A-9 | $C_3H_7$ | $-CH_2O(CH_2)_2OC_4H_9$ |

Type (5)

| Compound No. | $R^1$ | $R^2$ | $R^3$ | $R^4$ | $R^5$ |
|---|---|---|---|---|---|
| A-5 | $CH_3$ | $CH_3$ | $C_2H_5O$ | $(t)C_8H_{17}$ | OH |

Type (6)

| Compound No. | $R^1$ | $R^2$ | $R^3$ | $R^4$ | $R^5$ | $R^6$ | $R^7$ |
|---|---|---|---|---|---|---|---|
| A-6 | H | $(t)C_4H_9$ | $CH_3$ | $CH_3$ | $(t)C_4H_9$ | H | $CH_2$ |
| A-15 | $CH_3$ | $(t)C_4H_9$ | $CH_3$ | $CH_3$ | $(t)C_4H_9$ | $CH_3$ | $CH_2$ |

Type (7)

| Compound No. | $R^1$ | $R^2$ | $R^3$ | $R^4$ | $R^5$ | $R^6$ | $R^7$ | $R^8$ | $R^9$ | $R^{10}$ | $R^{11}$ | $R^{12}$ |
|---|---|---|---|---|---|---|---|---|---|---|---|---|
| A-13 | H | $C_3H_7O$ | $C_3H_7O$ | $CH_3$ | $CH_3$ | H | H | H | $C_3H_7O$ | $C_3H_7O$ | $CH_3$ | $CH_3$ |
| A-19 | H | $CH_3O$ | $CH_3O$ | $CH_3$ | $CH_3$ | H | H | H | $CH_3O$ | $CH_3O$ | $CH_3$ | $CH_3$ |
| A-20 | $CH_3$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-21 | H | $C_2H_5O$ | $C_2H_5O$ | $CH_3$ | $CH_3$ | H | H | H | $C_2H_5O$ | $C_2H_5O$ | $CH_3$ | $CH_3$ |
| A-22 | H | $CH_3O$ | $CH_3O$ | $C_2H_5$ | $CH_3$ | H | $CH_3$ | H | $CH_3O$ | $CH_3O$ | $CH_3$ | $C_2H_5$ |
| A-23 | H | $C_7H_{15}COO$ | $C_7H_{15}COO$ | $CH_3$ | $CH_3$ | H | H | H | $C_7H_{15}COO$ | $C_7H_{15}COO$ | $CH_3$ | $CH_3$ |
| A-24 | H | $C_4H_9O$ | $C_4H_9O$ | $CH_3$ | $CH_3$ | H | H | H | $C_4H_9O$ | $C_4H_9O$ | $CH_3$ | $CH_3$ |
| A-25 | H | $CH_3O(CH_2)_2O$ | $CH_3O(CH_2)_2O$ | $CH_3$ | $CH_3$ | H | H | H | $CH_3O(CH_2)_2O$ | $CH_3O(CH_2)_2O$ | $CH_3$ | $CH_3$ |
| A-26 | H | $CH_2{=}CHCH_2O$ | $CH_2{=}CHCH_2O$ | $CH_3$ | $CH_3$ | H | H | H | $CH_2{=}CHCH_2O$ | $CH_2{=}CHCH_2O$ | $CH_3$ | $CH_3$ |
| A-27 | H | $C_3H_7O$ | $C_3H_7O$ | $C_6H_5CH_2$ | $CH_3$ | $C_6H_5$ | H | H | $C_3H_7O$ | $C_3H_7O$ | $C_6H_5O$ | $CH_3$ |
| A-28 | $CH_3O$ | $C_4H_9O$ | $C_4H_9O$ | $CH_3$ | $CH_3$ | H | H | $CH_3$ | $C_4H_9O$ | $C_4H_9O$ | $CH_3$ | $CH_3$ |
| A-29 | H | $(s)C_5H_{11}O$ | $(s)C_5H_{11}O$ | $CH_3$ | $CH_3$ | H | H | H | $(s)C_5H_{11}O$ | $(s)C_5H_{11}O$ | $CH_3$ | $CH_3$ |
| A-30 | H | $C_4H_9O$ | $C_4H_9O$ | $(i)C_3H_7$ | $CH_3$ | $CH_3$ | $CH_3$ | H | $C_4H_9O$ | $C_4H_9O$ | $(i)C_3H_7$ | $CH_3$ |
| A-31 | H | $C_{18}H_{37}O$ | $C_{18}H_{37}O$ | $CH_3$ | $CH_3$ | H | H | H | $C_{18}H_{37}O$ | $C_{18}H_{37}O$ | $CH_3$ | $CH_3$ |
| A-32 | H | $C_6H_5CH_2O$ | $C_6H_5CH_2O$ | $CH_3$ | $CH_3$ | H | H | H | $C_6H_5CH_2O$ | $C_6H_5CH_2O$ | $CH_3$ | $CH_3$ |

A-7

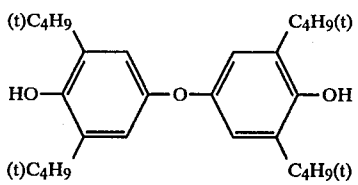

Formula [B]:

-continued
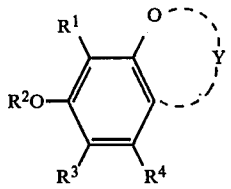

wherein $R_1$ and $R_4$ represent hydrogen, a halogen, an alkyl, alkenyl, alkoxy, alkenyloxy, hydroxy, aryl, aryloxy, acyl, acylamino, acyloxy, sufonamide, cycloalkyl or alkoxycarbon group, $R_2$ represents hydrogen, an alkyl, alkenyl, aryl, acyl, cycloalkyl or heterocyclic group; and $R_3$ represents hydrogen, a halogen, an alkyl, alkenyl, aryl, aryloxy, acyl, acyloxy, sulfonamido, cycloalkyl or alkoxycarbonyl group.

The above-given groups may be substituted by the other substituents, respectively. They include, for example, an alkyl, alkenyl, alkoxy, aryl, aryloxy, hydroxy, alkoxycarbonyl, aryloxycarbonyl, acylamino, acyloxy, carbamoyl, sulfonamido, and sulfamoyl groups or the like.

Further, $R_2$ and $R_3$ may close the ring by each other to form a 5- or 6-membered ring. The rings formed together with the benzene ring closed by $R_2$ and $R_3$ include, for example, a chroman ring and a methylenedioxybenzene ring.

Y represents a group of atoms necessary for forming a chroman or couraman ring.

Such chroman or couraman ring may be substituted by a halogen, an alkyl, cycloalkyl, alkoxy, alkenyl, alkenyloxy, hydroxy, aryl or aryloxy group or a heterocyclic ring; and may further form a spiro ring.

Among the compounds represented by Formula [B], the compounds particularly useful in the invention include those represented by Formulas [B-1], [B-2], [B-3], [B-4] and [B-5].

Formula [B-1]:

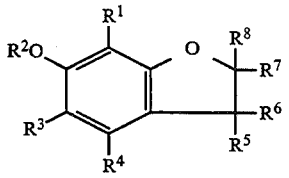

Formula [B-2]:

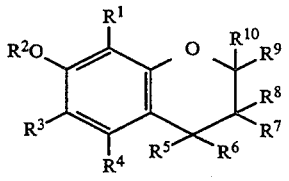

Formula [B-3]:

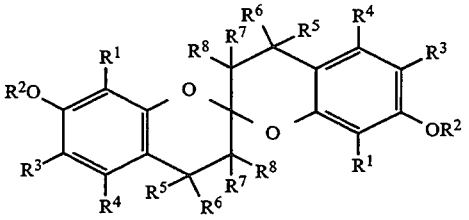

-continued

Formula [B-4]:

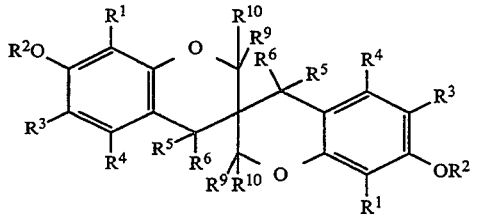

Formula [B-5]:

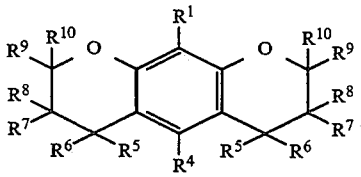

In the above Formula [B-1] through [B-5] $R_1$, $R_2$, $R_3$ and $R_4$ are synonymous with those denoted on the aforegiven Formula [B]; and $R_5$, $R_6$, $R_7$, $R_8$, $R_9$ and $R_{10}$ represent hydrogen, a halogen, an alkyl, alkoxy, hydroxy, alkenyl, alkenyloxy, aryl, aryloxy or heterocyclic group.

Further, $R_5$ and $R_6$, $R_6$ and $R_7$, $R_7$ and $R_8$, $R_8$ and $R_9$, and $R_9$ and $R_{10}$ may be cyclized to form the respective carbon rings and the carbon rings may also be substituted by alkyl groups, respectively.

In the aforegiven Formulas [B-1] through [B-5], the particularly useful compounds are those in which $R_1$ and $R_4$ are hydrogen, an alkyl, hydroxy or cycloalkyl group and $R_5$, $R_6$, $R_7$, $R_8$, $R_9$ and $R_{10}$ are hydrogen, an alkyl or cycloalkyl group, respectively.

The compounds represented by the Formula [B] represent and include the compounds described in 'Tetrahedron', 1970, vol. 126, pp. 4743~4751; 'Journal of The Chemical Society of Japan', 1972, No. 10, pp. 0987~1990; 'Chemical Letter', 1972, No. 4, pp. 315~316; and Japanese Patent O.P.I. Publication No. 139383/1980; and those compounds maybe synthesized in the processes described therein.

The amount of compounds represented by the Formula [B] to be used is preferably from 5 to 300 mol % and, more preferably, from 10 to 200 mol %, to the magenta couplers relating to the invention.

The typical examples of the above-mentioned compounds will be given below:

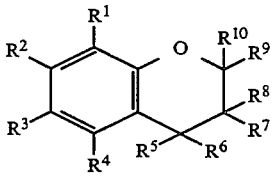

-continued

| Compound No. | $R^1$ | $R^2$ | $R^3$ | $R^4$ | $R^5$ | $R^6$ | $R^7$ | $R^8$ | $R^9$ | $R^{10}$ |
|---|---|---|---|---|---|---|---|---|---|---|
| B-1 | H | H | H | H | H | $CH_3$ | H | H | $CH_3$ | $CH_3$ |
| B-2 | H | H | $CH_3$ | H | H | $CH_3$ | H | H | $CH_3$ | $CH_3$ |
| B-3 | H | H | $C_{12}H_{25}$ | H | H | $CH_3$ | H | H | $CH_3$ | $CH_3$ |
| B-4 | H | H | 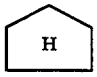 | H | H | $CH_3$ | H | H | $CH_3$ | $CH_3$ |
| B-5 | H | $CH_3$ | H | H | H | $CH_3$ | H | H | $CH_3$ | $CH_3$ |
| B-9 | $CH_3$ | H | $CH_3$ | H | H | H | H | 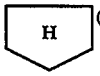 (Condensation) | | H |
| B-10 | H | $CH_3CO$ | H | H | H | (i)$C_3H_7$ | H | H | $CH_3$ | $CH_3$ |
| B-11 | H | $C_3H_7$ | (t)$C_8H_{17}$ | H | H | $CH_3$ | H | $CH_3$ | $CH_3$ | $CH_3$ |
| B-12 | Br | H | Br | H | H | H | H | $CH_3$ | $CH_3$ | $CH_3$ |
| B-13 | H | 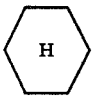 | H | H | $CH_3$ | $CH_3$ | H | H | $CH_2OH$ | $CH_3$ |
| B-14 | H | 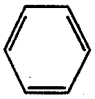 | H | H | $CH_3$ | $CH_3$ | H | H | $CH_3$ | $CH_3$ |
| B-15 | H | H | $CH_2{=}CHCH_2CO$ | | $CH_3$ | $CH_3$ | H | H | 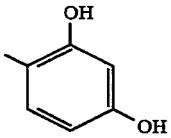 | $CH_3$ |
| B-16 | H | H | H | $CH_3SO_2NH$ | $CH_3$ | $CH_3$ | H | H | 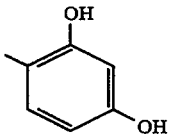 | $CH_3$ |
| B-17 | H | 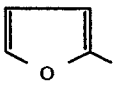 | $CH_3$ | H | Cl | H | Cl | H | $CH_3$ | $CH_3$ |
| B-18 | H | 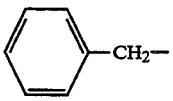 | $CH_3CONH$ | H | H | H | H | H | 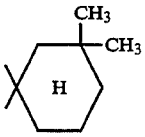 (Spiro) | |
| B-54 | $CH_3O$ | $CH_3O$ | H | H | H | H | H | H | $CH_3$ | $CH_3$ |
| B-55 | H | 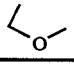 (methylenedioxy) | | H | H | H | H | H | $CH_3$ | $CH_3$ |

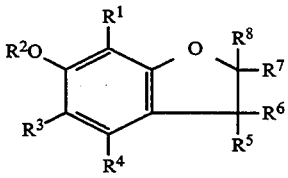

| Compound No. | $R^1$ | $R^2$ | $R^3$ | $R^4$ | $R^5$ | $R^6$ | $R^7$ | $R^8$ |
|---|---|---|---|---|---|---|---|---|

-continued

| | | | | | | | | |
|---|---|---|---|---|---|---|---|---|
| B-6 | H | H | H | H | H | 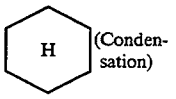 (Condensation) | | H |
| B-7 | H | H | (i)$C_3H_7$ | H | H | H | $CH_3$ | $CH_3$ |
| B-8 | H | $CH_3$ | Cl | H | H | H | $CH_3$ | $CH_3$ |
| B-19 | H | H | 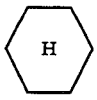 | H | $CH_3$ | $CH_3$ | $CH_3$ | $CH_3$ |
| B-20 | H | $CH_2{=}CHCH_2$ | $CH_3$ | H | $CH_3$ | $CH_3$ | $CH_3$ | H |
| B-21 | H | $C_3H_7$ | $C_3H_7$ | H | $CH_3$ | $CH_3$ | 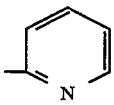 | H |
| B-22 | $CH_3$ | H | $CH_3$ | H | 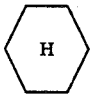 | | H | H |
| B-23 | $CH_3$ | H | 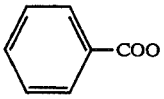 | H | $CH_3$ | $CH_3$ | $CH_3$ | $CH_3$ |

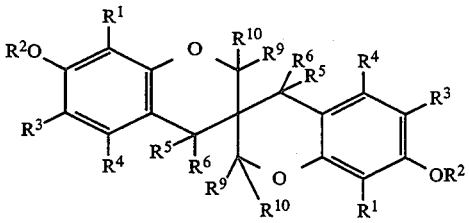

| Compound No. | $R^1$ | $R^2$ | $R^3$ | $R^4$ | $R^5$ | $R^6$ | $R^9$ | $R^{10}$ |
|---|---|---|---|---|---|---|---|---|
| B-24 | H | H | H | H | $CH_3$ | $CH_3$ | H | H |
| B-25 | H | H | $CH_3$ | H | $CH_3$ | $CH_3$ | H | H |
| B-26 | H | H | (t)$C_4H_9$ | H | H | H | H | H |
| B-27 | H | $CH_3$ | H | H | $CH_3$ | $CH_3$ | H | H |
| B-28 | H | H | 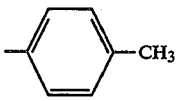 | H | $CH_3$ | $CH_3$ | H | H |
| B-29 | H | H | $C_2H_5COOCH_2$ | H | $CH_3$ | $CH_3$ | H | H |
| B-30 | $CH_3$ | 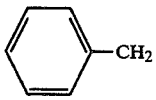 | H | $CH_3$ | $CH_3$ | $CH_3$ | H | H |
| B-31 | Cl | H | H | H | 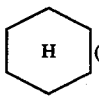 (Spiro) | | H | H |
| B-32 | H | H | $CH_3CONH$ | H | $CH_3$ | $CH_3$ | H | H |
| B-33 | $CH_3$ | 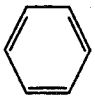 | (t)$C_8H_{17}$ | H | $CH_3$ | $CH_3$ | H | H |

-continued

| | | | | | | | | |
|---|---|---|---|---|---|---|---|---|
| B-34 | H | H | 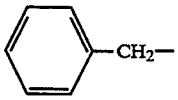 | H | $CH_3$ | $CH_3$ | H | H |

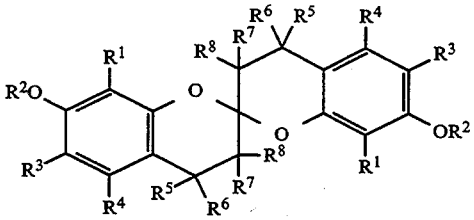

| Compound No. | $R^1$ | $R^2$ | $R^3$ | $R^4$ | $R^5$ | $R^6$ | $R^7$ | $R^8$ |
|---|---|---|---|---|---|---|---|---|
| B-35 | H | H | H | H | $CH_3$ | $CH_3$ | H | H |
| B-36 | H | $C_3H_7$ | H | H | $CH_3$ | $CH_3$ | H | H |
| B-37 | H | $CH_3$ | $CH_3$ | H | $CH_3$ | $CH_3$ | H | H |
| B-38 | H | H | (t)$C_4H_9$ | H | $CH_3$ | $CH_3$ | H | H |
| B-39 | H | H | 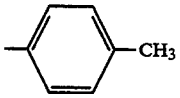 | H | $CH_3$ | $CH_3$ | H | H |
| B-40 | H | H | $CH_3SO_2NH$ | H | H | H | H | H |
| B-41 | $CH_3$ | 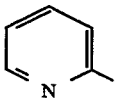 | H | $CH_3$ | $CH_3$ | $CH_3$ | H | H |
| B-42 | Cl | (t)$C_4H_9$ | H | H | 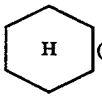 (Spiro) | | H | H |
| B-43 | H | $C_{12}H_{25}$ | $CH_3CONH$ | H | $CH_3$ | $CH_3$ | H | H |
| B-44 | H | H | (t)$C_8H_{17}$ | H | $CH_3$ | $CH_3$ | H | H |
| B-45 | H | H | 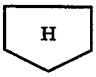 | H | $CH_3$ | $CH_3$ | H | H |

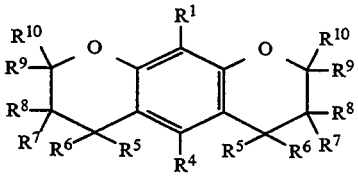

| Compound No. | $R^1$ | $R^4$ | $R^5$ | $R^6$ | $R^7$ | $R^8$ | $R^9$ | $R^{10}$ |
|---|---|---|---|---|---|---|---|---|
| B-46 | H | H | H | H | H | H | $CH_3$ | $CH_3$ |
| B-47 | OH | H | H | H | H | H | $CH_3$ | $CH_3$ |
| B-48 | H | H | H | H | H | H | $CH_3$ | $C_2H_5$ |
| B-49 | H | H | H | H | H | H | 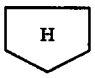 (Spiro) | |
| B-50 | $C_3H_7O$ | H | $CH_3$ | H | H | H | $CH_3$ | $CH_3$ |
| B-51 | H | H | H | H | $C_3H_7$ | H | $C_3H_7$ | H |
| B-52 | H | OH | H | H | H | H | $CH_3$ | $CH_3$ |
| B-53 | H | $C_3H_7O$ | H | H | H | H | $CH_3$ | $CH_3$ |

Formula [C]:

-continued

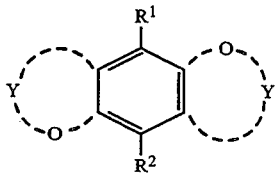

Formula [D]:

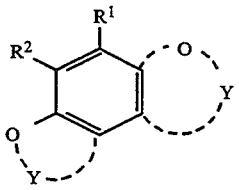

wherein $R_1$ and $R_2$ represent hydrogen, a halogen, an alkyl, alkenyl, alkoxy, alkenyloxy, hydroxy, aryl, aryloxy, acyl, acylamino, acyloxy, sulfonamido or alkoxycarbonyl group.

The above-given groups may be substituted by the other substituents, respectively. They include, for example, a halogen, an alkyl, alkenyl, alkoxy, aryloxy, hydroxy, alkoxycarbonyl, aryloxycarbonyl, acylamino, carbamoyl, sulfonamido and sulfamoyl groups and the like.

Y represents a group of atoms necessary for forming a dichroman or dicoumaran ring together with a benzene ring.

Such a chroman or coumaran ring may be substituted by a halogen, an alkyl, cycloalkyl, alkoxy, alkenyl, alkenyloxy, hydroxyl, aryl, aryloxy or heterocyclic group; and may also form a spiro ring.

Among the compounds represented by the Formulas [C] and [D], those particularly useful in the invention include, for example, the compounds represented by the following Formulas [C-1], [C-2], [D-1] and [D-2]:

Formula [C-1]:

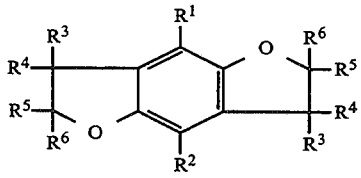

Formula [C-2]:

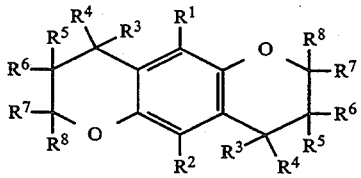

Formula [D-1]:

-continued

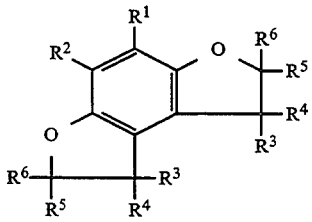

Formula [D-2]:

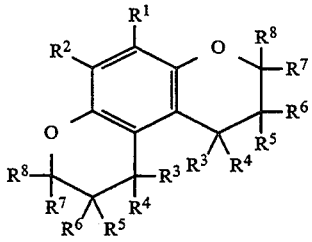

In the above-given Formulas [C-1], [C-2], [D-1] and [D-2], $R_1$ and $R_2$ are synonymous with those denoted in the aforegiven Formulas [C] and [D]; and $R_3$; $R_4$, $R_5$, $R_6$, $R_7$ and $R_8$ represent hydrogen, a halogen, an alkyl, alkoxy, hydroxy, alkenyl, alkenyloxy, aryl, aryloxy or heterocyclic group. Further, $R_3$ and $R_4$, $R_4$ and $R_5$, $R_5$ and $R_6$, $R_6$ and $R_7$ and $R_7$ and $R_8$ may be cyclized each other to form a carbon ring; and still further, such a carbon ring may also be substituted by an alkyl group.

In the above-given Formulas [C-1], [C-2], [D-1] and [D-2], the particularly useful compounds are those in which $R_1$ and $R_2$ represent hydrogen, an alkyl, alkoxy, hydroxy or cycloalkyl group, and $R_3$, $R_4$, $R_5$, $R_6$, $R_7$ and $R_8$ represent hydrogen, an alkyl or cycloalkyl group.

The compounds represented by the Formulas [C] and [D] include those described in 'Journal of The Chemical Society of Japan', Part C, 1968, (14), pp. 1939~18; 'Journal of The Society of Synthesis Organic Chemistry, Japan', 1970, 28(1), pp. 60~65; and 'Tetrahedron Letters', 1973, (29), pp. 2707~2710; and they may be synthesized in the processes described therein.

An amount of the compounds represented by the aforegiven Formulas [C] to be used is preferably from 5 to 300 mol % and, more preferably, from 10 to 200 mol %, to the magenta couplers used in the invention.

The typical examples of the above-mentioned compounds will be given below:

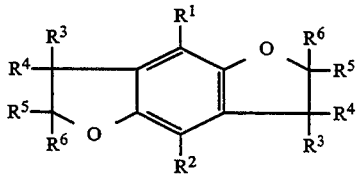

| Compound No. | $R^1$ | $R^2$ | $R^3$ | $R^4$ | $R^5$ | $R^6$ |
|---|---|---|---|---|---|---|
| C-11 | H | H | H | H | $CH_3$ | $CH_3$ |
| C-12 | H | H | H | H | 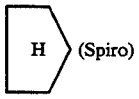 (Spiro) | |
| C-13 | H | H | H | 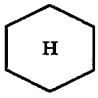 (Condensation) | | H |

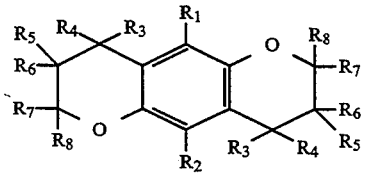

| Compound No. | $R_1$ | $R_2$ | $R_3$ | $R_4$ | $R_5$ | $R_6$ | $R_7$ | $R_8$ |
|---|---|---|---|---|---|---|---|---|
| C-1 | H | H | H | H | H | H | H | H |
| C-2 | H | H | H | H | H | H | $CH_3$ | $CH_3$ |
| C-3 | H | H | $CH_3$ | H | H | H | $CH_3$ | $CH_3$ |
| C-4 | $CH_3$ | H | $CH_3$ | $CH_3$ | H | H | $CH_3$ | $CH_3$ |
| C-5 | OH | H | H | H | H | H | $C_2H_5$ | $CH_3$ |
| C-6 | $OCH_3$ | H | H | H | H | H | H | H |
| C-7 | $OC_3H_7$ | H | H | H | H | H | H | H |
| C-8 | $OC_{12}H_{25}$ | H | H | H | H | H | H | H |
| C-9 | $CH_3COO$ | H | H | H | H | H | $CH_3$ | $CH_3$ |
| C-10 | $CH_3CONH$ | H | H | H | H | H | 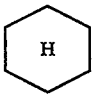 (Spiro) | |
| C-14 | $(CH_3)_2\underset{\underset{Cl}{\vert}}{C}CHCH_2$ | $(CH_3)_2\underset{\underset{Cl}{\vert}}{C}CH_2CH_2$ | H | H | H | H | $CH_3$ | $CH_3$ |
| C-15 | $CH_3$ | $CH_3$ | H | H | H | H | $CH_3$ | $CH_3$ |
| C-16 | $(CH_3)_2C{=}CHCH_2$ | $(CH_3)_2C{=}CCH_2$ | H | H | H | H | $CH_3$ | $CH_3$ |
| C-17 | Cl | H | H | H | H | H | H | H |

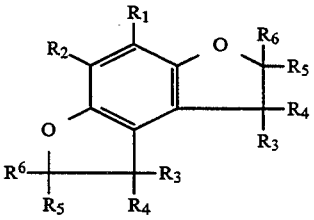

| Compound No. | $R_1$ | $R_2$ | $R_3$ | $R_4$ | $R_5$ | $R_6$ |
|---|---|---|---|---|---|---|
| D-1 | $CH_3$ | $CH_3$ | H | H | H | H |
| D-2 | H | H | H | H | $CH_3$ | $CH_3$ |

-continued

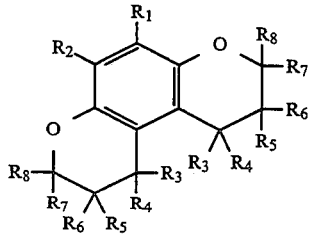

| Compound No. | $R_1$ | $R_2$ | $R_3$ | $R_4$ | $R_5$ | $R_6$ | $R_7$ | $R_8$ |
|---|---|---|---|---|---|---|---|---|
| D-3 | H | H | H | H | H | H | H | H |
| D-4 | H | H | H | H | H | H | $CH_3$ | $CH_3$ |
| D-5 | $CH_3$ | $CH_3$ | H | H | H | H | $CH_3$ | $CH_3$ |
| D-6 | $(CH_3)_2CCH_2CH_2$ (Cl) | $(CH_3)_2CCH_2CH_2$ (Cl) | H | H | H | H | $CH_3$ | $CH_3$ |
| D-7 | H | H | Cl | H | Cl | H | H | H |
| D-8 | H | H | H | H | H | H | 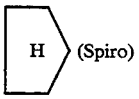 (Spiro) | |
| D-9 | $CH_3O$ | H | H | H | H | H | 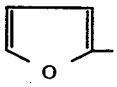 | H |
| D-10 | H | H | H | H | H | H | $CH_2OH$ | $CH_3$ |
| D-11 | 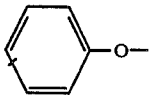 | H | H | H | H | H | $CH_3$ | $CH_3$ |

Formula [E]:

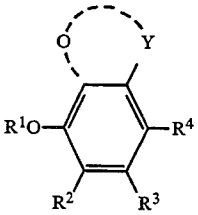

wherein $R^1$ represents hydrogen, an alkyl, alkenyl, aryl, acyl, cycloalkyl or heterocyclic group; and $R^3$ represents hydrogen, a halogen, an alkyl, alkenyl, aryl, aryloxy, acyl, acylamino, acyloxy, sulfonamido, cycloalkyl or alkoxycarbonyl group.

$R^2$ and $R^4$ represent hydrogen, a halogen, an alkyl, alkenyl, aryl, acyl, acylamino, sulfonamido, cycloalkyl or alkoxycarbonyl group.

The above-mentioned groups may be substituted by the other substituents, respectively. They include, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

Further, $R^1$ and $R^2$ may close a ring each to form a 5- or 6-membered ring, provided that, in this case, $R^3$ and $R^4$ represent hydrogen, a halogen, an alkyl, alkenyl, alkoxy, alkenyloxy, hydroxy, aryl, aryloxy, acyl, acyloxy, sulfonamido or alkoxycarbonyl group.

Y represents a group of atoms necessary for forming a chroman or coumaran ring.

Such a chroman or coumaran ring may be substituted by a halogen, an alkyl, cycloalkyl, alkoxy, alkenyl, alkenyloxy, hydroxy, aryl, aryloxy or heterocyclic group; and may further form a spiro ring.

Among the compounds represented by the Formula [E] include, for example, those represented by the following Formulas [E-1], [E-2], [E-3], [E-5], Formula [E-1]:

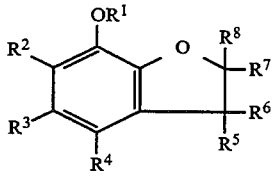

Formula [E-2]:

-continued

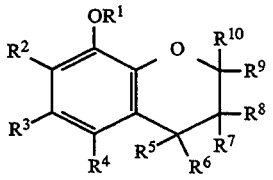

Formula [E-3]:

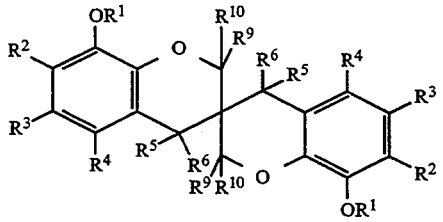

Formula [E-4]:

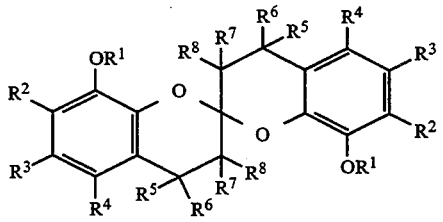

Formula [E-5]:

-continued

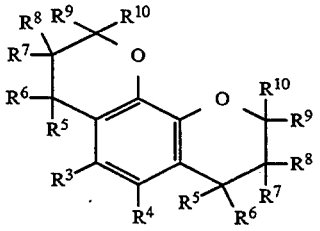

In the above-given Formulas [E-1] through [E-5], $R^1$, $R^2$, $R^3$ and $R^4$ are synonymous with those denoted in the aforgiven Formula [E]; and $R^5$, $R^6$, $R^7$, $R^8$, $R^9$ and $R^{10}$ represent hydrogen, a halogen, an alkyl, alkoxy, hydroxy, alkenyl, alkenyloxy, aryl, aryloxy or heterocyclic group. Further, $R^5$ and $R^6$, $R^6$ and $R^7$, $R^7$ and $R^8$, $R^8$ and $R^9$, and $R^9$ and $R^{10}$ may be cyclized each other to form a carbon ring; and still further, the carbon ring may also be substituted by an alkyl group.

The compounds particularly useful include those in which $R^1$, $R^2$, $R^2$, $R^3$ and $R^4$ represent hydrogen, an alkyl or cycloalkyl group in the Formulas [E-1] through [E-5]; $R^3$ and $R^4$ represent hydrogen, an alkyl, alkoxy, hydroxy or cycloalkyl group in the Formula [E-5]; and $R^5$, $R^6$, $R^7$, $R^8$, $R^9$ and $R^{10}$ represent hydrogen, an alkyl or cycloalkyl group in the Formulas [E-1] through [E-5].

The compounds represented by the Formula [E] include those described in 'Tetrahedron Letters', 1965, (8), pp. 457~460; 'Journal of The Chemical Society of Japan', Part C, 1966, (22), pp. 20—~2016; and 'Zh. Org. Khim.', 1870, (6), pp. 1230~1237; and they may be synthesized in the processes described therein.

An amount of the compounds represented by the Formula [E-1] to be used is preferably from 5 to 300 mol % and more preferably from 10 to 200 mol %, to the magnet couplers relating to the invention.

The typical examples of the above-mentioned compounds will be given below:

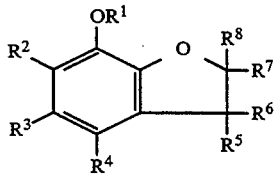

| Compound No | $R_1$ | $R_2$ | $R_3$ | $R_4$ | $R_5$ | $R_6$ | $R_7$ | $R_8$ |
|---|---|---|---|---|---|---|---|---|
| E-19 | H | H | H | H | H | | | H |
| | | | | | | 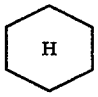 (Condensation) | | |
| E-20 | $C_3H_7$ | H | H | H | H | | | H |
| | | | | | | 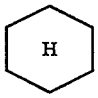 (Condensation) | | |
| E-21 | H | H | H | H | H | H | | |
| | | | | | | | 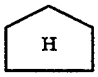 (Spiro) | |

-continued

| | | | | | | | | |
|---|---|---|---|---|---|---|---|---|
| E-22 | $CH_3$ | H | H | H | H | H | 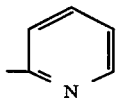 | H |
| E-23 | H | H | H | H | H | H | $CH_3$ | $CH_3$ |
| E-24 | $CH_3$ | H | 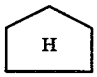 | H | H | H | $CH_3$ | $CH_3$ |
| E-25 | 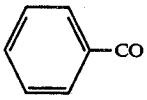 | H | H | H | H | H | $CH_3$ | $CH_3$ |
| E-26 | $C_{12}H_{25}$ | H | H | H | $CH_3$ | $CH_3$ | $CH_3$ | $CH_2OH$ |

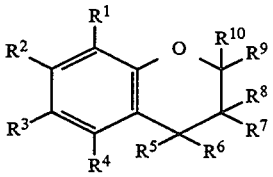

| Compound No | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| E-1 | H | H | H | H | H | H | H | H | H | H |
| E-2 | H | H | H | H | H | H | H | H | $CH_3$ | $CH_3$ |
| E-3 | H | H | H | H | $CH_3$ | H | H | H | $CH_3$ | $CH_3$ |
| E-4 | H | H | $CH_2{=}CHCH_2$ | H | H | H | H | H | $CH_3$ | $CH_3$ |
| E-5 | $CH_3$ | H | H | H | H | H | H | H | $CH_3$ | $CH_3$ |
| E-6 | $C_3H_7$ | H | H | H | H | H | H | H | $CH_3$ | $CH_3$ |
| E-7 | $C_{12}H_{25}$ | H | H | H | $CH_3$ | H | H | H | $CH_3$ | $CH_3$ |
| E-8 | 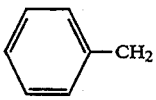 | H | H | H | H | H | H | H | H | H |
| E-9 | 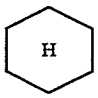 | H | H | H | H | H | H | H | $CH_3$ | $CH_3$ |
| E-10 | 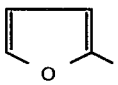 | H | H | H | H | H | H | H | $CH_3$ | $CH_3$ |
| E-11 | H | H | H | H | H | H | H | H | $CH_3$ | $C_{16}H_{33}$ |
| E-12 | H | H | 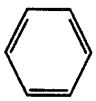 | H | H | H | H | H | $CH_3$ | $CH_3$ |
| E-13 | $CH_3$ | H | $CH_3CO$ | H | H | H | H | H | $CH_3$ | $CH_3$ |
| E-14 | $CH_3$ | H | H | H | H | Br | Br | H | H | H |
| E-15 | $CH_3$ | H | H | H | H | Cl | Cl | H | H | H |
| E-16 | $CH_3$ | H | H | H | H | $CH_3O$ | Br | H | H | H |
| E-17 | $CH_3$ | H | H | H | H | OH | Br | H | $CH_3$ | $CH_3$ |
| E-18 | $CH_3$ | H | H | H | H | $C_2H_5O$ | OH | H | $CH_3$ | $CH_3$ |

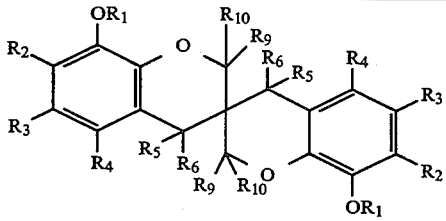

-continued

| Compound No | $R_1$ | $R_2$ | $R_3$ | $R_4$ | $R_5$ | $R_6$ | $R_9$ | $R_{10}$ |
|---|---|---|---|---|---|---|---|---|
| E-27 | H | H | H | H | H | H | H | H |
| E-28 | $CH_3$ | H | H | H | H | H | H | H |
| E-29 | 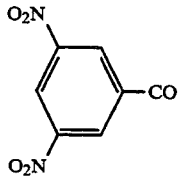 | H | H | H | H | H | H | H |
| E-30 | H | H | $CH_3$ | H | H | H | $CH_3$ | $CH_3$ |
| E-31 | $C_3H_7$ | H | H | H | H | H | H | H |
| E-32 | $C_3H_7$ | H | H | H | $CH_3$ | $CH_3$ | H | H |
| E-37 | H | H | H | $CH_3CONH$ | H | H | H | H |
| E-38 | CO | H | H | H | H | H | H | H |

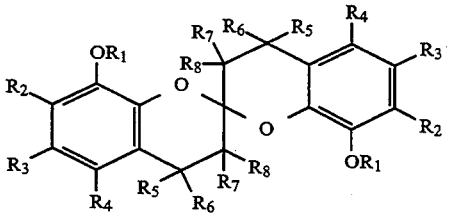

| Compound No | $R_1$ | $R_2$ | $R_3$ | $R_4$ | $R_5$ | $R_6$ | $R_7$ | $R_8$ |
|---|---|---|---|---|---|---|---|---|
| E-33 | H | H | H | H | H | H | H | H |
| E-34 | H | H | H | H | $CH_3$ | $CH_3$ | H | H |
| E-35 | $C_{12}H_{25}$ | H | H | H | $CH_3$ | $CH_3$ | H | H |
| E-36 | $CH_3$ | H | $CH_3$ | H | $CH_3$ | $CH_3$ | H | H |

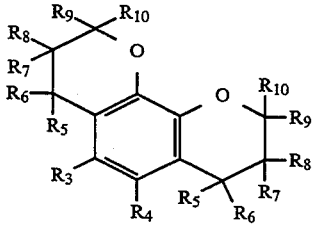

| Compound No | $R_3$ | $R_4$ | $R_5$ | $R_6$ | $R_7$ | $R_8$ | $R_9$ | $R_{10}$ |
|---|---|---|---|---|---|---|---|---|
| E-39 | H | H | H | H | H | H | H | H |
| E-40 | H | H | H | H | H | H | $CH_3$ | $CH_3$ |
| E-41 | OH | H | H | H | H | H | $CH_3$ | $CH_3$ |
| E-42 | $C_3H_7O$ | H | $CH_3$ | $CH_3$ | H | H | H | H |

Formula [F]:

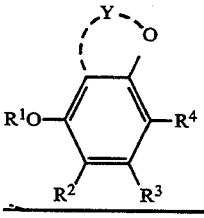

wherein $R^1$ represents hydrogen, an alkyl, alkenyl, aryl, acyl, cycloalkyl or heterocyclic group; $R^2$ represents hydrogen, a halogen, an alkyl, alkenyl, aryl, aryloxy, acyl, acylamino, acyloxy, sulfonamido, cycloalkyl or alkoxycarbonyl group; $R^3$ represents hydrogen, a halogen, an alkyl, alkenyl, aryl, acyl, acylamino, sulfonamido, cycloalkyl or alkoxycarbonyl group; and $R^4$ represents hydrogen, a halogen, an alkyl, alkenyl, alkoxy, alkenyloxy, hydroxy, aryl, aryloxy, acyl, acylamino, acyloxy, sulfonamido or alkoxycarbonyl group.

The above-mentioned groups may be substituted by the other substituents, respectively. The include, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

Further, $R^1$ and $R^2$ may close a ring with each other to form a 5- and 6-membered ring, provided that, in this case, $R^3$ and $R^4$ represent hydrogen, a halogen, an alkyl, alkenyl, alkoxy, alkenyloxy, hydroxy, aryl, aryloxy, acyl, acylamino, acyloxy, sulfonamido or alkoxycarbonyl group.

Y represents a group of atoms necessary for forming a chroman or coumaran ring.

Such a chroman or coumaran ring may be substituted by a halogen, an alkyl, cycloalkyl, alkoxy, alkenyl, alkenyloxy, hydroxy, aryl, aryloxy or heterocyclic group; and may further form a spiro ring.

Among the compounds represented by the Formula [F], the compounds particularly preferably in the invention include those represented by the following Formulas [F-1], [F-2], [F-3], [F-4] and [F-5];

Formula [F-1]:

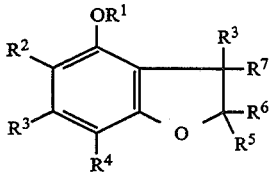

Formula [F-2]:

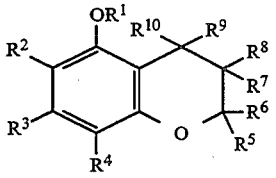

Formula [F-3]:

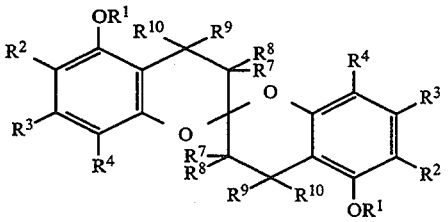

Formula [F-4]:

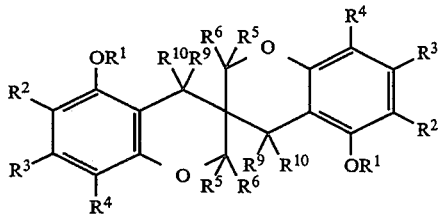

-continued

Formula [F-5]:

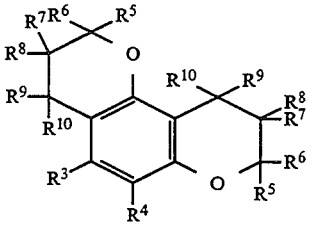

In the above-given Formulas [F-1] through [F-5], $R^1$, $R^2$, $R^3$ and $R^4$ are synonymous with those denoted in the Formula [F]; and $R^5$, $R^6$, $R^7$, $R^8$, $R^9$ and $R^{10}$ represent hydrogen, a halogen, an alkyl, alkoxy, hydroxy, alkenyl, alkenyloxy, aryl, aryloxy or heterocyclic group.

Further, $R^5$ and $R^6$, $R^6$ and $R^7$, $R^7$ and $R^8$, $R^8$ and $R^9$, and $R^9$ and $R^{10}$ may be cyclized each other to form a carbon ring; and the carbon ring may also be substituted by an alkyl group.

Still further, in the above-given Formulas [F-3], [F-4] and [F-5], two each of from $R^1$ through $R^{10}$ may be the same or different from each other.

In the Formulas [F-1]through [F-5], the particularly preferably compounds are those in which $R^1$, $R^2$ and $R^3$ represent hydrogen, an alkyl or cycloalkyl group; $R^4$ represent hydrogen, an alkyl, alkoxy, hydroxy or cycloalkyl group, and $R^5$, $R^6$, $R^7$, $R^8$, $R^9$ and $R^{10}$ represent hydrogen, an alkyl or cycloalkyl group.

The compounds represented by the Formula [F] include those described in 'Tetrahedron Letters', 1970, vol. 26, pp. 4743~4751; 'Journal of The Chemical Society of Japan', 1972, No. 10, pp. 1987~1990; 'Synthesis', 1975, vol. 6, pp. 392~393; and 'Bul. Soc. Chem. Belg.', 1975, vol. 84(7), pp. 747~759; and they may be synthesized in the processes described therein.

An amount of the compounds represented by the Formula [F] to be used is preferably from 5 to 300 mol %, more preferably, from 10 to 200 mol %, to the magenta couplers relating to the invention.

The typical examples of the compounds represented by the Formula [F] will be given below:

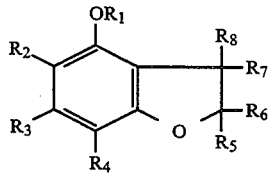

| Compound No | $R_1$ | $R_2$ | $R_3$ | $R_4$ | $R_5$ | $R_6$ | $R_7$ | $R_8$ |
|---|---|---|---|---|---|---|---|---|
| F-11 | H | H | H | H | H | 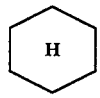 (Condensation) | | H |

-continued

| | | | | | | | | |
|---|---|---|---|---|---|---|---|---|
| F-12 | $C_3H_7$ | H | H | H | H | 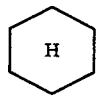 (Condensation) | | H |
| F-13 | H | H | H | H | H | H | H | H |
| F-14 | H | H | H | H | H | H | $CH_3$ | H |
| F-15 | H | H | $CH_3$ | H | H | H | $CH_3$ | H |
| F-16 | H | H | 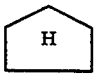 | H | H | H | $CH_3$ | H |
| F-17 | H | H | 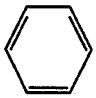 | H | H | H | $CH_3$ | H |
| F-18 | $C_3H_7$ | H | $CH_3$ | H | H | H | $CH_3$ | H |
| F-19 | 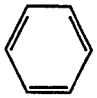 | H | H | H | 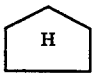 (Spiro) | | H | H |
| F-24 | $CH_2{=}CHCH_2$ | $CH_3$ | $CH_3$ | H | H | $C_2H_5O$ | $CH_3$ | $CH_3$ |
| F-25 | $C_3H_7$ | H | H | H | H | 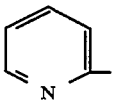 | $CH_3$ | $CH_3$ |
| F-26 | H | $CH_3$ | $CH_3$ | H | H | H | 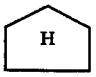 (Spiro) | |

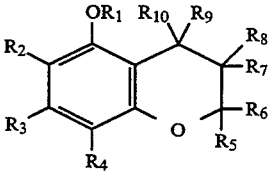

| Compound No | $R_1$ | $R_2$ | $R_3$ | $R_4$ | $R_5$ | $R_6$ | $R_7$ | $R_8$ | $R_9$ | $R_{10}$ |
|---|---|---|---|---|---|---|---|---|---|---|
| F-1 | H | H | H | H | H | H | H | H | H | H |
| F-2 | H | H | H | H | $CH_3$ | $CH_3$ | H | H | $CH_3$ | H |
| F-3 | H | H | H | H | $CH_3$ | $CH_3$ | H | H | H | H |
| F-4 | H | $(CH_3)_2C{=}CCHCH_2$ | H | H | $CH_3$ | $CH_3$ | H | H | H | H |
| F-5 | $CH_3$ | H | H | H | $CH_3$ | $CH_3$ | H | H | H | H |
| F-6 | $C_3H_7$ | H | H | H | $CH_3$ | $CH_3$ | H | H | H | H |
| F-7 | $C_{12}H_{25}$ | H | H | H | $CH_3$ | $CH_3$ | H | H | H | H |
| F-8 | 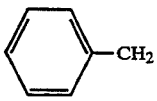 | H | H | H | $CH_3$ | $CH_3$ | H | H | H | H |
| F-9 | 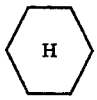 | H | H | H | $CH_3$ | $CH_3$ | H | H | H | H |
| F-10 | 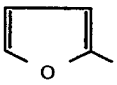 | H | H | H | $CH_3$ | $CH_3$ | H | H | H | H |

-continued

| | | | | | | | | | | |
|---|---|---|---|---|---|---|---|---|---|---|
| F-20 | H | Cl | H | H | H | 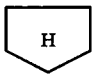 (Condensation) | | H | H | H |
| F-21 | H | H | H | H | $CH_3$ | $CH_2OH$ | H | H | $CH_3$ | $CH_3$ |
| F-22 | $C_3H_7$ | $(t)C_8H_{17}$ | H | H | $C_2H_5$ | $CH_3$ | H | H | H | H |
| F-23 | $CH_3CO$ | H | H | H | $CH_3$ | $CH_3$ | H | H | $CH_3$ | H |

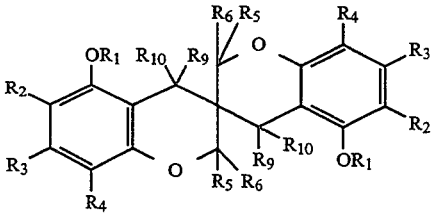

| Compound No | $R_1$ | $R_2$ | $R_3$ | $R_4$ | $R_5$ | $R_6$ | $R_9$ | $R_{10}$ |
|---|---|---|---|---|---|---|---|---|
| F-27 | H | H | H | H | H | H | $CH_3$ | $CH_3$ |
| F-28 | $C_3H_7$ | H | H | H | H | H | $CH_3$ | $CH_3$ |
| F-29 | H | H | H | $(t)C_8H_{17}$ | H | H | H | H |
| F-30 | H | Cl | H | H | H | H | 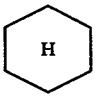 (Spiro) | |
| F-31 | 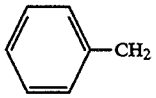 | H | H | H | H | H | $CH_3$ | $CH_3$ |

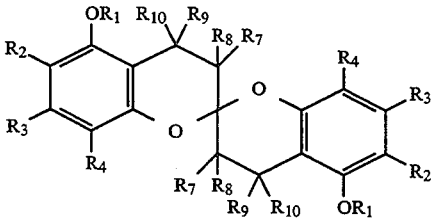

| Compound No | $R_1$ | $R_2$ | $R_3$ | $R_4$ | $R_7$ | $R_8$ | $R_9$ | $R_{10}$ |
|---|---|---|---|---|---|---|---|---|
| F-32 | H | H | H | H | H | H | $CH_3$ | $CH_3$ |
| F-33 | $CH_3$ | H | H | H | H | H | $CH_3$ | $CH_3$ |
| F-34 | H | $CH_3$ | H | H | H | H | H | H |
| F-35 | H | H | H | $(t)C_4H_9$ | H | H | $CH_3$ | $CH_3$ |
| F-36 | H | 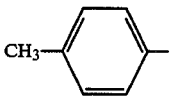 | H | H | H | H | $CH_3$ | $CH_3$ |
| F-37 | H | H | H | $CH_3SO_2NH$ | H | H | H | H |
| F-38 | 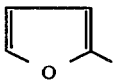 | H | H | H | H | H | $CH_3$ | $CH_3$ |
| F-39 | $C_{12}H_{25}$ | H | H | H | H | H | $CH_3$ | $CH_3$ |
| F-40 | 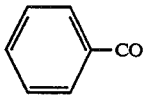 | H | H | H | H | H | 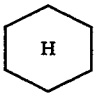 (Spiro) | |
| F-41 | H | H | 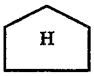 | H | H | H | $CH_3$ | $CH_3$ |

-continued

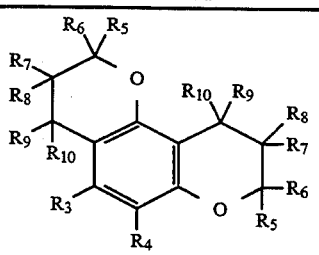

| Compound No | $R_3$ | $R_4$ | $R_5$ | $R_6$ | $R_7$ | $R_8$ | $R_9$ | $R_{10}$ |
|---|---|---|---|---|---|---|---|---|
| F-42 | H | H | $CH_3$ | $CH_3$ | H | H | H | H |
| F-43 | H | H | H (Spiro) | | H | H | H | H |
| F-44 | H | OH | $CH_3$ | $CH_3$ | H | H | $CH_3$ | H |
| F-45 | H | $C_3H_7O$ | H | H | H | H | $CH_3$ | $CH_2OH$ |
| F-46 | OH | H | $CH_3$ | $CH_3$ | H | H | H | H |
| F-47 | $C_3H_7O$ | H | $CH_3$ | $CH_3$ | H | H | H | H |

Formula [G]:

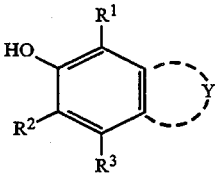

wherein $R^1$ and $R^3$ represent hydrogen, a halogen, an alkyl, alkenyl, alkoxy, hydroxy, aryl, aryloxy, acyl, acylamino, acyloxy, sulfonamido, cycloalkyl or alkoxycarbonyl group; and $R^2$ represents hydrogen, a halogen, an alkyl, alkenyl, hydroxyl, aryl, acyl, acylamino, acyloxy, sulfonamido, cycloalkyl or alkoxycarbonyl group.

The above-mentioned groups may be substituted by the other substituents including, for example, an alkyl, alkenyl, alkoxy, aryl, aryloxy, hydroxy, alkoxycarbonyl, aryloxycarbonyl, acylamino, carbamoyl, sulfonamido, sulfamoyl or like group.

$R^2$ and $R^3$ may close a ring with each other to form a 5- or 6-membered hydrocarbon ring which may also be substituted by a halogen, an alkyl cycloalkyl, alkoxy, alkenyl, hydroxy, aryl, aryloxy, heterocyclic or like group.

Y represents a group of atoms necessary for forming an indan ring which may also be substituted by a halogen, an alkyl, alkenyl, alkoxy cyclokalkyl, hydroxy, aryl, aryloxy, heterocyclic or like group; and may further form a spiro ring.

Among the compounds represented by the Formula [G], those particularly preferred include the compounds represented by the following Formulas [G-1] through [G-3]:

Formula [G-1]:

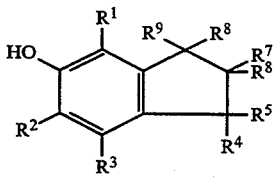

-continued

Formula [G-2]:

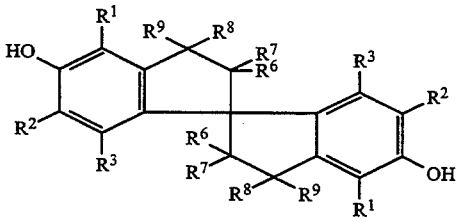

Formula [G-3]:

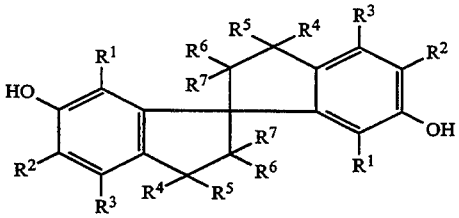

In the above-given Formulas [G-1] through [G-3], $R^1$, $R^2$ and $R^3$ are synonymous with those denoted in the Formula [G]; and $R^4$, $R^5$, $R^6$, $R^7$, $R^8$ and $R^9$ represent hydrogen, a halogen, an alkyl, alkoxy, alkenyl, hydroxy, aryl, aryloxy or heterocyclic group.

$R^4$ and $R^5$, $R^5$ and $R^6$, $R^6$ and $R^7$, $R^7$ and $R^8$, and $R^8$ and $R^9$ may close a ring with each other to form a hydrocarbon ring which may further be substituted by an alkyl group.

In the above-given Formulas [G-1] through [G-3], the particularly useful compounds are those in which $R^1$ and $R^3$ represent hydrogen, an alkyl, alkoxy, hydroxy or cycloalkyl group; $R^2$ represent hydrogen, an alkyl, hydroxy or cycloalkyl group; and $R^4$, $R^5$, $R^6$, $R^7$, $R^8$ and $R^9$ represent hydrogen, an alkyl or cycloalkyl group.

An amount of the compounds represented by the above-given Formula [G] to be used is preferably from 5 to 300 mol % and, more preferably, from 10 to 200 mol %, to the magenta couplers.

The typical examples of the compounds represented by the Formula [G] will be given below:

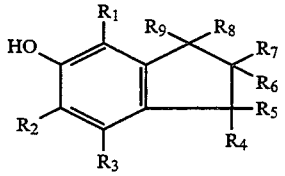

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| G-1 | H | H | H | H | H | H | H | H | H |
| G-2 | H | H | H | H | H | H | H | $CH_3$ | $CH_3$ |
| G-3 | H | H | H | H | H | H | H | $CH_3$ | $C_{16}H_{33}$ |
| G-4 | H | OH | H | H | H | H | H | $CH_3$ | $C_{16}H_{33}$ |
| G-5 | H | H | H | $CH_3$ | $CH_3$ | H | H | $CH_3$ | $CH_3$ |
| G-6 | H | Cl | H | $CH_3$ | $CH_3$ | H | H | $CH_3$ | $CH_3$ |
| G-7 | Cl | Cl | H | $CH_3$ | $CH_3$ | H | H | $CH_3$ | $CH_3$ |
| G-8 | H | H | $CH_3$ | $CH_3$ | $CH_3$ | H | H | $CH_3$ | $CH_3$ |
| G-9 | H | H | H | H | H (Condensation) | | H | H | H |
| G-10 | H | H | H | H | H | H | H | H (Spiro) | |
| G-11 | H | $C_3H_7$ | H | $CH_3$ | $CH_3$ | H | H | $CH_3$ | $CH_3$ |
| G-12 | H | (t)$C_8H_{17}$ | H | $CH_3$ | $CH_3$ | H | H | $CH_3$ | $CH_3$ |
| G-13 | H | H | H | $CH_3$ | $CH_3$ | H | H | $CH_3$ | $CH_3$ |
| G-14 | H | H | H | | $CH_3$ | H | H | $CH_3$ | $CH_3$ |
| G-15 | H | H | $CH_3O$ | $CH_3$ | $CH_3$ | H | H | $CH_3$ | $CH_3$ |
| G-16 | $CH_3H$ | H | H | H | H (Condensation) | | H | H | H |
| G-17 | H | $CH_3SO_2NH$ | H | $CH_3$ | $CH_3$ | H | H | $CH_3$ | $CH_3$ |
| G-18 | H | $CH_3CO$ | H | $CH_3$ | $CH_3$ | H | H | $CH_3$ | $CH_3$ |
| G-19 | H | | H | $CH_3$ | $CH_3$ | H | H | $CH_3$ | $CH_3$ |
| G-20 | H | $-CH_2-$ | H | $CH_3$ | $CH_3$ | H | H | $CH_3$ | $CH_3$ |
| G-21 | H | H (Condensation) | | H | H | H | H | H | H |

-continued

| | | | | | | | | |
|---|---|---|---|---|---|---|---|---|
| G-22 | H | 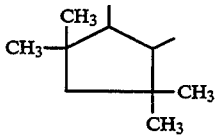 | $CH_3$ | $CH_3$ | H | H | $CH_3$ | $CH_3$ |
| G-23 | H | 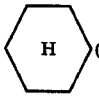 (Condensation) | $CH_3$ | $CH_3$ | H | H | $CH_3$ | $CH_3$ |
| G-24 | $CH_3$ | 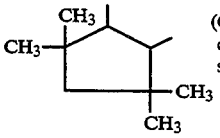 (Condensation) | $CH_3$ | $CH_3$ | H | H | $CH_3$ | $CH_3$ |

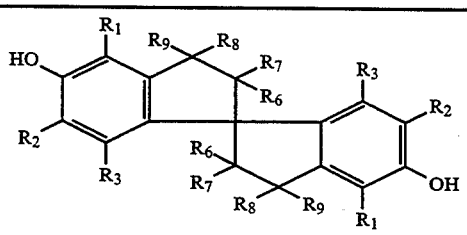

| Compound No. | $R^1$ | $R^2$ | $R^3$ | $R^6$ | $R^7$ | $R^8$ | $R^9$ |
|---|---|---|---|---|---|---|---|
| G-29 | H | H | H | H | H | $CH_3$ | $CH_3$ |
| G-32 | $CH_3$ | H | H | H | H | $CH_3$ | $CH_3$ |

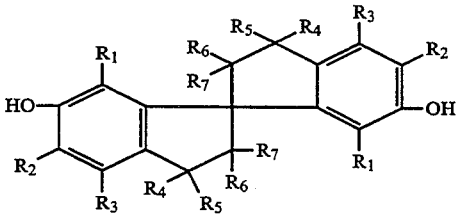

| Compound No. | $R_1$ | $R_2$ | $R_3$ | $R_4$ | $R_5$ | $R_6$ | $R_7$ |
|---|---|---|---|---|---|---|---|
| G-25 | H | $CH_3$ | H | $CH_3$ | $C_6H_5$ | H | H |
| G-26 | Cl | Cl | H | $CH_3$ | $CH_3$ | H | H |
| G-27 | H | OH | H | $CH_3$ | $CH_3$ | H | H |
| G-28 | H | $C_3H_7$ | H | $CH_3$ | $CH_3$ | H | H |
| G-30 | H | Cl | H | $CH_3$ | $CH_3$ | H | H |
| G-31 | H | $C_2H_5$ | H | $CH_3$ | $CH_3$ | H | H |
| G-33 | $CH_3$ | $CH_3$ | H | $CH_3$ | $CH_3$ | H | H |
| G-34 | H | 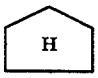 | H | $CH_3$ | $CH_3$ | H | H |
| G-35 | H | $CH_3$ | H | H | H | H | H |
| G-36 | H | H | H | 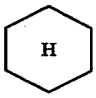 (Spiro) | | H | H |
| G-37 | $CH_3$ | H | H | $CH_3$ | $CH_3$ | H | H |
| G-38 | H | $CH_3$ | H | $CH_3$ | $C_6H_5$ | H | H |
| G-39 | 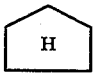 | H | H | $CH_3$ | $CH_3$ | H | H |
| G-40 | $CH_3$ | $CH_3$ | H | $C_2H_5$ | $C_2H_5$ | H | H |
| G-41 | H | H | H | H | H | $CH_3$ | $CH_3$ |

-continued

| | | | | | | | |
|---|---|---|---|---|---|---|---|
| G-42 | H | OH | H | 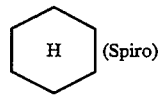 (Spiro) | | H | H |
| G-43 | H | 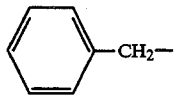 | H | H | H | H | H |
| G-44 | H | (t)$C_4H_9$ | H | $CH_3$ | $CH_3$ | H | H |
| G-45 | H | (t)$C_8H_{17}$ | H | $CH_3$ | $CH_3$ | H | H |

Formula [H]:

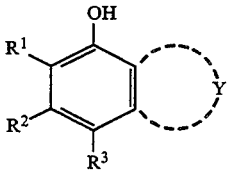

wherein $R^1$ and $R^2$ represents hydrogen, a halogen, an alkyl, alkenyl, aryl, acyl, acylamino, acyloxy, sulfonamido, cycloalkyl or alkoxycarbonyl group, respectively;

$R^3$ represents hydrogen, a halogen, an alkyl, alkenyl, alkoxy, hydroxy, aryl, aryloxy, arcyl, acylamino, acyloxy, sulfonamido, cycloalkyl or alkoxycarbonyl group;

The above-mentioned groups may be substituted by the other substituents including, for example, an alkyl, alkenyl, alkoxy, aryl, aryloxy, hydroxy, alkoxycarbonyl, aryloxycarbonyl, acylamino, carbamoyl, sulfonamido, sulfamoyl or like group;

Further, $R^1$ and $R^2$, and $R^2$ and $R^3$ may close a ring with each other to form a 5- or 6-membered hydrocarbon ring which may further be substituted by a halogen, an alkyl, cycloalkyl, alkoxy, alkenyl, hydroxy, aryl, aryloxy, heterocyclic or like group; and Y represents a group of atoms necessary for forming an indan ring which may also be substituted by a substituent capable of substituting the above-mentioned hydrocarbon ring; and may further form a spiro ring.

Among the compounds represented by the above-give Formula [H], the compounds particularly useful in the invention include those represented by the following Formulas [H-1] and [H-2]:

Formula [H-1]:

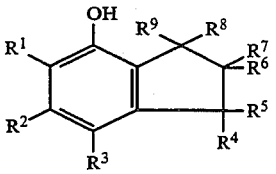

Formula [H-2]:

-continued

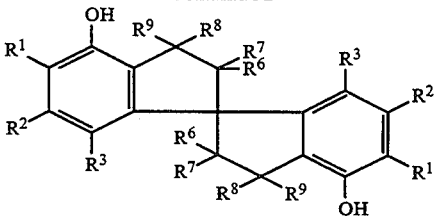

Formula [H-3]:

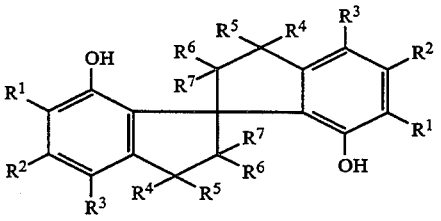

In the above-given Formulas [H-1] through [H-3], $R^1$, $R^2$ and $R^3$ are synonymous with those denoted in the Formula [H]; $R^4$, $R^5$, $R^6$, $R^7$, $R^8$ and $R^9$ represent hydrogen, a halogen, an alkyl, alkoxy, hydroxy, alkenyl, aryl, aryloxy or heterocyclic group; and, $R^4$ and $R^5$, $R^5$ and $R^6$, $R^6$ and $R^7$, $R^7$ and $R^8$, and $R^8$ and $R^9$ may close a ring with each other to form a hydrocarbon ring which may further be substituted by an alkyl group.

In the above-given Formulas [H-1] through [H-3], the particularly preferable compounds are those in which $R^1$ and $R^2$ represent hydrogen, an alkyl or cycloalkyl group; $R^3$ represent hydrogen, an alkyl, alkoxy, hydroxy or cycloalkyl group; and $R^4$, $R^5$, $R^6$, $R^7$, $R^8$ and $R^9$ represent hydrogen, an alkyl or cycloalkyl group.

The synthesizing processes of the compounds represented by the Formula [H] are already known. The compounds represented thereby may be prepared in accordance with the processes described in U.S. Pat. No. 3,057,929; 'Chem Ber.', 1972, 95(5), pp. 1673~1674; and 'Chemistry Letters', 1980, pp. 739~742.

The compounds represented by the Formula [H] are used in an amount of preferably from 5 to 300 mol % and more preferably from 10 to 200 mol %, to the magenta couplers used.

The typical examples of the compounds represented by the Formula [H] will be given below:

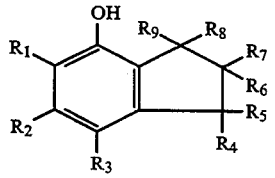

| Compound No. | $R^1$ | $R^2$ | $R^3$ | $R^4$ | $R^5$ | $R^6$ | $R^7$ | $R^8$ | $R^9$ |
|---|---|---|---|---|---|---|---|---|---|
| H-1 | H | H | H | H | H | H | H | H | H |
| 2 | $CH_3$ | H | H | H | H | H | H | H | H |
| 3 | H | H | H | H | H | H | H | $CH_3$ | $C_{16}H_{33}$ |
| 4 | H | H | OH | H | H | H | H | H | H |
| 5 | $CH_2{=}CHCH_2$ | H | Cl | H | H | H | H | H | H |
| 6 | H | H | H | H | H | H | H | $CH_3$ | $CH_3$ |
| 7 | H | H | H | $CH_3$ | $CH_3$ | H | H | H | H |
| 8 | H | H | H | $CH_3$ | $CH_3$ | $CH_3$ | H | H | H |
| 9 | $CH_2{=}CHCH_2$ | H | $CH_3O$ | H | H | H | H | H | H |
| 10 | H | H | H | $CH_3$ | $CH_3$ | H | H | $CH_3$ | $CH_3$ |
| 11 | H | $C_3H_7$ | H | $CH_3$ | $CH_3$ | H | H | $CH_3$ | $CH_3$ |
| 12 | Cl | H | Cl | H | H | H | H | $CH_3$ | $CH_3$ |

| Compound No. | $R_1$ | $R_2$ | $R_3$ | $R_4$ | $R_5$ | $R_6$ | $R_7$ | $R_8$ | $R_9$ |
|---|---|---|---|---|---|---|---|---|---|
| H-13 | H | H | H | H | H (Condensation) | | H | H | H |
| 14 | H | H | H | H | H | H | H | H (Spiro) | |
| 15 | H | H | H | $CH_3$ | $CH_3$ | H | H | $CH_3$ | $CH_3$ |
| 16 | H | $CH_3SO_2NH$ | H | $CH_3$ | $CH_3$ | H | H | $CH_3$ | $CH_3$ |
| 17 | H | $CH_3CO$ | H | H | H | H | H | $CH_3$ | $CH_3$ |
| 18 | H | | H | $CH_3$ | $CH_3$ | H | H | $CH_3$ | $CH_3$ |
| 19 | H | $CH_2$ | H | $CH_3$ | $CH_3$ | H | H | $CH_3$ | $CH_3$ |
| 21 | H (Condensation) | | $CH_3$ | H | H | H | H | $CH_3$ | $CH_3$ |
| 22 | H | H | H | $CH_3$ | | H | H | $CH_3$ | $CH_3$ |

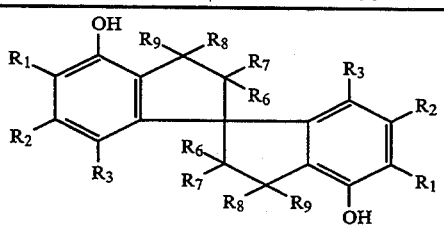

-continued

| Compound No. | $R_1$ | $R_2$ | $R_3$ | $R_6$ | $R_7$ | $R_8$ | $R_9$ |
|---|---|---|---|---|---|---|---|
| H-23 | H | H | H | H | H | H | H |
| 24 | H | H | OH | H | H | H | H |
| 25 | $CH_3$ | H | $CH_3$ | H | H | H | H |
| 26 | H | H | $CH_3$ | H | H | H | H |
| 27 | Cl | H | Cl | H | H | $CH_3$ | $CH_3$ |
| 28 | H | H | H | H | H | H | 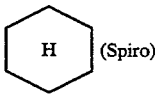 (Spiro) |
| 29 | H | H | H | H | H | $CH_3$ | 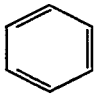 |
| 30 | H | H | 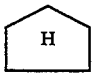 | H | H | H | H |
| 31 | H | H | 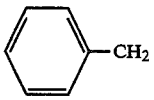 | H | H | $CH_3$ | $CH_3$ |
| 36 | H | H | $(t)C_4H_9$ | H | H | $CH_3$ | $CH_3$ |

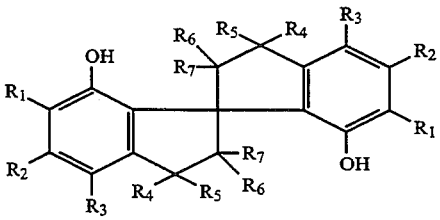

| Compound No. | $R_1$ | $R_2$ | $R_3$ | $R_4$ | $R_5$ | $R_6$ | $R_7$ |
|---|---|---|---|---|---|---|---|
| H-32 | H | H | H | H | H | H | H |
| 33 | H | H | H | $CH_3$ | $CH_3$ | H | H |
| 34 | H | H | $(t)C_4H_9$ | $CH_3$ | $CH_3$ | H | H |
| 35 | H | H | $(t)C_8H_{17}$ | $CH_3$ | $CH_3$ | H | H |

Others:
H-20

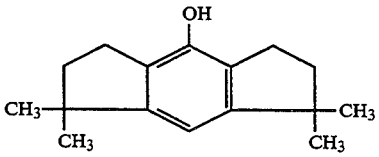

Formula [J]:

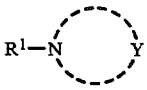

wherein $R^1$ represents an aliphatic group, a cycloalkyl group or an aryl group; and Y represents a group of non-metal atoms necessary for forming a 5-, 6- or 7-membered heterocyclic ring together with nitrogen; provided that, when there are two or more hetero atoms in a non-metal atom containing nitrogen atom forming the heterocyclic ring, at least two hetero atoms are not adjacent to each other.

The aliphatic groups represented by $R^1$ include, for example, a saturated alkyl group which may have a substituent, and an unsaturated alkyl group which may have a substituent. Such saturated alkyl groups include, for example, a methyl, ethyl, butyl, octyl, dodecyl, tetracyl, hexadecyl or like group; and such unsaturated alkyl groups include, for example, an ethenyl, propenyl or like group.

The cycloalkyl groups represented by $R^1$ are 5-, 6- or 7-membered cycloalkyl groups including, for example, a cyclopentyl, cyclohexyl or like group.

The aryl groups represented by $R^1$ include, for example, a phenyl group and a naphthyl group which are allowed to have a substituent.

The substituents of the aliphatic, cycloalkyl or aryl group represented by $R^1$ include, for example, an alkyl, aryl, alkoxy, carbonyl, carbamoyl, acylamino, sulfamoyl, sulfonamido, carbonyloxy, alkylsulfonyl, arylsulfonyl, hydroxy, heterocyclic, alkylthio, arylthio or like group; and each of these substituents may have a further substituent.

In the above-given Formula [J], Y represents a group of non-metal atoms necessary for forming a 5-, 6- or 7-membered heterocyclic ring together with nitrogen, however, at least two of the non-metal atom groups each containing nitrogen forming the heterocyclic ring are to be hereto atoms and, at the same time, the two hetero atoms are not to be adjacent to each other. In the heterocyclic ring of the compounds represented by the Formula [J], it is undesirable that all the hetero atoms are adjacent to each other, because it is unable to display the function of a magenta dye image stabilizer.

The 5-, 6- or 7-membered heterocyclic rings of the compounds represented by the Formula [J] are allowed to have such a substituent as an alkyl, aryl, acyl, carbamoyl, alkoxycarbonyl, sulfonyl or sulfamoyl group which may have a further substituent. In addition to the above, the 5-, 6- or 7-membered heterocyclic ring may also be saturated and a saturated heterocyclic ring is desired. It is further allowed that a benzene ring or the like may be condensed together with the heterocyclic ring or a spiro ring may be formed.

The compounds represented by the Formula [J] relating to the invention are to be used in an amount of preferably from 5 to 300 mol % and, more preferably, from 10 to 200 mol %, to the amount of the magenta couplers used.

The typical examples of the compounds represented by the Formula [J] will be given below:

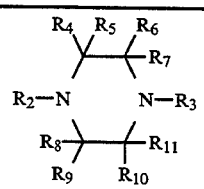

| | $R^2$ | $R^3$ | $R^4$ | $R^5$ | $R^6$ | $R^7$ | $R^8$ | $R^9$ | $R^{10}$ | $R^{11}$ |
|---|---|---|---|---|---|---|---|---|---|---|
| J-1 | $C_{12}H_{25}$ | $C_{12}H_{25}$ | H | H | H | H | H | H | H | H |
| J-2 | $C_{14}H_{29}$ | $C_{14}H_{29}$ | H | H | H | H | H | H | H | H |
| J-3 | $C_{14}H_{29}$ | H | H | H | H | H | H | H | H | H |
| J-4 | $C_{14}H_{29}$ | $CH_3CO$ | H | H | H | H | H | H | H | H |
| J-5 | $C_{16}H_{33}$ | $C_{16}H_{33}$ | H | H | H | H | H | H | H | H |
| J-6 | $C_{14}H_{29}$ | $CH_3$ | H | H | H | H | H | H | H | H |
| J-7 | 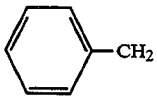 | 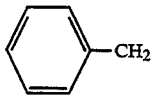 | H | H | H | H | H | H | H | H |
| J-8 | 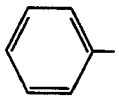 | 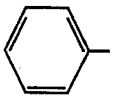 | H | H | H | H | H | H | H | H |
| J-11 | 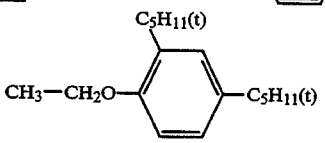 | | H | H | H | H | H | H | H | H |
| J-13 | $C_{14}H_{29}$ | $C_4H_9NHCO$ | H | H | H | H | H | H | H | H |
| J-14 | $(t)C_8H_{17}$ | 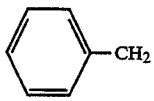 | H | H | H | H | H | H | H | H |
| J-15 | $C_{14}H_{29}$ | $CF_3CO$ | H | H | H | H | H | H | H | H |
| J-16 | $C_{14}H_{29}$ | $C_2H_5OCO$ | H | H | H | H | H | H | H | H |
| J-17 | 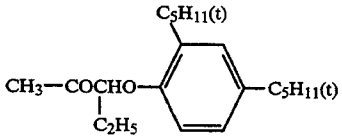 | | H | H | H | H | H | H | H | H |
| J-18 | $C_{14}H_{29}$ | $C_{14}H_{29}$ | $CH_3$ | H | H | H | H | H | H | H |
| J-19 | $C_{14}H_{29}$ | $C_{14}H_{29}$ | $CH_3$ | H | H | H | H | H | $CH_3$ | H |
| J-20 | $C_{14}H_{29}$ | $C_{14}H_{29}$ | $CH_3$ | $CH_3$ | $CH_3$ | $CH_3$ | $CH_3$ | $CH_3$ | $CH_3$ | $CH_3$ |

-continued

| | | | | | | | | | | |
|---|---|---|---|---|---|---|---|---|---|---|
| J-21 | 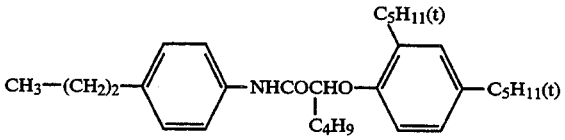 | | H | H | H | H | H | H | H | H |
| J-22 | $C_{12}H_{25}$ | $CH_3$ | $CH_3$ | H | H | H | $CH_3$ | H | H | H |
| J-23 | $C_{12}H_{25}$ | $C_{12}H_{25}$ | $CH_3$ | H | H | H | H | H | $CH_3$ | H |
| J-24 | $C_{16}H_{33}$ | $C_{16}H_{33}$ | $CH_3$ | H | H | H | H | H | $CH_3$ | H |
| J-25 | $C_6H_5CH{=}CH{-}CH_2{-}$ | $C_{12}H_{25}$ | H | H | H | H | H | H | H | H |
| J-26 | $C_{12}H_{25}$ | $C_2H_5$ | $CH_3$ | H | H | H | H | H | H | H |
| J-27 | $C_{16}H_{33}$ | H | $C_2H_5$ | H | H | H | H | H | H | H |
| J-29 | $C_{14}H_{29}$ | $CH_2BrCH_2$ | H | H | H | H | H | H | H | H |
| J-30 | $CH_3O(CH_2)_4{-}$ | $CH_3O(CH_2)_4$ | H | H | H | H | H | H | H | H |

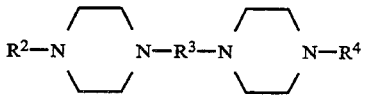

| | $R^2$ | $R^3$ | $R^4$ |
|---|---|---|---|
| J-9 | $C_{14}H_{29}$ | $(CH_2)_2$ | $C_{14}H_{29}$ |
| J-10 | $(t)C_8H_{17}$ | $(CH_2)_6$ | $(t)C_8H_{17}$ |
| J-12 | $C_{14}H_{29}$ | $CH_2$ | $C_{14}H_{29}$ |
| J-28 | $C_{12}H_{25}$ | 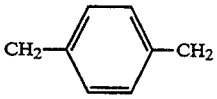 | $C_{12}H_{25}$ |

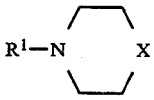

| | X | $R_1$ |
|---|---|---|
| J-31 | O | $C_{12}H_{25}$ |
| J-32 | O | $C_{14}H_{29}$ |
| J-33 | O | $C_6H_5CH{=}CH{-}$ |
| J-34 | O | 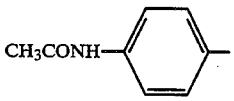 |
| J-35 | O | α-naphthyl |
| J-36 | O | 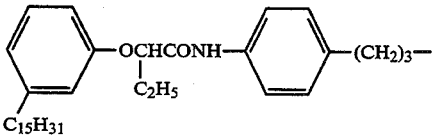 |
| J-37 | O | 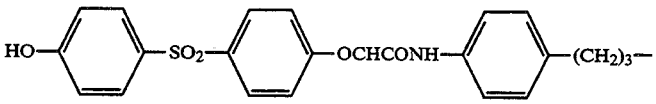 |
| J-38 | O | 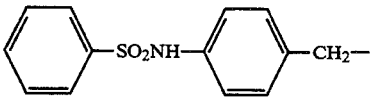 |
| J-39 | O | 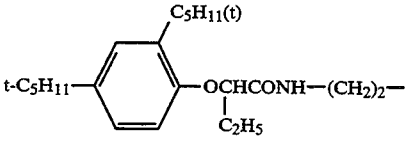 |

-continued
| | | |
|---|---|---|
| J-40 | O | 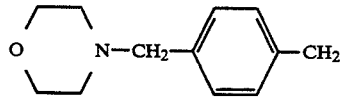 |
| J-41 | S | $C_{14}H_{29}$ |
| J-42 | S | 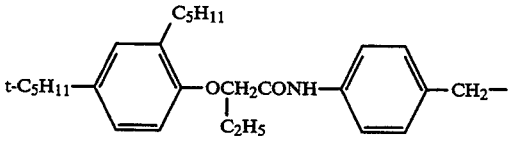 |
| J-43 | S | 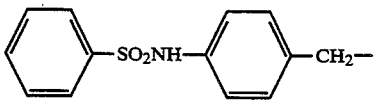 |
| J-44 | S | 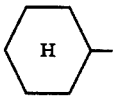 |
| J-45 | S | 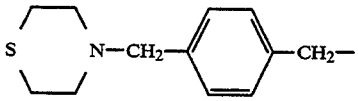 |
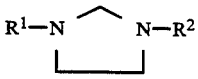
| | $R^1$ | $R^2$ |
|---|---|---|
| J-46 | $C_{12}H_{25}$ | $C_{12}H_{25}$ |
| J-47 | $C_{14}H_{29}$ | $C_{14}H_{29}$ |
| J-48 | $C_6H_5CH_2$ | $C_6H_5CH_2$ |
| J-49 | $C_{16}H_{33}$ | H |
| J-50 | $C_{16}H_{33}$ | $CH_3CO$ |
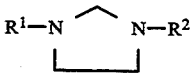
| | | |
|---|---|---|
| J-51 | $C_{16}H_{33}$ | $C_{16}H_{33}$ |
| J-52 | $C_{14}H_{29}$ | $C_{14}H_{29}$ |
| J-53 | $C_{12}H_{25}$ | $C_{12}H_{25}$ |
| J-54 | $C_{14}H_{29}$ | $CH_3CO$ |
| J-55 | $C_{14}H_{29}$ | $CF_3CO$ |
| J-56 | $C_2H_5$ | 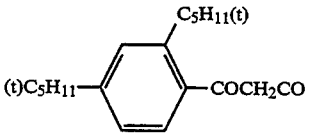 |
| J-57 | $C_{14}H_{29}$ | $C_2H_5OCO$ |
| J-58 | $C_{14}H_{29}$ | $CH_3NHCO$ |
| J-59 | $C_{14}H_{29}$ | $C_4H_9SO_2$ |
| J-60 | $C_{14}H_{29}$ | $(CH_3)_2NSO_2$ |
| J-61 | $C_{12}H_{25}$ | 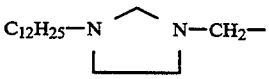 |
| J-62 | H | 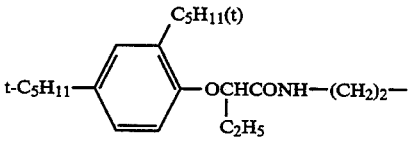 |

-continued
J-63
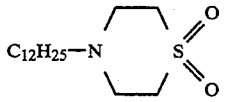
J-64
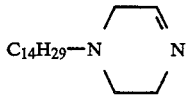
J-65
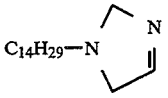
J-66
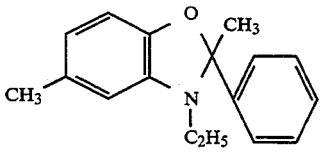
J-67
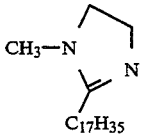
J-68
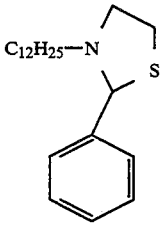
J-69
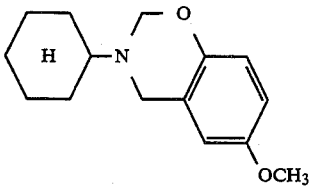
J-70
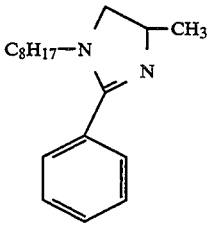
J-71
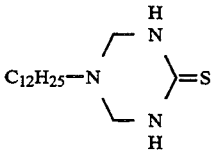

-continued

J-72

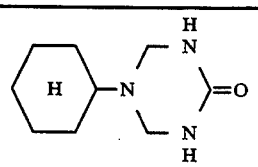

J-73

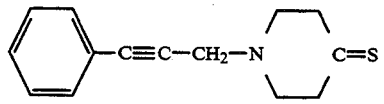

J-74

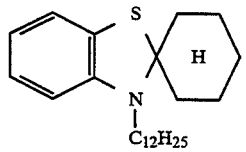

Among the compounds represented by the Formula [J], the piperazine compounds and the homopiperazine compounds are particularly preferred, and the compounds represented by the following Formula [J-1] or [J-2] are further particularly preferred to use;

Formula [J-1]:

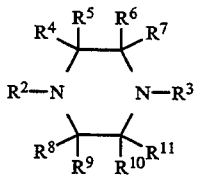

Formula [J-2]:

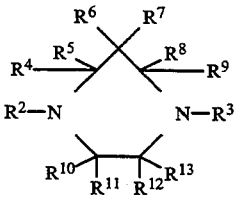

In the above-given Formulas [J-1] and [J-2], $R^2$ and $R^3$ represent hydrogen, an alkyl or aryl group, provided that $R^2$ and $R^3$ are not hydrogen at the same time; and $R^4$ through $R^{13}$ represent hydrogen, an alkyl or aryl group, respectively.

In the Formulas [J-1] and [J-2], $R^2$ and $R^3$ represent hydrogen, an alkyl or aryl group. The alkyl groups represented thereby include, for example, a methyl, ethyl, butyl, octyl, dodecyl, tetradecyl, hexadecyl, octadecyl or like group. The aryl groups represented thereby include, for example, a phenyl or like group. The alkyl groups and the aryl groups represented thereby may have substituents including, for example, a halogen, an alkyl, aryl, alkoxy, aryloxy and heterocyclic groups and the like.

A total number of the carbon atoms of $R^2$ and $R^3$ including the substituents thereof is preferably from 6 to 40.

In the above-given Formula [J-1] or [J-2], $R^4$ through $R^{13}$ represent hydrogen, an alkyl or aryl group. The alkyl groups represented thereby include, for example, a methyl, ethyl or like group, and the aryl groups represented thereby include, for example, a phenyl or like group.

The typical examples of the compounds represented by the Formula [J-1] or [J-2] are the same as those given in the exemplified piperazine compounds [J-1] through [J-30] and the exemplified homopiperazine compounds [J-51] through [J-62].

Next, the synthesis examples of the magenta dye image stabilizers represented by the aforegiven Formula [J], which are typically used in the invention, will be given below.

SYNTHESIS EXAMPLE-1 (SYNTHESIS OF COMPOUND J-2)

Nine (9) grams of piperazine and 55 g of myristyl bromide were dissolved in 100 ml of acetone and 15 g of anhydrous potassium carbonate were then added thereto. The resulted matter was boiled and refluxed for 10 hours so as to undergo a reaction. After the reaction, the resulted reactant solution was poured in to 500 ml of water and an extraction was then tried with 500 ml of ethyl acetate. After the resulted ethyl acetate layer was dried with magnesium sulfate, the ethyl acetate was distilled off. Then, the white crystallized objective matter was obtained. The recrystallization thereof was made with 300 ml of acetone and, then, 34 g of white-flaky crystals were obtained (yield: 70%).

Melting point: 55° to 58° C.

SYNTHESIS EXAMPLE-2 (SYNTHESIS OF COMPOUND J-34)

Eighteen (18) grams of 4-morpholinaniline were dissolved in 100 ml of ethyl acetate and 12 ml of acetic anhydride were added thereto little by little while stirring and keeping the reactant solution at 20° C. After then, the resulted solution was ice-cooled and the resultantly deposited crystals were filtered. The filtrated crystals were recrystallized with ethyl acetate and, then, 16.5 g of white powder-like crystals were obtained (yield: 75%).

Melting point: 207° to 210° C.

Formula [K]:

-continued

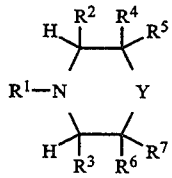

wherein $R^1$ represents an aliphatic, cycloalkyl or aryl group; Y represents a simple link or divalent hydrocarbon group which is necessary to form a 5- to 7-membered heterocyclic ring together with nitrogen; and $R^2$, $R^3$, $R^4$, $R^5$, $R^6$ and $R^7$ represent hydrogen, an aliphatic, cycloalkyl or aryl group, provided that $R^2$ and $R^4$, and $R^3$ and $R^6$ may couple to each other to form a simple link so that an unsaturated 5- to 7-membered heterocyclic ring may be formed together with nitrogen and Y and, when Y is a simple link, $R^5$ and $R^7$ may couple to each other to form a simple link so that an unsaturated 5-membered heterocyclic ring may be formed together with nitrogen and Y and further, when Y is not a simple link, $R^5$ and Y, $R^7$ and Y, or Y itself may form an unsaturated link so that an unsaturated 6- or 7-membered heterocyclic ring together with nitrogen and Y.

The aliphatic groups represented by $R^1$ include, for example, a saturated alkyl group which may have a substituent and an unsaturated alkyl group which may have a substituent. The saturated alkyl groups include, for example, a methyl, ethyl, butyl, octyl, dodecyl, tetradecyl, hexadecyl or like group. The unsaturated alkyl groups include, for example, an ethenyl, propenyl or like group.

The cycloalkyl groups represented by $R^1$ include, for example, such a 5- to 7-membered cycloalkyl group which may have a substituent as a cyclopentyl, cyclohexyl or like group.

The aryl groups represented by $R^1$ include, for example, a phenyl or naphthyl group which may have a substituent.

The substituents of the aliphatic, cycloalkyl and aryl groups each represented by $R^1$ include, for example, an alkyl, aryl, alkoxy, carbonyl, carbamoyl, acylamino, sulfamoyl, sulfonamido, carbonyloxy, alkylsulfonyl, hydroxy, heterocyclic, alkylthio and arylthio groups and the like; and these substituents each may have a further substituent.

In the above-given Formula [K], Y represents a simple link or divalent hydrocarbon group which is necessary to form a 5- to 7-membered heterocyclic ring together with nitrogen, however, when Y is a simple link, $R^5$ and $R^7$ may couple to each other to form a simple link so that an unsaturated 5-membered heterocyclic ring may be formed and, when Y is a divalent hydrocarbon group, i.e., a methylene group, $R^5$ and Y or $R^7$ and Y may form an unsaturated link so that an unsaturated 6-membered heterocyclic ring may be formed, and further, when Y is an ethylene group, $R^5$ and Y, $R^7$ and Y or Y itself may form an unsaturated link so that an unsaturated 7-membered heterocyclic ring may be formed. In addition to the above, the divalent hydrocarbon groups represented by Y may have substituents, respectively. Such substituents include, for example, an alkyl, carbamoyl, alkyloxycarbonyl, acylamino, sulfonamido, sulfamoyl, aryl, heterocyclic and like groups.

In the above-given Formula [K], $R^2$, $R^3$, $R^4$, $R^5$, $R^6$ and $R^7$ represent hydrogen, an aliphatic, cycloalkyl or aryl group. The aliphatic groups represented by $R^2$ through $R^7$ include, for example, a saturated alkyl group which may have a substituent and an unsaturated alkyl group which may have a substituent. The saturated alkyl groups include, for example, a methyl, ethyl, butyl, octyl, dodecyl, tetradecyl, hexadecyl and like groups; and the unsaturated alkyl groups include, for example, an ethenyl, propenyl and like groups.

The cycloalkyl groups represented by $R^2$ through $R^7$ include, for example, such a 5- to 7-membered cycloalkyl group which may have a substituent as a cyclopentyl, cyclohexyl or like group.

The aryl groups represented by $R^2$ through $R^7$ include, for example, a phenyl, naphthyl or like group which may have a substituet.

The substituents of the aliphatic, cycloalkyl and aryl groups represented by the above-denoted $R^2$ through $R^7$ include, for example, an alkyl, aryl, alkoxy, carbonyl, carbamoyl, acylamino, sulfamoyl, sulfonamido, cabonyloxy, alkylsulfonyl, arylsulfonyl, hydroxy, heterocyclic, alkylthio and like groups.

Among the compounds represented by the aforegiven Formula [K], those each having a 5- to 7-membered saturated heterocyclic ring are more preferable than those each having an unsaturated ring.

A mount of the compounds represented by the aforegiven Formula [K] to be used to preferably from 5 to 300 mol % and more preferably from 10 to 200 mol %, to the magenta couplers of the invention represented by the aforegiven Formula [I].

The typical examples of the compounds represented by the aforegiven Formula [K] will be give below:

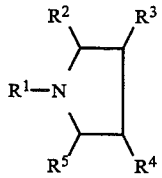

| | $R^1$ | $R^2$ | $R^3$ | $R^4$ | $R^5$ |
|---|---|---|---|---|---|
| K-1 | $C_8H_{17}$ | H | H | H | H |
| K-2 | 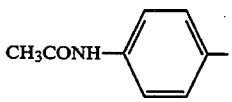 | H | H | H | H |

-continued
| | | | | | |
|---|---|---|---|---|---|
| K-3 | 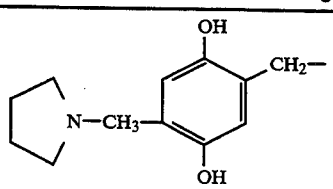 | H | H | H | H |
| K-4 | $C_{12}H_{25}$ | H | H | H | H |
| K-5 | $C_{14}H_{29}$ | H | H | H | H |
| K-6 | $C_{16}H_{33}$ | H | H | H | H |
| K-7 | $C_{14}H_{29}$ | H | 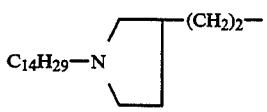 | H | H |
| K-8 | 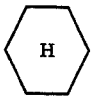 | $CH_3$ | $CH_3$ | H | H |
| K-9 | $C_6H_5CH{=}CHCH_2{-}$ | H | H | H | H |
| K-10 | 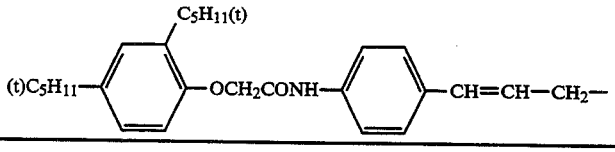 | H | H | H | H |
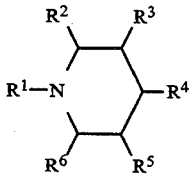
| | $R^1$ | $R^2$ | $R^3$ | $R^4$ | $R^5$ | $R^6$ |
|---|---|---|---|---|---|---|
| K-11 | $(t)C_8H_{17}$ | H | H | H | H | H |
| K-12 | 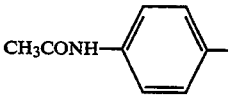 | H | H | H | H | H |
| K-13 | $C_{12}H_{25}$ | H | H | H | H | H |
| K-14 | $C_{14}H_{29}$ | H | H | H | H | H |
| K-15 | $C_{16}H_{33}$ | H | H | H | H | H |
| K-16 | $C_{14}H_{29}$ | $CH_3$ | H | H | H | H |
| K-17 | 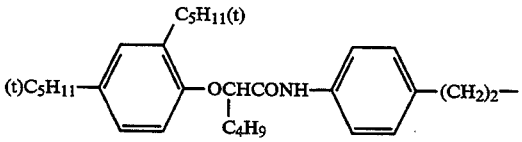 | | | H | H | H |
| K-18 | $C_8H_{17}$ | $CH_3$ | $CH_3$ | H | $CH_3$ | $CH_3$ |
| K-19 | 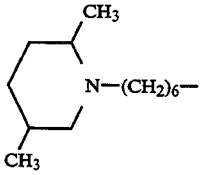 | $CH_3$ | H | H | $CH_3$ | H |
| K-20 | $CH_3$ | H | H | $C_{12}H_{25}OCOCH_2{-}$ | H | H |
| K-21 | $CH_3$ | $CH_3$ | H | $C_{16}H_{33}OCOCH_2{-}$ | H | $CH_3$ |
| K-22 | $CH_3$ | $C_{16}H_{33}$ | H | H | H | H |
| K-23 | $C_6H_5$ | H | H | $C_{12}H_{25}OCO{-}$ | H | H |
| K-24 | $CH_3$ | $C_6H_5$ | H | H | H | H |

-continued
| | | | | | |
|---|---|---|---|---|---|
| K-25 | 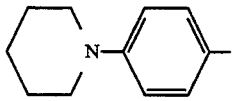 | H | H | H | H | H |
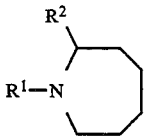
| | $R^1$ | $R^2$ |
|---|---|---|
| K-26 | $C_8H_{17}$ | H |
| K-27 | 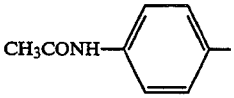 | H |
| K-28 | 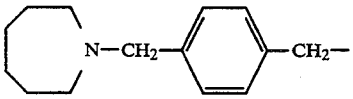 | H |
| K-29 | $C_{14}H_{29}$ | H |
| K-30 | 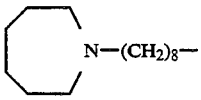 | H |
| K-31 | $C_{16}H_{33}$ | $CH_3$ |
| K-32 | 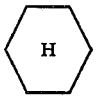 | H |
| K-33 | 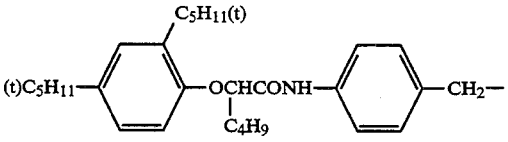 | H |
| K-34 | 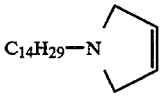 | |
| K-35 | 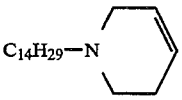 | |
| K-36 | 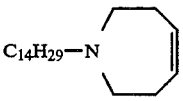 | |
| K-37 | 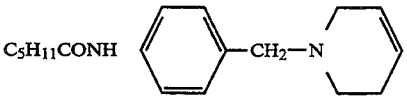 | |
| K-38 | 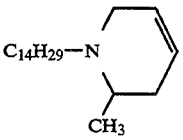 | |

-continued

K-39

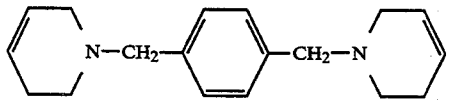

K-40

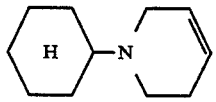

K-41

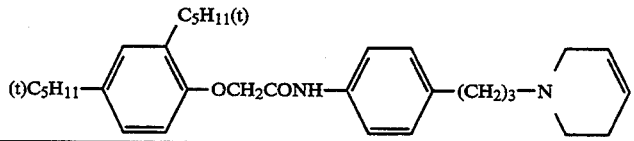

Next, the typical synthesis examples of the compounds represented by the Formula [K] will be given below:

SYNTHESIS EXAMPLE-1 (SYNTHESIS OF COMPOUND K-14)

Nine (9) grams of piperazine and 28 g of myristyl bromide were dissolved in 60 ml of acetone and 6.0 g of anhydrous potassium carbonate were then added thereto. The resulted matter was boiled and refluxed for 20 hours so as to undergo a reaction. After the reaction, the resulted reactant solution was poured into 300 ml of water and an extraction was then tried with 300 ml of ethyl acetate. After the resulted ethyl acetate layer was dried with magnesium sulfate, the ethyl acetate was distilled off. Then, the white crystallized objective matter was obtained. The recrystallization thereof was made with 100 ml of acetone and, then, 12 g of white flaky crystals were obtained (yield: 43%).

Melting point: 175° to 180° C.

The hydrophilic colloidal layers such as a protective layer, an interlayer and the like of the color photographic light-sensitive materials for printing use of the invention are allowed to contain an ultraviolet absorving agent with the purposes of preventing a fog caused by a static discharge generated by rubbing the light-sensitive materials and avoiding the deterioration of an image caused by exposing the light-sensitive materials to ultraviolet rays.

To the color photographic light-sensitive materials for printing use of the invention, there may be provided with the supplementary layers such as a filter layer, an antihalation layer and/or an antiiradiation layer. These layers and/or emulsion layers may also contain such a dyestuff as is capable of flowing out from the light-sensitive materials or being bleached, in a developing process.

To the silver halide emulsion layers and/or the other hydrophilic colloidal layers of the color photographic light-sensitive matrials for printing use of the invention, there may be added with a matting agent with the purpose of reducing the gross of the light-sensitive materials and improving the retouchability and further avoiding the adhesion of the light-sensitive materials to each other.

To the color photographic light-sensitive matrials for printing use of the invention, there may be added with a sliding agent with the purpose of reducing a sliding friction.

To the color photographic light-sensitive matrials for printing use of the invention, there may be added with an antistatic agent with the purpose of preventing a static charge. Such an antistatic agent is sometimes provided to an antistatic layer arranged to the side of the support of the light-sensitive material whereon no emulsion is coated, or the antistatic agent may also be provided, in other cases, to a protective layer other than the emulsion layers, which is arranged to the side of the emulsion layer and/or the support whereon the emulsion is coated.

To the photographic emulsion layers and/or the other hydrophilic colloidal layers of the color photographic light-sensitive materials for printing use of the invention, various surface active agents maybe applied with the purposes of improving the coating behavior, preventing the static charge, improving the slidability, improving the emulsificationdispersion property, preventing the adhesion, improving the photographic characteristics such as a development acceleration, hardening, sensitization, and the like.

For the purpose of color-reproducing an image in a color substraction process, the reflection type support of a color photographic light-sensitive material for color printing use of the invention is provided thereon with silver halide emulsion layers and non-light-sensitive layers, in suitable quantity and arrangement order, containing a magenta, yellow and cyan couplers each serving as the couplers for photographic use. Such quantity and arrangement order to the layers may suitably be changed according to the priority properties and the purposes of using.

The color photographic light-sensitive materials for printing use of the invention may be coated to the surface of the support thereof directly or with the interposition of one or not less than two subbing layers between them for improving the surface of the support on its adhesion property, antistatic property, dimensional stability, abrasion resistance, hardness, antihalation property, friction property and/or other properties, after applying a corona discharge, an ultraviolet ray irradiation, a flame treatment or the like to the surface of the support, if required.

In coating the color photographic light-sensitive materials for printing use of the invention, a thickening agent may be used to improve the coatability. An extrusion coating method and a curtain coating method are particularly useful for this purpose, because two or more layers may be coated at the same time in these methods.

In the color photographic light-sensitive materials for printing use of the invention, images may be reproduced in any color developments well-known to the skilled in the art.

In the invention, the aromatic primary amine color developing agents to be used in a color developer include any well-known ones being popularly used in various color photographic processes. These developers include, for example, an aminophenol derivative and a p-phenylenediamine derivative. These compounds are generally used in the form of the salts thereof, such as a chloride or sulfate, rather than in the free state, because the salts are more stable. Such compounds are generally used at a cendensation of from about 0.1 g to about 30 g per liter of a color developer used and more preferably from about 1 g to about 15 g per liter of the color developer used.

Such aminophenol developers include, for example, o-aminophenol, p-aminophenol, 5-amino-2-oxytoluene, 2-amino-3-oxytoluene, 2-oxy-3-amino-1,4-dimethylbenzene, and the like.

The particularly useful aromatic primary amine color developers include, for example, a N,N'-dialkyl-p-phenylene diamine compound, and the alkyl and phenyl groups thereof may be substituted by any arbitrary substituents. Among the compounds, the particularly useful compounds include, for example, a N,N'-diethyl-p-phenylenediamine chloride, a N-methyl-p-phenylenediamine chloride, a N,N'-dimethyl-p-phenylenediamine chloride, 2-amino-5-(N-ethyl-N-dodecylamino)-toluene, a N-ethyl-N-β-methanesulfonamidoethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluene sulfonate, and the like.

In the processes of the invention, the color developers used contain the above-mentioned aromatic primary amine color developing chemicals and in addition they are further allowed to contain nay various components which are normally added to color developers, including, for example, such an alkalizer as sodium hydroxide, sodium carbonate, potassium carbonate; an alkali metal sulfite, an alkali metal bisulfite, an alkali metal thiocyanate, an alkali metal halide, benzyl alcohol, a water softening agent, a thickening agent and the like. A pH value of the above-mentioned color developers is normally not lower than 7 and most popularly from about 10 to about 13.

In the invention, a color photographic light-sensitive material for printing use is color-developed and is then processed with a processing liquid capable of fixing the light-sensitive material. When the processing liquid capable of fixing is a fixer, a bleaching step is to be taken before the fixing step. As for the bleaching agents to be used in such a bleaching step, the metallic complex salts of an organic acid are used. Such metallic complex salts have the function that a metallic silver produced by a development is oxidized and restored to the silver halide thereof and, at the same time, the undeveloped color portions of a color-developing chemical are color-developed. Such a metal complex salts is composed of an aminopolycarboxylic acid or such an organic acid as oxalic acid, citric acid or the like, with which such a metal ions as that of iron, cobalt, copper or the like are coordinated. The organic acids most preferably useful to form such a metal complex salt thereof as mentioned above include, for example, a polycarboxylic acid or aminocarboxylic acid. These polycarboxylic acid or aminocarboxylic acid may alternatively be an alkali metallic salt, an ammonium salt or a water-soluble amine salt.

The typical examples thereof may be given below:

[1] Ethylenediaminetetraacetic acid,
[2] Nitrilotriacetic acid
[3] Iminodiacetic acid,
[4] Disodium ethylenediaminetetraacetate,
[5] Tetra(Tri)methylammonium ethylenediaminetetraacetate
[6] Tetrasodium ethylenediaminetetraacetate, and
[7] Sodium nitrilotriacetate.

The bleaching agents to be used therein contain various additives as well as the above-mentioned metallic complex salts of the organic acids to serve as the bleaching agents. It is desirable that such an additive contains an alkali halide or ammonium halide in particular including, for example, a rehalogenater such as potassium bromide, sodium bromide, sodium chloride, ammonium bromide or the like, a metallic salt and a chelating agent.

It is also allowed to suitably add such a matter as a borate, oxalate, acetate, carbonate, phosphate or like salts which is well-known to be put into a pH buffer, and such a metter as an alkylamine, polyethylene oxide or the like which is well-known to be put into an ordinary type bleaching liquid.

In addition to the above, the fixers and the bleach-fixers are also allowed to contain a single or not less than two kinds of pH buffers comprising such a sulfite as ammonium sulfite, potassium sulfite, ammonium bisulfite, potassium bisulfite, sodium bisulfite, ammonium metabisulfite, potassium metabisulfite, sodium metabisulfite and the like, and various kinds of salts such as a boric acid, borax, sodium hydroxide, potassium hydroxide, sodium carbonate, potassium carbonate, sodium bisulfite, sodium bicarbonate, potassium bicarbonate, acetic acid, sodium acetate, ammonium hydroxide and the like.

When a process of the invention is carried out while adding a bleach-fix replenisher to a bleach-fix solution (bath), the bleach-fix solution (bath) may contain a thiosulfate, a thiocyanate, a sulfite or the like, or the bleach-fix replenisher may contain the above-mentioned salts to be replenished to a processing bath.

In the invention, for a further activation of a bleach-fixer, the air or oxygen may be blown, if desired, through the bleach-fixing bath and the reservoir of a bleach-fix replenisher, or such a suitable oxidizer as hydrogen peroxide, a bromate, a persulfate and the like may suitably be added thereto.

EXAMPLES

Now, the invention will be descrived in detail with reference to the following embodiments, and it is, however, to be understood that the invention shall not be limited thereto.

EXAMPLE-1

In the presence of an inert gelatin, there prepared, in a normal (or single-jet) prepcipitation process, a polydispersed silver chlorobromide emulsion (whose silver bromide content: 80 mol %) having the average grain size ($\bar{r}$) of 0.60 μm and the variation coefficient ($s/\bar{r}$) of 0.25; and the resulted emulsion was further added with sodium thiosulfate and the following spectral sensitizing dye (D-1) at 50° C., so that the Emulsion EM-1 was obtained.

Next, the emulsion EM-1 prepared as above for serving as a green sensitive emulsion, the following coupler (M-1) for serving as a magenta coupler and the aforementioned high boiling organic solvent (S-3) were dispersed in an aqueous gelatin solution by making use of a supersonic dispersing device, and the resulted dispersed solution was coated to form the third layer on a paper support coated with polyethylene on the both sides thereof, and the other layers each comprising the compositions shown in Table were coated respectively on the paper support, so that a multilayered color photographic light-sensitive material for printing use were prepared and named Sample-1.

TABLE-1

| | |
|---|---|
| 7th layer | Gelatin<br>Hardener (H-1) |
| 6th layer | Ultraviolet absorber (UV-1)<br>Gelatin |
| 5th layer | Red-sensitive silver chlorobromide emulsion<br>(Silver bromide content: 60 mol %;<br>Silver coated: 0.25 g/m$^2$)<br>Cyan coupler (C-1)<br>Dioctyl phthalate<br>Gelatin |
| 4th layer | Ultraviolet absorbing agent (UV-1) |
| 3rd layer | Green sensitive emulsion (EM-1)<br>(Silver coated: 0.40 g/m$^2$)<br>Magenta coupler<br>Dioctyl phthalate<br>Gelatin |
| 2nd layer | Gelatin |
| 1st layer | Blue sensitive silver chlorobromide emulsion<br>(Silver bromide content: 90 mol %;<br>Silver coated: 0.35 g/m$^2$)<br>Yellow coupler (Y-1)<br>Dioctyl phthalate<br>Gelatin |
| | Support |

Next, in the presence of an insert gelatin, there prepared, in a double-jet precipitation process, a monodispersed silver chlorobromide emulsion (whose silver bromide content: 80 mol %) having the average grain size ($\bar{r}$) of 0.53 μm and the variation coefficient ($s/\bar{r}$) of 0.13 with regulating the flow at 50° C. to meet the conditions for not producing any new grains in the course of grain growth. The resulted emulsion was added with sodium thiosulfate and the following spectral sensitizing dye D-1 at 55° C., so that the emulsion EM-2 was obtained.

Now, Samples 2 and 3 were prepared respectively in the same manner as in Sample-1 except that the emulsion EM-2 prepared as described above were used in the both samples and the silver coated weight of the green sensitive emulsion were 0.35 g/m$^2$, and 0.32 g/m$^2$, respectively.

Then, a monodispersed chlorobromide emulsion (Silver bromide content: 80 mol %) having the average grain size ($\bar{r}$) of 0.39 μm and the variation coefficient ($s/\bar{r}$) of 0.14 was prepared in the same manner as in the preparation of the emulsion EM-2 except that the mixing temperature was set at 40° C., and the resulted emulsion was chemically sensitized in the same manner as in the emulsion EM-2, so that the emulsion EM-3 was obtained.

Further, a monodispersed silver chlorobromide emulsion having the average grain size ($\bar{r}$) of 0.65 μm and the variation coefficient ($s/\bar{r}$) of 0.12 in the same manner as taken in the case of the emulsion EM-2 except that the mixing temperature was changed to 60° C., and the resulted emulsion was chemically sensitized as was treated in the case of the emulsion EM-2, so that the emulsion EM-4 was obtained.

Still further, Samples 4 and 5 were prepared in the same manner as in the case of the emulsion EM-1, except that the emulsions EM-3 and 4 were mixed up in the proportion of the silver contents between them were adjusted to 1:1 and the mixture was coated to serve as a green sensitive emulsion in the amounts of silver coated of 0.37 g/m$^2$ and 0.34 g/m$^2$, respectively.

Next, Sample-6 was prepared in the same manner as in Sample-1, except that the Exemplified Magenta Coupler (44) was used and the green sensitive emulsion was coated in an amount of 0.20 g/m$^2$ in the terms of silver content.

Further, Sample-7 was prepared in the same manner as in Sample-2, except that the Exemplified Magenta Coupler (44) was used and the green sensitive emulsion was coated in an amount of 0.17 g/m$^2$ in the terms of silver content.

Still further, Sample-8 was prepared in the same manner as in Sample-4, except that the Exemplified Magenta Coupler (44) was used and the green sensitive emulsion was coated in an amount of 0.19 g/m$^2$ in the terms of silver content.

Now, the respective structures of the yellow coupler (Y-1), the magenta coupler (M-1), the cyan coupler (C-1), the ultraviolet absorber (UV-1), the hardener (H-1) and the spectral sensitizing dye (D-1) which were used in Samples 1 through 8 will be given below:

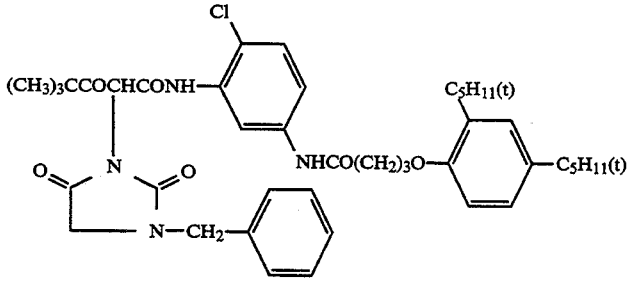

(Y-1)

-continued (M-1)

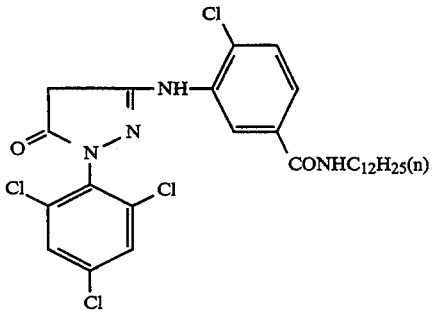

(C-1)

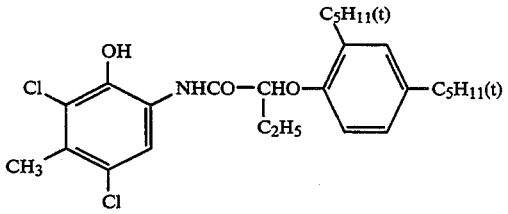

(UV-1)

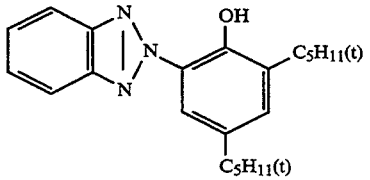

(H-1)

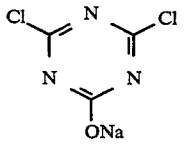

(D-1)

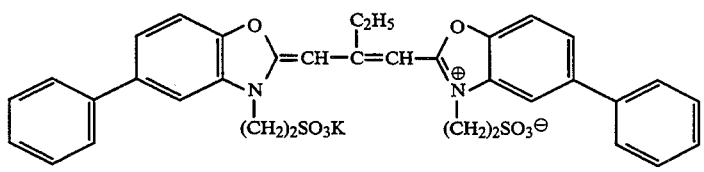

With respect to the resulted Samples 1 through 8, the gradation characteristics thereof (in particular, the attention was paid to the color-balance of each sample) were evaluated in the following manner:

How to evaluate the gradation characteristics (Color balance)

The above-mentioned Samples 1 through 8 were exposed to light by making use of a sensitometer (Model KS-7 manufactured by Konishiroku Photo Industry Co., Ltyd., Japan) through an optical wedge, and were then processed according to the following processing steps, respectively, provided that each of the exposure was so conditioned as to adjust the color density obtained after processed to the neutral, at a density of about 1.0.

| [Developing Process] | | |
|---|---|---|
| Color developing step: | 38° C. | 3 min. 30 sec. |
| Bleach-fixing step: | 33° C. | 1 min. 30 sec. |
| Washing step: | 25~35° C. | 3 min. |
| Drying step: | 77~80° C. | About 2 min. |

| [Color developer] | | |
|---|---|---|
| Benzyl alcohol | 15 | ml. |
| Ethylene glycol | 15 | ml. |
| Potassium sulfite | 2.0 | g. |
| Potassium bromide | 0.7 | g. |
| Sodium chloride | 0.2 | g. |
| Potassium carbonate | 30.0 | g. |
| Hydroxylamine sulfate | 3.0 | g. |
| Polyphosphoric acid (TPPS) | 2.5 | g. |
| 3-methyl-4-amino-N-ethyl-N-(β-methane sulfonamidoethyl)-aniline sulfonate | 5.5 | g. |
| Brightening agent (a 4,4'-diamino stilbenedisulfonic acid derivative) | 1.0 | g. |
| potassium hydroxide | 2.0 | g. |
| Add water to make a total amount to | 1 | liter |
| Adjust the pH value to | 10.20 | |
| [Bleach-fixer] | | |
| Ferric ammonium ethylenediamine tetraacetate dihydrate | 60.0 | g. |
| Ethylenediaminetetracetic acid | 3.0 | g. |
| Ammonium thiosulfate (a 70% solution) | 100 | ml. |
| Ammonium sulfite (a 40% solution) | 27.5 | ml. |
| Adjust the pH value with potassium carbonate or glacial acetic acid to | 7.1 | |
| Add water to make a total amount to | 1 | liter. |

The processed samples resulted thereby were evaluated for the neutrality at the density points of about 0.5, 1.0, 1.5 and 2.0, by making use of a standard color chip (provided according to JIS Z8721 supervided by The JIS Color Chip Committe of The Japan Standards Association). In the evaluation of such gradation characteristics, a sample having the neutrality in every density area is to be graded as the best and a sample having the more shifted density is graded as the worse in gradation characteristics.

The results therefrom are shown in Table 2, below.

Wherein, with respect to the evaluation of the neutrality in the density points of about 0.5, 1.0, 1.5 and 2.0, N indicates that an approximate neutrality is reproduced, and M, C, B and G indicate a shift from the neutrality to magenta, cyan, blue and green, respectively.

TABLE 2

| Sample No. | Magenta coupler | Green sensitive emulsion | Silver amount coated to 3rd layer (g/m$^2$) | Evaluation of neutrality: Density at abt. 0.5 | Density at abt. 1.0 | Density at abt. 1.5 | Density at abt. 2.0 |
|---|---|---|---|---|---|---|---|
| 1 (Comparative) | M-1 | EM-1 | 0.40 | N | N | N | N |
| 2 (Comparative) | " | EM-2 | 0.35 | C~B | N | M | M |
| 3 (Comparative) | " | " | 0.32 | C~B | N | N | G |
| 4 (Comparative) | " | EM-3 + EM-4 | 0.37 | N | N | N | M |
| 5 (Comparative) | " | " | 0.34 | N | N | G | N |
| 6 (Comparative) | Exemplified compound 44 | EM-1 | 0.20 | M | N | N | G |
| 7 (Invention) | Exemplified compound 44 | EM-2 | 0.17 | N | N | N | N |
| 8 (Invention) | Exemplified compound 44 | EM-3 + EM-4 | 0.19 | N | N | N | N |

As is obvious from the results shown in Table 2, it can be understood that the samples each combined the monodispersed emulsion of the invention with the magenta coupler of the invention (i.e., Samples 7 and 8) are excellent in gradation characteristics.

Next, with the purpose of checking up other photographic characteristics than the gradation characteristics, the samples 1 through 8 were evaluated for sensitivity to pressure-induced desensitization in the method described below. The results therefrom are shown in Table 3.

Evaluation of Sensitivity to Pressure-induced Desensitization

A sample is so uniformly exposed to light as to make the magent color density after the development be about 0.5 ans is bent along a piece of stainless-steel rod of 5 mm in diameter at 25° C. and 25% RH. The resulting sample is color-developed in the same manner as in the cases of examples memtioned above and is then measured of the magent density. In this case, the less the variation of the density is, the less the sensitivity to pressure-induced desensitization is.

TABLE 3

| Sample No. | Sensitivity to pressure |
|---|---|
| 1 (For comparison) | −0.15 |
| 2 (For comparison) | −0.01 |
| 3 (For comparison) | 0.00 |
| 4 (For comparison) | −0.02 |
| 5 (For comparison) | −0.02 |
| 6 (For comparison) | −0.13 |
| 7 (of Invention) | −0.01 |
| 8 (of Invention) | −0.01 |

It is found from the Table 3 that, with respect to the sensitivity to pressure-induced desensitization, the Samples 1 and 6 were considerably lowered in density and were at the level practically causing rubs, while the other samples were at the level practically causing no rub at all.

It is also found from the results mentioned above that Sample 1 was at the level causing no rub in gradation characteristics, however, this sample has the serious defects in manufacturing costs because it requires a large amount of silver to be coated, and in the photographic properties, so that this sample cannot satisfy the objets of the invention.

In the Samples 2, 3, 4 and 5, it is found that the gradation characteristics are not fully satisfied by only making use of the magenta coupler of the invention, but the invention using the monodispersed emulsion of the invention and the magenta coupler of the invention is combination is the only way for obtaining a color photographic light-sensitive material for printing use which is excellent in gradation characteristics and sensitivity to pressure-induced desensitization and is also capable of being manufactured at an inexpensive cost.

EXAMPLE-2

Samples 9 through 21 were prepared in the same manner as taken in the case of Example-1 except that the emulsions, EM-1 and EM-2, were used to serve as the green-sensitive emulsion, and the magenta coupler and the coating weight of silver were conditioned as shown in Table 4 and, further, the solvent, S-12, were used to serve as the high-boiling organic solvent for the magenta coupler.

With respect to the above-mentioned Samples 9 through 21, the gradation characteristics thereof were evaluated in the same manner as in Example-1, respectively. The results therefrom are shown in Table 4, below.

The sensitivity to pressure-induced desensitization thereof were also evaluated in the same manner as in Example-1, and the results therefrom are shown in Table 4, together.

For reference, the structures of the magenta couplers, M-2 and M-3, indicated in Table 4 are given below:

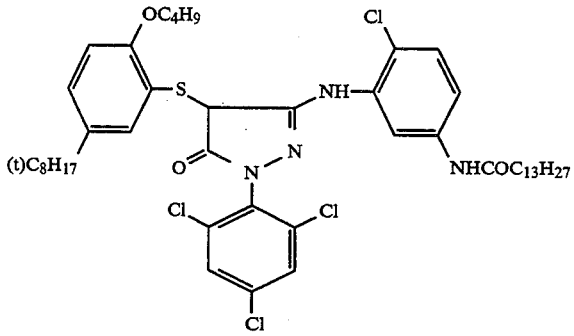

(M-2)

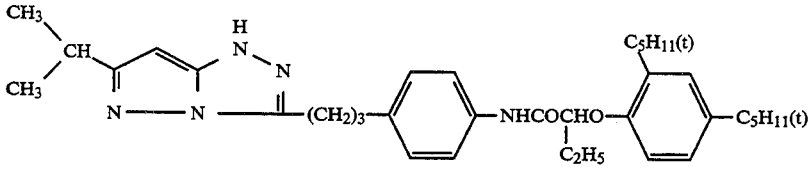

(M-3)

TABLE 4

| Sample No. | Magenta coupler | Green sensitive material | Coating wt. of silver to 3rd layer (g/m²) | Evaluation of neutrality: Density at abt. 0.5 | Density at abt. 1.0 | Density at abt. 1.5 | Density at abt. 2.0 | Sensitivity to pressure-induced desensitization |
|---|---|---|---|---|---|---|---|---|
| 9 (Invention) | Exemplified compound 5 | EM-2 | 0.16 | N~G | N | N | N | −0.03 |
| 10 (Invention) | Exemplified compound 18 | " | 0.17 | N~G | N | N | N | −0.02 |
| 11 (Invention) | Exemplified compound 28 | " | 0.17 | N | N | N | N | −0.01 |
| 12 (Invention) | Exemplified compound 45 | " | 0.18 | N | N | N | N | −0.01 |
| 13 (Invention) | Exemplified compound 59 | " | 0.16 | N | N | N | N | −0.02 |
| 14 (Invention) | Exemplified compound 104 | " | 0.19 | N~M | N | N | N | −0.03 |
| 15 (Invention) | Exemplified compound 127 | " | 0.17 | N | N | N | N | −0.03 |
| 16 (Invention) | Exemplified compound 152 | " | 0.19 | N | N | N | N | −0.04 |
| 17 (Comparative) | M-2 | EM-2 | 0.18 | G | N | M | M | −0.01 |
| 18 (Comparative) | " | " | 0.16 | C~G | N | N | G | −0.02 |
| 19 (Comparative) | " | EM-1 | 0.19 | N | N | N | N | −0.17 |
| 20 (Comparative) | M-3 | EM-2 | 0.35 | M | N | G | G | 0.00 |
| 21 (Comparative) | " | " | 0.38 | M | N | N | M | −0.01 |

It is found from the results shown in Table 4 that a color photographic light-sensitive material for printing use which is excellent in gradation characteristics and other photographic properties and is also capable of being manufactured at an inexpensice cost that is the object of the invention can be prepared solely by the constitution of the invention comprising a green-sensitive emulsion containing the combination of a monodispersed emulsion and the magenta coupler of the invention having a specific structure.

What is claimed is:

1. A color photographic light-sensitive material which comprises a reflective support and a blue sensitive silver halide emulsion layer, a green sensitive silver halide emulsion layer, and a red sensitive silver halide emulsion layer, said green sensitive silver halide emulsion layer comprising a magenta coupler and a monodispersed silver chlorobromide emulsion; wherein said monodispersed silver chlorobromide emulsion has an $S/\bar{r}$ ratio of not more than 0.22, wherein S is a statistical standard deviation of grain size and $\bar{r}$ is an average grain size, said magenta coupler being represented by Formula II or III

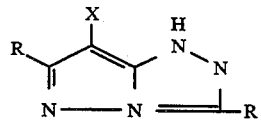

Formula [II]

or

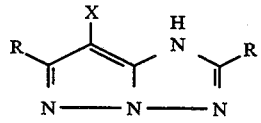

Formula [III]

wherein the R's, which may be the same or different, represent hydrogen or a substituent, and X represents a substituent capable of splitting off through a reaction thereof with oxidation products of a color developing agent.

2. The material of claim 1 wherein r is 0.25 to 0.75 μm.

3. The material of claim 2 wherein r is 0.35 to 0.65 μm.

4. The material of claim 1 wherein said silver chlorobromide emulsion contains silver chlorobromide grains having at least 5 mol % of silver chloride.

5. The material of claim 4 wherein said silver chlorobromide emulsion contains silver chlorobromide grains with a silver chloride content of at least 15 mol %.

* * * * *